US009042802B2

(12) United States Patent
Hase et al.

(10) Patent No.: US 9,042,802 B2
(45) Date of Patent: May 26, 2015

(54) IMAGE FORMING APPARATUS

(71) Applicants: Takamasa Hase, Shizuoka (JP); Shinya Nakayama, Shizuoka (JP); Atsushi Yamamoto, Osaka (JP); Hideyuki Santo, Kanagawa (JP); Minoru Masuda, Shizuoka (JP); Yukiko Iwasaki, Kanagawa (JP); Tsuneyasu Nagatomo, Shizuoka (JP)

(72) Inventors: Takamasa Hase, Shizuoka (JP); Shinya Nakayama, Shizuoka (JP); Atsushi Yamamoto, Osaka (JP); Hideyuki Santo, Kanagawa (JP); Minoru Masuda, Shizuoka (JP); Yukiko Iwasaki, Kanagawa (JP); Tsuneyasu Nagatomo, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/190,459

(22) Filed: Feb. 26, 2014

(65) Prior Publication Data

US 2014/0270874 A1 Sep. 18, 2014

(30) Foreign Application Priority Data

Mar. 15, 2013 (JP) ..... 2013-054298
Jan. 10, 2014 (JP) ..... 2014-003692

(51) Int. Cl.
*G03G 15/20* (2006.01)

(52) U.S. Cl.
CPC ..... *G03G 15/2064* (2013.01)

(58) Field of Classification Search
USPC ..... 399/107, 110, 122, 320, 328, 329; 219/216, 619
See application file for complete search history.

(56) References Cited

U.S. PATENT DOCUMENTS

| | | | | |
|---|---|---|---|---|
| 2011/0200837 | A1* | 8/2011 | Yoshizawa et al. | 428/500 |
| 2012/0282000 | A1 | 11/2012 | Nakayama et al. | |
| 2013/0078563 | A1 | 3/2013 | Nakayama et al. | |
| 2013/0095422 | A1 | 4/2013 | Yamamoto et al. | |
| 2013/0108950 | A1 | 5/2013 | Yamamoto et al. | |
| 2013/0115550 | A1 | 5/2013 | Amemori et al. | |
| 2013/0157183 | A1 | 6/2013 | Santo et al. | |
| 2013/0157185 | A1 | 6/2013 | Sakashita et al. | |
| 2013/0236826 | A1 | 9/2013 | Keiji MAKABE et al. | |
| 2013/0244153 | A1 | 9/2013 | Nakayama et al. | |
| 2013/0244154 | A1 | 9/2013 | Yamamoto et al. | |
| 2013/0252158 | A1 | 9/2013 | Yamada et al. | |
| 2013/0260298 | A1 | 10/2013 | Amemori et al. | |

FOREIGN PATENT DOCUMENTS

| | | |
|---|---|---|
| JP | 7-234596 | 9/1995 |
| JP | 2004-157529 | 6/2004 |
| JP | 2008-287088 | 11/2008 |
| JP | 2010-077419 | 4/2010 |
| JP | 2010-151996 | 7/2010 |

* cited by examiner

*Primary Examiner* — Hoan Tran
(74) *Attorney, Agent, or Firm* — Oblon, McClelland, Maier & Neustadt, L.L.P.

(57) ABSTRACT

An image forming apparatus includes: an image bearing member; a charger; an irradiator; a development device having an accommodation unit to accommodate toner to obtain a visible image; a transfer device; and a fixing device to fix the visible image transferred onto a recording medium. The fixing device having a fixing rotation member; and a pressure rotation member to form a nipping portion by contacting the fixing rotation member, wherein the surface pressure of the nipping portion is 1.5 kgf/cm$^2$ or less, wherein the fixing rotation member has a Martens hardness of 1.0 N/mm$^2$ or less at 23° C., wherein the ratio of the projected area of a single particle of the toner onto the recording medium at 120° C. to the projected area of a single particle of the toner onto the recording medium at 23° C. is 1.60 or less.

13 Claims, 7 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application Nos. 2013-054298 and 2014-003692 filed on Mar. 15, 2013 and Jan. 10, 2014, respectively, in the Japan Patent Office, the entire disclosures of which are hereby incorporated by reference herein.

BACKGROUND

1. Technical Field

The present invention relates to an image forming apparatuses.

2. Background Art

Image forming apparatuses employing electrophotography, for example, printers, are used to form images with toner. Such an image forming apparatus forms an image by: developing a latent electrostatic image formed on an image bearing member with toner; transferring the thus-obtained toner image to a recording medium; and fixing the toner image thereon by melting the toner upon application of heat. This fixing process requires a lot of electric power to melt and fuse toner. For this reason, using toner having a low temperature fixability is an issue in terms of energy efficiency.

In efforts to improve this low temperature fixability of toner, for example, JP-2010-077419-A and JP-2010-151996-A disclose toner containing a crystalline resin as a binder resin.

However, as the content of such a crystalline resin increases in toner containing the crystalline resin as a binder resin, the toner becomes soft because the resin is soft. Such toner is weak to stirring stress in a development unit so that toner and carrier are easily agglomerated, resulting in production of defective images.

The hardness of toner can be improved by, for example, introducing a urethane bond, etc. into a crystalline resin.

However, since the toner becomes hard, it loses ductility. For this reason, anchoring between the toner and a recording medium is lowered, thus degrading the low temperature fixability of the toner. When an image is formed in monochrome mode or a half tone image is formed, the attachment amount of toner is few in particular. In such a case, the attachment force between toner is not strong. As a consequence, the low temperature fixability is worsened in comparison with when forming an image with a large amount of toner, for example, forming an image in color mode.

Typically, increasing the surface pressure (pressure of the contact surface) of the nip (nipping portion) of a fixing unit is a way to improve anchoring between toner having low ductility and a recording medium. However, the releasability between toner and a fixing member is lowered, thereby degrading the hot offset resistance of the toner. In addition, to maintain durability, the substrate of a fixing roller and a core material of a pressure roller are thickened, which leads to an increase of the heat capacity of such fixing members. This is not preferable in terms of energy efficiency.

SUMMARY

The present invention provides improved image forming apparatus including an image bearing member; a charger to charge the image bearing member; an irradiator to expose the image bearing member to light to form a latent electrostatic image thereon; a development device having an accommodation unit that accommodates toner to develop the latent electrostatic image therewith to obtain a visible image; a transfer device to transfer the visible image to a recording medium; and a fixing device to fix the visible image transferred onto the recording medium, the fixing device including a fixing rotation member; and a pressure rotation member to form a nipping portion by contacting the fixing rotation member, wherein the surface pressure of the nipping portion is 1.5 kgf/cm$^2$ or less, wherein the fixing rotation member has a Martens hardness of 1.0 N/mm$^2$ or less at 23° C., wherein the ratio of the projected area of a single particle of the toner onto the recording medium at 120° C. to the projected area of a single particle of the toner onto the recording medium at 23° C. is 1.60 or less.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

The present invention is to provide an image forming apparatus having excellent low temperature fixability and hot offset resistance even for toner having a low ductility.

In the present disclosure, an image forming apparatus is provided which has an image bearing member; a charger to charge the image bearing member; an irradiator to expose the image bearing member to light to form a latent electrostatic image thereon; a development device comprising an accommodation unit that accommodates toner to develop the latent electrostatic image therewith to obtain a visible image; a transfer device to transfer the visible image to a recording medium; and a fixing device to fix the visible image transferred onto the recording image, the fixing device having a fixing rotation member and a pressure rotation member to form a nipping portion by contacting the fixing rotation member, wherein the surface pressure of the nipping portion is 1.5 kgf/cm$^2$ or less, wherein the fixing rotation member has a Martens hardness of 1.0 N/mm$^2$ or less at 23° C. With regard to the toner, the ratio of the projected area of one toner particle onto the recording medium at 120° C. to the projected area of one toner particle onto the recording medium at 23° C. is 1.60 or less.

Next, embodiments of the present disclosure are described with reference to accompanying drawings.

The toner having a low ductility means that the ratio of the projected area S(120) of one toner particle onto the recording medium at 120° C. to the projected area S(23) of one toner particle onto the recording medium at 23° C. is 1.60 or less. When the ratio (S(120)/S(23) is too large, for example, greater than 1.60, the fixing range becomes narrow.

The ratio S(120)/S(23) can be measured as follows: First, after a development agent formed of a mixture of toner and carrier is placed on a mesh, the development agent is blown onto a recording medium by air so as to attach it thereto one toner particle by one toner particle. Next, the portion of the recording medium where the toner is attached is cut out to 10 mm×10 mm and placed on a heating plate. Furthermore, the cut-out portion is heated at 10° C./min. by the heating plate. Still images are taken by optical microscope in monitoring. Next, from the sill image, the projected area of a single toner particle onto the recording medium is obtained by using image analysis software and thereafter S(120)/S(23) is calculated. The projected area of a single toner particle onto the recording medium is the average of 50 toner particles.

Figure 1:
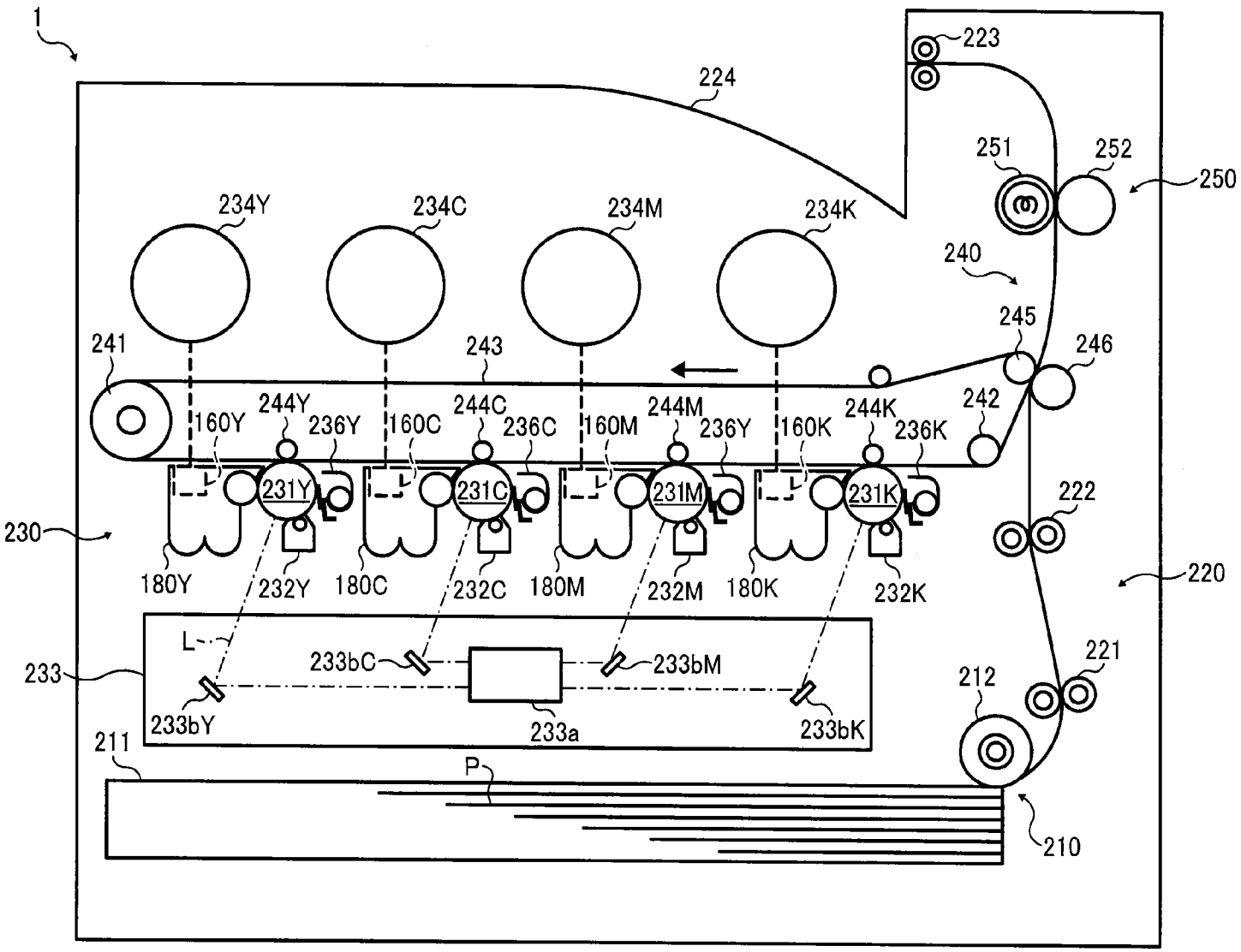
FIG. 1 is a schematic diagram illustrating an image forming apparatus according to an embodiment of the present invention.

FIG. 1 is a diagram illustrating an example of the image forming apparatus according of the present disclosure.

An image forming apparatus 1 is a printer but the image forming apparatus of the present invention is not limited thereto. For example, any of a photocopier, a facsimile machine. or a multi-functional machine that can form images with toner is suitable.

The image forming apparatus 1 include: a sheet feeder 210, a sheet transfer unit 220, an image forming unit 230, an image transfer unit 240, and a fixing device 250.

The sheet feeder 210 has a sheet cassette 211 on which sheets P to be fed are accommodated and a sheet feeding roller 212 that feeds the sheet P accommodated in the sheet cassette 211 one by one.

The sheet transfer unit 220 includes a roller 221 to transfer the sheet P fed from the sheet feeding roller 212 to the direction of the image transfer unit 240; a pair of timing rollers 222 to pinch the front end of the sheet P transferred from the roller 221 to be ready for the particular timing on which the sheet P is sent out to the image transfer unit 240; and a discharging roller 223 to discharge the sheet P on which a color toner image is attached to a discharging tray 224.

The image forming unit 230 includes four image forming units arranged from left to right in the following order with the same gap therebetween in FIG. 1; which are an image forming unit Y to form an image using a development agent containing yellow toner; an image forming unit C to form an image using a development agent containing cyan toner; an image forming unit M to form an image using a development agent containing magenta toner; and an image forming unit K to form an image using a development agent containing black toner. The image forming unit 230 also includes an irradiator 233.

"The image forming unit" is used instead of these image forming units Y, C, M, and K when indicating any one of them.

In addition, the development agent contains toner and a carrier.

The four image forming units Y, C, M and K have the substantially same mechanical structure except for the development agents used therein.

The image forming units Y, C, M, and K are rotatable clockwise in FIG. 1. They each have image bearing drums (image bearing members, photoreceptors) 231Y, 231C, 231M, and 231K; chargers 232Y, 232C, 232M, and 232K to charge the surfaces of the image bearing drums 231Y, 231C, 231M, and 231K, respectively; development devices 180Y, 180C, 180M, and 180K to develop with each color toner latent electrostatic images formed on the surfaces of the image bearing drums 231Y, 231C, 231M, and 231K, respectively, by the irradiator 233; and cleaning device (cleaner) 236Y, 236C, 236M, and 236K to remove toner remaining on the surface of the image bearing drums 231Y, 231C, 231M, and 231K, respectively.

In addition, the image forming units Y, C, M, and K include toner cartridges 234Y, 234C, 234M, and 234K, respectively, and sub-hoppers 160Y, 160C, 160M, and 160K to replenish the toner supplied from the toner cartridges 234Y, 234C, 234M, and 234K, respectively.

The toner accommodated in the toner cartridge 234 is discharged by a suction pump and supplied to the sub-hopper 160 via a supplying tube. The sub-hopper 160 transfers the toner supplied from the toner cartridge 234 to replenish it to the development device 180. The development device 180 develops the latent electrostatic image formed on the image bearing drum 231 using the toner replenished from the sub-hopper 160.

"The image bearing drum 231" is used instead of these image bearing drums 231Y, 231C, 231M, and 231K when indicating any one of them. In addition, "the charger 232" is used instead of these chargers 232Y, 232C, 232M, and 232K when indicating any one of them.

In addition, "the toner cartridge 234" is used instead of these toner cartridges 234Y, 234C, 234M, and 234K when indicating any one of them.

In addition, "the sub-hopper 160" is used instead of these sub-hoppers 160Y, 160C, 160M, and 160K when indicating any one of them.

In addition, "the development device 180" is used instead of these development devices 180Y, 180C, 180M, and 180K when indicating any one of them.

In addition, "the cleaning device 236" is used instead of these cleaning devices 236Y, 236C, 236M, and 236K when indicating any one of them.

There is no specific limit to the image bearing drum 231. Specific examples thereof include, but are not limited to, inorganic image bearing drums such as an amorphous silicone image bearing drum and a selenium image bearing drum, and organic image bearing drums such as a phthalopolymethylne image bearing drum. Of these, amorphous silicon image bearing drums are preferable in terms of the length of working life.

There is no specific limit to the charger 232. Any known charger can be selected. Specific examples thereof include, but are not limited to, known contact type chargers having an electroconductive or semi-electroconductive roll, brush, film, rubber blade, etc. and non-contact type chargers such as a corotron or a scorotron which utilizes corona discharging.

It is preferable to apply a direct voltage or a voltage obtained by superimposing an alternating voltage to a direct voltage to the surface of the image bearing drum 231 by the charger arranged in contact with or in the vicinity of the image bearing drum.

Moreover, it is preferable that the charger 232 is a charging roller arranged in the proximity of the image bearing drum 231 via a gap tape to be not in contact therewith and charges the surface of the image bearing drum 231 by applying a direct voltage or an alternating voltage to the charging roller.

The irradiator 233 irradiates the image bearing drum 231 with the laser beam L emitted from a light source 233*a* according to image data via reflection at polygon mirrors 233*b* (233*by*, 233*b*C, 233*b*M, and 233*b*K) rotationally driven by a motor.

There is no specific limit to the irradiator 233. Any irradiation device that can expose the surface of the image bearing drum 231 charged by the charger 232 according to image data to light is suitably used. Specific examples of such irradiators include, but are not limited to, variety of irradiators such as of a photocopying optical system, a rod lens array system, a laser optical system, or a liquid crystal shutter optical system.

As to the present disclosure, the rear side irradiation system in which the image bearing drum 231 is irradiated according to image data from the rear side thereof can be also employed.

There is no specific limit to the development device 180. Any development device that can conduct development is usable. It is preferable to use a development device that accommodates a development agent containing toner and provide the development agent to a latent electrostatic image in a contact or non-contact manner and more preferable to use a development device having a container that accommodates a development agent.

Both a single color development device and a multi-color development device can be used as the development device 180.

There is no specific limit to cleaning device 236. Any cleaning device that can remove residual toner remaining on the surface of the image bearing drum 231 is usable. Cleaners having a cleaning member 236*a* such as a magnetic brush cleaner, an electrostatic brush cleaner, a magnetic roller cleaner, a blade cleaner, a brush cleaner, or a web cleaner are preferable.

The image bearing drum 231 from which residual toner is removed by the cleaning device 236 is discharged to remove residual voltage, by which a series of the image forming processes conducted on the image bearing drum 231 are finished.

The image transfer unit 240 includes a driving roller 241, a driven roller 242, an intermediate transfer belt 243 rotatable counterclockwise in FIG. 1, a primary transfer belt 244Y, 244C, 244M, and 244K provided facing the image bearing drum 231, a secondary facing roller 245, and a secondary transfer roller 246. The secondary facing roller 245 and the secondary transfer roller 246 are arranged at the transfer position of a toner image to a recording medium facing each other with the intermediate transfer belt 243 therebetween.

"The primary transfer roller 244" is used instead of these primary transfer rollers 244Y, 244C, 244M, and 244K when indicating any one of them.

The primary transfer bias having a reverse polarity to that of the toner is applied to the primary transfer roller 244. The intermediate transfer belt 243 is sandwiched by the primary transfer roller 244 and the image bearing drum 231 to form a primary transfer nip. At this nip, each color toner image formed on the surface of the image bearing drum 231 is primarily transferred to the intermediate transfer belt 243. The intermediate transfer belt 243 rotates in the direction indicated by the arrow in FIG. 1. Then, each color toner image formed on the image bearing drum 231Y, 231C, 231M. and 231K is sequentially transferred to the intermediate transfer belt 243 to form a color toner image thereon.

To the secondary transfer roller 246 of the image transfer unit 240, a secondary transfer bias is applied. The color toner image formed on the intermediate transfer belt 243 is secondarily transferred to the sheet P sandwiched at the secondary transfer nip between the secondary transfer roller 246 and the secondary facing roller 245.

The fixing device 250 includes a fixing belt 251 to heat the sheet P by a heater provided inside thereof and a pressure roller 252 to apply a pressure to the fixing belt 251 to form a nip (nipping portion) therebetween in such a manner that both are rotatable. At the nip, heat and pressure are applied to the color toner image on the sheet P to fix it thereon. The sheet P on which the color toner image is fixed is discharged to the discharging tray 224 by the discharging roller 223 to complete the series of image forming process.

Next, the structure of the image forming unit 230 is described in detail with reference to FIGS. 2 and 3.

The development device 180 includes an accommodation unit. The accommodation unit is formed of, for example, a primary accommodation unit 181 and a secondary accommodation unit 183. The development device 180 includes a primary transfer screw 182 provided to a primary accommodation unit 181, a concentration detecting sensor 187, a secondary transfer screw 184 provided to a secondary accommodation unit 183, a development roller 185, and a doctor blade 186. The primary accommodation unit 181 and the secondary accommodation unit 182 preliminarily accommodate carriers.

A replenishing mouth B1 connected to the sub-hopper 160 is formed to the primary accommodation unit 181. Replenishment of toner by the sub-hopper 160 is controlled based on the detection result by the concentration detecting sensor 187 in order that the rate (concentration) of the toner in a development agent is within a particular range.

Figure 2:
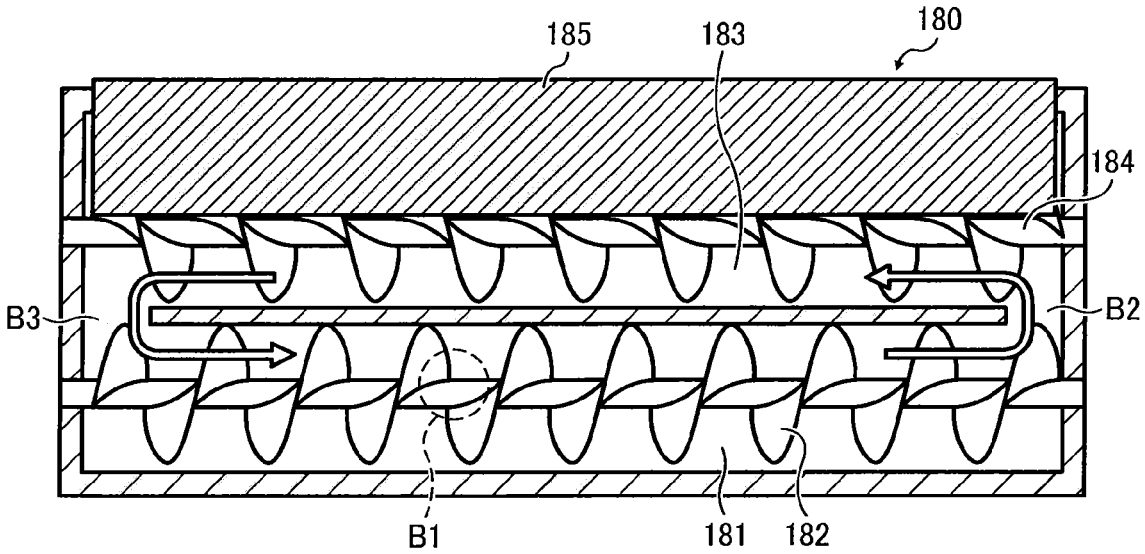
FIG. 2 is a diagram illustrating a horizontal section of the development device of FIG. 1.
Figure 3:
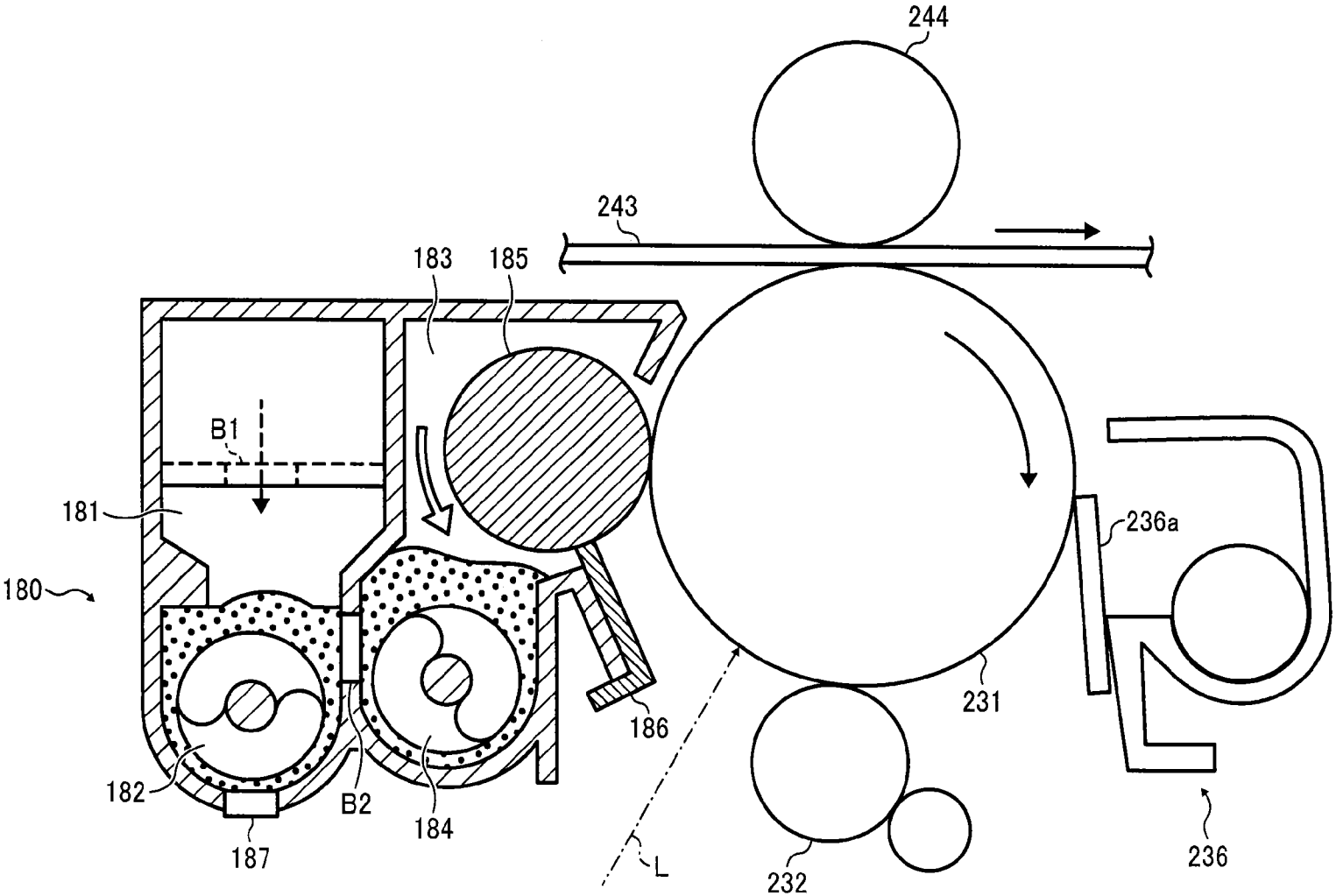
FIG. 3 is a diagram illustrating a longitudinal section of the image forming unit of FIG. 1.

The toner replenished into the primary accommodation unit 181 is circulated in the primary accommodation unit 181 and the secondary accommodation unit 183 in the direction indicated by the arrow in FIG. 2 via piercing holes B2 and B3 while being mixed and stirred together with carriers by the primary transfer screw 182 and the secondary transfer screw 184. The toner is attached to the carrier by triboelectric charging during the circulation.

A development roller 185 includes a magnet roller inside thereof. The toner being transferred in the secondary accommodation unit 183 is attached together with the carrier to the development roller by the magnet force generated by the magnetic roller. The development agent attached to the development roller 185 is transferred according to the rotation of the development roller 185 and thereafter the thickness of the development agent is regulated by a doctor blade 186. The development agent having a regulated thickness is transferred to the position facing the image bearing drum 231 and thereafter the toner is attached to the latent electrostatic image formed on the image bearing drum 231. As a result, a toner image is formed on the image bearing drum 231. The development agent from which the toner on the development roller 185 is consumed is returned to the secondary accommodation unit 183 according to the rotation of the development roller 185. Furthermore, the development agent from which the toner is consumed is transferred to the secondary transfer unit 183 by the secondary transfer screw and thereafter is returned to the primary accommodation unit 181 via a piercing hole B3.

Next, the structure of the fixing device 250 is described in detail with reference to FIG. 4.

The fixing device 250 includes a flexible fixing belt 251 having an endless form, a pressure roller 252, a supporting member 24, a halogen heater 25, and a thermopile 40. The fixing belt 251 rotates counterclockwise as indicated by an arrow in FIG. 4.

Figure 5:
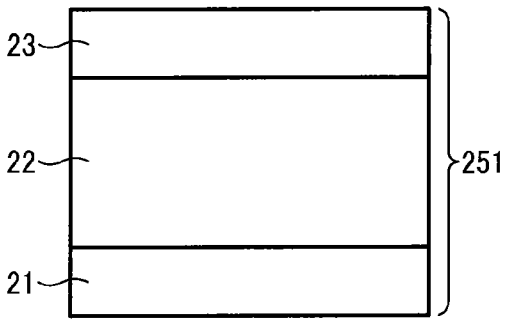
FIG. 5 is a diagram illustrating a cross-section of the structure of the fixing belt of FIG. 1.

The fixing belt 251 has a substrate 21 on which an elastic layer 22 and a releasing layer 23 are laminated as illustrated in FIG. 5.

The entire thickness of the fixing belt 251 is normally 1 mm or less.

The substrate has a thickness of from 20 μm to 50 μm.

There is no specific limit to the materials that form the substrate 21. Specific examples thereof include, but are not limited to, metal such as nickel and copper steel and resins such as polyimide. Of these, nickel or polyimide are preferable in terms of low temperature fixability.

The elastic layer 22 preferably has a thickness of 100 μm or more. When the thickness of the elastic layer is too thick, the fixing device is not able to trace minute roughness of the surface of a toner image, which tends to degrade the low temperature fixability of the toner. The elastic layer 22 normally has a thickness of 300 μm or less.

There is no specific limit to the material that forms the elastic layer 22. Specific examples thereof include, but are not limited to, rubber materials such as silicone rubber, expandable silicone rubber, and fluorine-containing rubber.

The releasing layer 23 preferably has a thickness of 10 μm or less. When the thickness of the releasing layer 23 is too thick, the fixing device is not able to trace minute roughness of the surface of a toner image, which tends to degrade the low temperature fixability of the toner. The thickness of the releasing layer 23 is normally 30 μm or more.

There is no specific limit to the material that forms the releasing agent 23 Specific examples thereof include, but are not limited to, copolymers of tetrafluoroethylene perfluoroalkyl vinyl ether (PFA), polytetrafluoroethylene (PTFE), polyimide, polyetherimide, and polyether sulfide (PES).

The fixing belt 251 has a Martens hardness at 23° C. of 1.0 $N/mm^2$ or less and preferably 0.5 $N/mm^2$ or less. When the Martens hardness of the fixing belt 251 at 23° C. is too small, the fixing device is not able to trace minute roughness of the surface of a toner image, which tends to degrade the low temperature fixability of the toner. The Martens hardness of the fixing belt 251 at 23° C. is normally 2.0 $N/mm^2$ or more.

The Martens hardness of the fixing belt 251 is measured as follows: After cutting the fixing belt 251 to a square of 10 mm, the square is placed on the stage of a hardness measuring instrument (Fisherscope H100, manufactured by Helmut Fischer GmbH) with the releasing layer 23 upside and measured thereby at 23° C. A microVickers indenter is used. Load and no load is applied to the fixing belt 241 in turns with the press-in depth of 20 μm at most.

The outer diameter of the fixing belt 25 is normally from 20 mm to 40 mm.

The halogen heater 25 and the supporting member 24 are provided inside the fixing belt 251. The fixing belt 251 forms a nip with the pressure roller 252 by being pressed by a contact member 26 supported by the supporting member 24 and a slidable member 27. By this structure, the contact member 26 and the slidable member 27 are prevented from being transformed significantly.

At this point, the surface pressure (pressure of the contact surface) of the nip is 1.5 $kgf/cm^2$ or less and preferably 1.3 $kgf/cm^2$ or less. When the surface pressure of the nip is too large, hot offset resistance tends to deteriorate. In addition, to maintain durability, the thickness of the supporting member 24 and a core metal 31 of the pressure roller 252 are thickened, thereby increasing the heat capacity of the fixing device250, resulting in degradation of energy efficiency. The surface pressure of the nip is 0.5 $kgf/cm^2$ or less.

The supporting member 24 is formed in such a manner that the length in the width direction is the same as those of the contact member 26 and the slidable member 27. Both ends of the supporting member 24 in the width direction are fixed by side plates.

There is no specific limit to the material forming the supporting member 24. Specific examples thereof include, but are not limited to, metal materials having a high mechanical strength such as stainless steel and iron.

It is preferable that the supporting member 24 has a cross section having a longer side along the direction of the pressure from the pressure roller 252. As a result, the supporting roller becomes mechanically strong because the cross section coefficient is increased.

Part or all of the surface of the supporting member 24 facing the halogen heater 25 has a reflection plate 28 treated with mirror treatment. For this reason, heat transmitting from the halogen heater 25 to the supporting member 24 is utilized to heat the fixing belt 251, which contributes to improvement of heating efficiency of the fixing belt 251.

Both end of the halogen heater 25 are fixed onto side plates of the fixing device 250. The fixing belt 251 is heated by radiation heat of the halogen heater 25. The heat amount of the halogen heater 25 is controlled by the power unit of the image forming apparatus 1. Furthermore, heat is applied from the surface of the fixing belt 251 to a color toner image T. The output of the halogen heater 25 is controlled based on the detection result of the surface temperature of the fixing belt 251 by the thermopile 40 facing the surface of the fixing belt 251. In addition, by the control of the output of the halogen heater 25, the surface temperature of the fixing belt 251 can be set desirably.

In the fixing device 250, the fixing belt 250 is not heated locally but entirely along the circumference direction. For this reason, the fixing belt 251 is sufficiently heated even when the fixing device 250 is operated at high speed, which contributes to prevention of no-good fixing. That is, since the fixing belt 251 is heated efficiently by a relatively simple structure, the warm-up time and first print output time can be shortened and the fixing device 250 can be downsized.

The outer diameter of the pressure roller 252 is normally from 20 mm to 40 mm.

The pressure roller has the elastic layer 32 on the core metal 31.

There is no specific limit to materials that form the core metal 31. Specific examples thereof include, but are not limited to, metal materials such as stainless steel and aluminum.

There is no specific limit to materials that form the elastic layer 32. Specific examples thereof include, but are not limited to, rubber materials such as silicone rubber, expandable silicone rubber, and fluorine-containing rubber.

Optionally, a releasing layer can be formed on the elastic layer 32.

There is no specific limit to materials that form the releasing layer. Specific examples thereof include, but are not limited to, tetrafluoroethylene perfluoroalkyl vinyl ether (PFA) and polytetrafluoroethylene (PTFE).

The pressure roller 252 includes a gear that is engaged with a driving gear of a driving mechanism. The gear is rotated clockwise as indicated by the arrow in FIG. 4. In addition, the pressure roller 252 is rotatably supported at both ends in the shaft direction by the side plates of the fixing device 250 via a bearing.

A heat source such as a halogen heater can be optionally provided inside the pressure roller 252.

When the elastic layer 32 contains a sponge-like material such as expandable silicone rubber, it is possible to reduce the pressure onto the nip. Therefore, is possible to deflection occurring to the contact member 26 and the slidable member 27. Furthermore, since the heat insulating properties of the pressure roller 252 is improved, the heat of the fixing belt 251 is never or little transferred to the pressure roller 252. Therefore, the heating efficiency of the fixing belt 251 is improved.

The outer diameter of the fixing belt 251 is significantly the same as the outer diameter of the pressure roller 252 but can be smaller than that. In this case, since the curvature of the fixing belt 251 at the nip is smaller than that of the pressure roller 252, the sheet P sent out from the nip is easily separated from the fixing belt 251.

The behavior of the fixing device 250 is described below.

Figure 4:
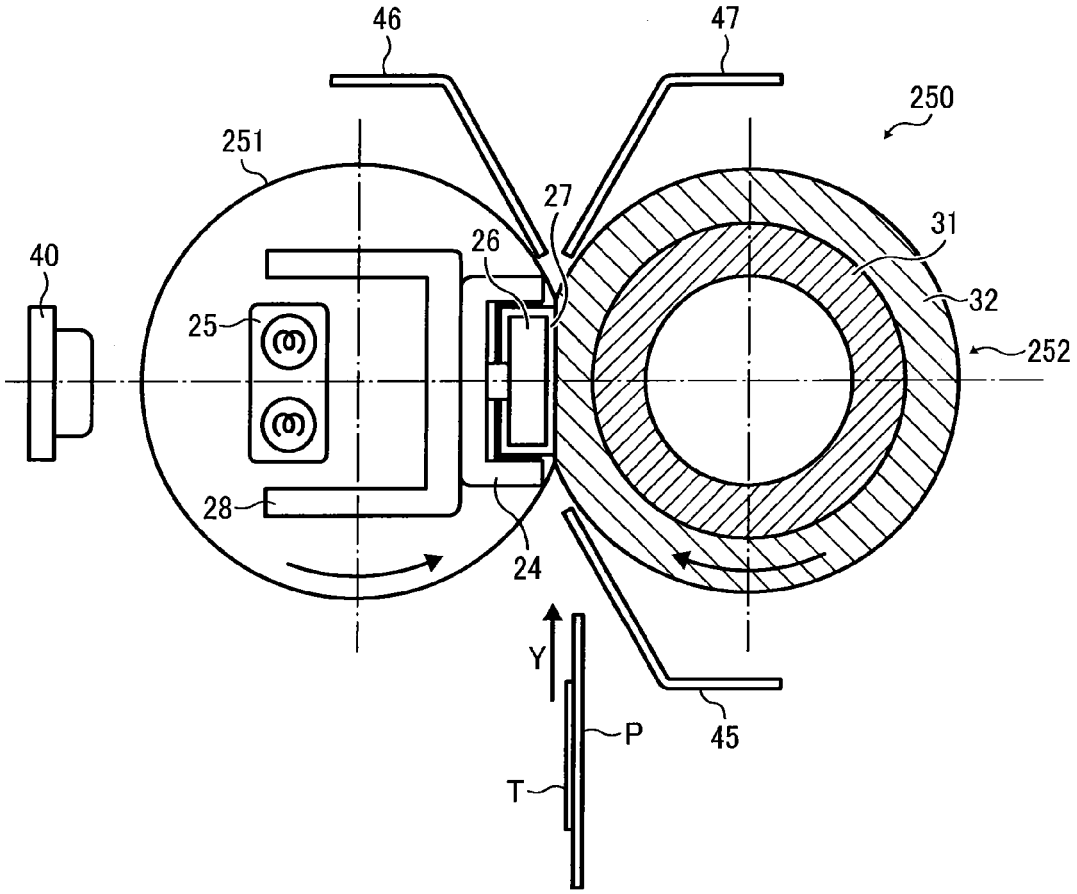
FIG. 4 is a diagram illustrating a cross-section of the fixing device of FIG. 1.

When the power of the image forming apparatus is on, electricity is supplied to the halogen heater 25 and simultaneously, the pressure roller 252 starts to rotate in the direction indicated by the arrow in FIG. 4. At the same time, the fixing belt is driven to rotate in the direction indicated by the arrow in FIG. 4 by friction force with the pressure roller 252. Thereafter, the sheet P is fed from the sheet feeder 210 and then the color toner image is transferred to the sheet P at the position of the secondary transfer roller 89. The sheet P on which the color toner image T is transferred is guided in a direction Y by an entrance guiding plate 45. Thereafter, the sheet P enters into the nip between the fixing belt 251 and the pressure roller 252. The color toner image T is fixed on the surface of the sheet P by the heat from the fixing belt 251 heated by the halogen heater 25 and the pressure between the contact member 26 and the slidable member 27, which are supported by the supporting member 24 and the pressure roller 252. Thereafter, the sheet P sent out from the nip is guided in the direction Y by a separating plate 46 and an exit guiding plate 47.

Figure 6:
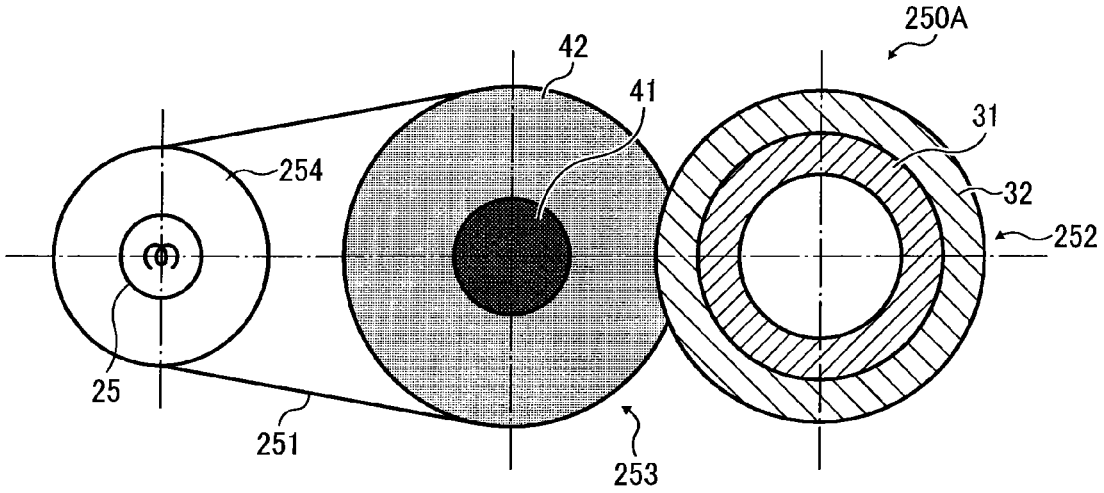
FIG. 6 is diagram illustrating a cross section of a variation of the fixing device of FIG. 1.

FIG. 6 is a diagram illustrating a variation of the fixing device 250. In FIG. 6, the same reference numerals as in FIG. 4 are applied for the structure in common and the descriptions thereof are omitted.

A fixing device 250A includes a flexible fixing belt 251 having an endless form, a pressure roller 252, a fixing roller 253, a heating roller 254, and a halogen heater 25.

The fixing belt 251 is supported by the fixing roller 253 and the heating roller 254.

The fixing roller 253 has an elastic layer 42 on a core metal 41.

There is no specific limit to materials that form the core metal 41. Specific examples thereof include, but are not limited to, metal materials such as stainless steel and aluminum.

There is no specific limit to materials that form the elastic layer 42. Specific examples thereof include, but are not limited to, rubber materials such as silicone rubber, expandable silicone rubber, and fluorine-containing rubber.

The halogen heater is provided inside the heating roller 254.

Figure 7:
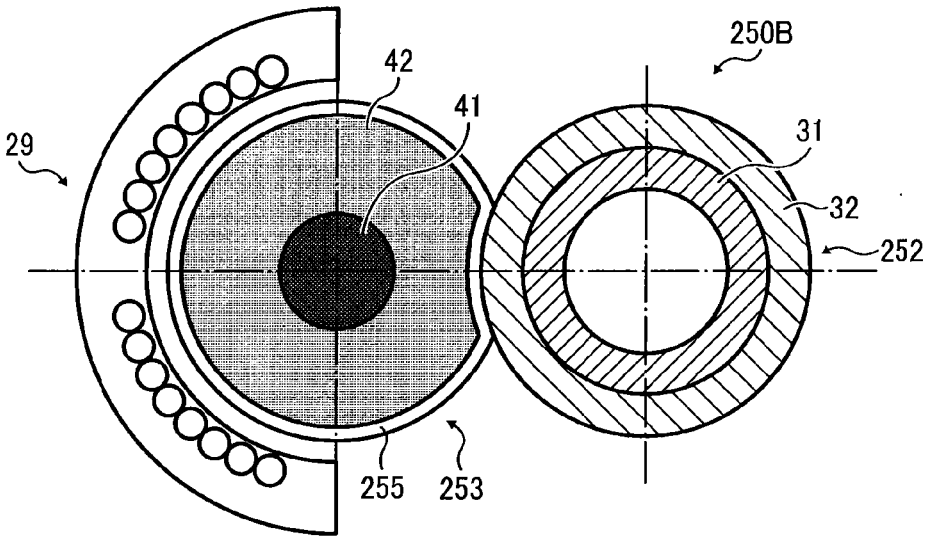
FIG. 7 is diagram illustrating a cross section of another variation of the fixing device of FIG. 1.

FIG. 7 is a diagram illustrating another variation of the fixing device 250. In FIG. 7, the same reference numerals as in FIGS. 4 and 6 are applied for the structure in common and the descriptions thereof are omitted.

A fixing device 250B includes a flexible fixing sleeve 255, a pressure roller 252, a fixing roller 253, and an induction heating (IH) coil 29.

Figure 8:
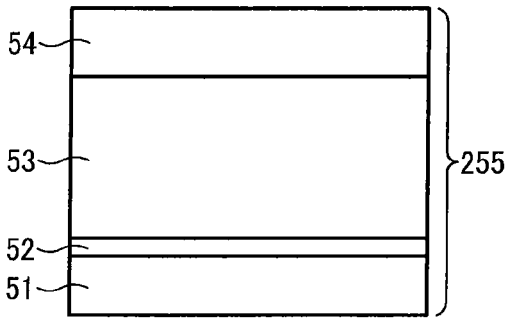
FIG. 8 is a diagram illustrating a cross section of the structure of the fixing sleeve of FIG. 7.

The fixing sleeve 255 is formed on the fixing roller 253 and has a substrate 51 on which a heat generating layer 52, an elastic layer 53, and a releasing layer are laminated in this sequence as illustrated in FIG. 8.

The total thickness of the fixing sleeve 255 is normally 1 mm or less.

The thickness of the substrate 51 is normally from 20 μm to 50 μm.

There is no specific limit to the materials that form the substrate 51. Specific examples thereof include, but are not limited to, metal such as nickel and copper steel and resins such as polyimide. Of these, nickel or polyimide are preferable in terms of tracing minute roughness of the surface of a toner image and ameliorating the low temperature fixability of toner.

The heat generating layer 52 normally has a thickness of from 10 μm to 20 μm.

There is no specific limit to materials that forms the heat generating layer. A specific example thereof is copper.

The elastic layer 53 preferably has a thickness of 100 μm or more. When the elastic layer 53 is too thin, the low temperature fixability of toner tends to deteriorate. The elastic layer 53 normally has a thickness of 300 μm or less.

There is no specific limit to the material that forms the elastic layer 53. Specific examples thereof include, but are not limited to, rubber materials such as silicone rubber, expandable silicone rubber, and fluorine-containing rubber.

The releasing layer 54 preferably has a thickness of 10 μm or less. In addition, when the thickness of the releasing layer 54 is too thick, the low temperature fixing property of toner tends to be worsened.

There is no specific limit to the material that forms the releasing agent 54. Specific examples thereof include, but are not limited to, copolymers of tetrafluoroethylene perfluoroalkyl vinyl ether (PFA) and polytetrafluoroethylene (PTFE).

The Martens hardness of the fixing sleeve 255 at 23° C. is 1.0 $N/mm^2$ or less and preferably 0.5 $N/mm^2$ or less. When the Martens hardness of the fixing sleeve 255 at 23° C. is too large, the fixing sleeve 255 is not able to trace minor roughness of a toner image, thereby degrading the low temperature fixability of the toner image.

The Martens hardness of the fixing sleeve 255 can be measured in the same manner as for the fixing belt 251 after detaching the fixing sleeve 255 from the fixing roller 253.

The outer diameter of the fixing sleeve 255 is normally from 20 mm to 40 mm.

An inducing heating (IH) coil is provided to the outside of the fixing sleeve 255.

Figure 9:
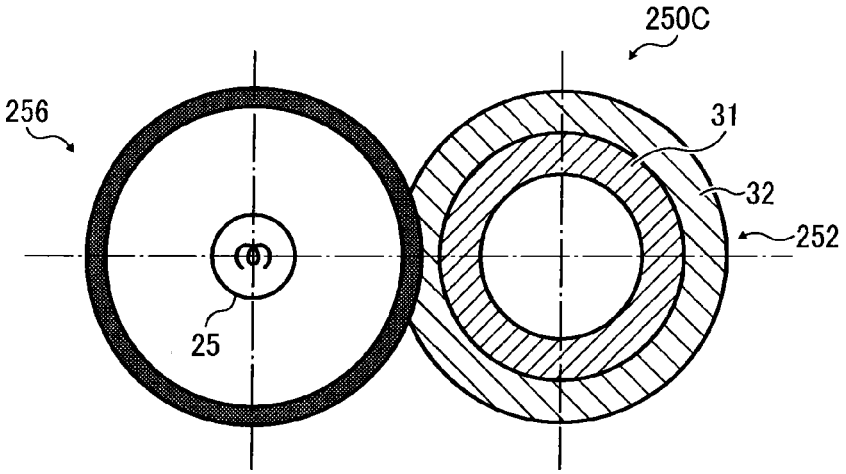
FIG. 9 is a diagram illustrating a cross section of another variation of the fixing device of FIG. 1.

FIG. 9 is a diagram illustrating another variation of the fixing device 250. In FIG. 9, the same reference numerals as in FIG. 4 are applied for the structure in common and the descriptions thereof are omitted.

A fixing device 250C includes a fixing roller 256, the pressure roller 252, and the halogen heater 25.

Figure 10:
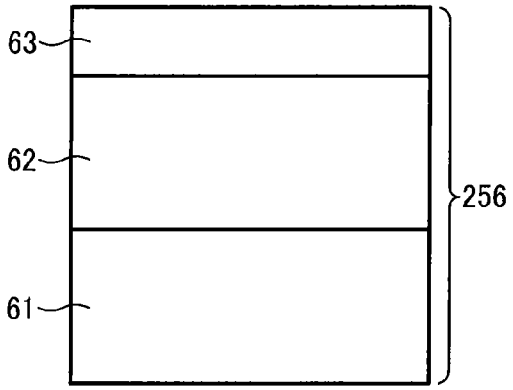
FIG. 10 is a diagram illustrating a cross section of the structure of the fixing roller of FIG. 9.

The fixing roller 256 has a core metal 61 on which an elastic layer 62 and a releasing layer 63 are laminated in this sequence as illustrated in FIG. 10.

The total thickness of the fixing roller 256 is normally 10 mm or less.

The thickness of the core metal 61 is 5 mm or less.

There is no specific limit to materials that form the core metal 61. Specific examples thereof include, but are not limited to, metal materials such as stainless steel and aluminum.

The elastic layer 62 preferably has a thickness of 100 μm or more. When the thickness of the elastic layer 62 is too thin, the fixing roller 256 is not able to trace minor roughness of a toner image, thereby degrading the low temperature fixability of the toner image. The elastic layer 62 normally has a thickness of 300 μm or less.

There is no specific limit to the material that forms the elastic layer 62. Specific examples thereof include, but are not limited to, rubber materials such as silicone rubber, expandable silicone rubber, and fluorine-containing rubber.

The releasing layer 63 preferably has a thickness of 10 μm or less. When the thickness of the releasing layer 63 is too thick, the fixing device is not able to trace minute roughness of the surface of a toner image, which tends to degrade the low temperature fixability of the toner. The thickness of the releasing layer 63 is normally 30 μm or more.

There is no specific limit to the material that forms the releasing agent 63. Specific examples thereof include, but are not limited to, copolymers of tetrafluoroethylene perfluoroalkyl vinyl ether (PFA) and polytetrafluoroethylene (PTFE).

The Martens hardness of the fixing roller 256 at 23° C. is 1.0 $N/mm^2$ or less and preferably 0.5 $N/mm^2$ or less. When the Martens hardness of the fixing roller 256 at 23° C. is too large, the fixing sleeve 255 is not able to trace minor roughness of a toner image, thereby degrading the low temperature fixability of the toner image.

The Martens hardness of the fixing roller 256 can be measured as follows: The fixing roller 256 is fixed by a fixing jig on the stage of a hardness measuring instrument (Fisherscope H100, manufactured by Helmut Fischer GmbH) and measured thereby at 23° C. A microVickers indenter is used. Load and no load is applied to the fixing roller 256 in turns with the press-in depth of 20 μm at most.

The outer diameter of the fixing roller 256 is normally from 20 mm to 40 mm.

The halogen heater 25 is provided inside the fixing roller 256.

Toner

Toner contains a binder resin. The binder resin preferably contains a crystalline resin and optionally a non-crystalline resin in the present disclosure.

The crystalline resin contains a crystalline polymer segment and has a melting point. The non-crystalline resin has no crystalline polymer segment.

The toner has a small ductility. S(120)/S(23) thereof is 1.60 or less. The toner that contains the crystalline resin as a main component preferably has a S(120)/S(23) of 1.50 or less and more preferably 1.20 or less. On the other hand, the toner having no crystalline resin as a main component preferably has a S(120)/S(23) of 1.20 or more.

The toner having a crystalline resin as a main component is described as the first embodiment and the toner having a crystalline resin as a minor (not main) component is described as the first embodiment.

First Embodiment of Toner

The toner contains a crystalline resin as a main component.

As the crystalline polymer unit contained in the crystalline resin, a crystalline polyester segment and a crystalline poly (meth)acrylic acid long chain alkyl ester segment are preferable in terms that such segments have suitable melting points as the binder resin. Of the two, the crystalline polyester segment is particularly preferable because it is easy to design toner having a suitable melting point and the binding property thereof is excellent.

The content of a crystalline resin having a crystalline polyester segment in a binder resin is from 50% by weight or more, preferably from 60% by weight or more, more preferably from 75% by weight or more, and particularly preferably from 90% by weight or more. This contributes to further improvement of the low temperature fixability of toner.

There is no specific limit to the crystalline resin having a crystalline polyester segment. Specific examples thereof include, but are not limited to, a crystalline resin (crystalline polyester) only made of a crystalline polyester segment, a crystalline resin formed by linking crystalline polyester segments, a crystalline resin (block polymer, graft polymer) formed by bonding a crystalline polyester segment and another polymer segment.

There is no specific limit to the method of synthesizing such a crystalline resin. For example, the crystalline resin can be prepared by bonding a crystalline polymer segment into the main chain of a resin.

Crystalline polyester is formed of many crystal structure but easily deformed by an external force. This is inferred since it is difficult to form a crystalline polyester made of only crystal structures, the degree of freedom of molecular chain of non-crystalline structures is high, which leads to easy deformation. Alternatively, it is inferred that since a crystalline polyester has a lamellar structure in which planes are formed while molecular chains are folded but a large bond force is not applied between lamellar layers, the lamellar layers easily slip. Once a binder resin is deformed by an external force, problems arise such that toner is deformed and agglomerates or is attached or fixated to other members in the image forming apparatus 1, or output images incur damage. For this reason, the binder resin is preferably tough and not easily deformed by an external force to some degree.

In terms of imparting toughness to a crystalline resin, it is preferable to use a crystalline resin having a bond having a large agglomerating energy such as a urethane bond, a urea bond or a phenylene bond, which is formed by linking crystalline polyester segments or bonding a crystalline polyester segment with another polymer segment (block polymer, graft polymer). Of these, a urethane bond and a urea bond are particularly preferable in terms that these are inferred that pseudo-cross linking points are formed in the non-crystalline structure or between lamellar layers due to a large intermolecular force because such bonds are present in molecular chains. In addition, these are easy to be wet to paper, thereby increasing the fixing strength of a toner image.

There is no specific limit to the crystalline polyester segment. Specific examples thereof include, but are not limited to, polycondensed products of a polyol and a polycarboxylic acid, a alctone ring opening polymer, and a polyhydroxy carboxylic acid. Of these, the polycondensed products of a polyol and a polycarboxylic acid are preferable in terms of demonstration of the crystallinity.

There is no specific limit to such a polyol. Diols or tri- or higher alcohols are suitable. These can be used in combination.

Specific examples of the diol include, but are not limited to, straight-chain type aliphatic diols, branch-type aliphatic diols, alkylene ether glycol having 4 to 36 carbon atoms, alicyclic diols having 4 to 36 carbon atoms, adducts of alicyclic diols with alkylene oxides (AO), adducts of bisphenols with AO, polylactone diols, polybutadiene diols, diols having carboxylic groups, diols having a sulfonic acid group or a sulfamic acid group, and diols having other functional groups of these salts. Of these, aliphatic diol having 2 to 36 carbon atoms is preferable and straight chain type aliphatic diol is more preferable.

Specific examples of the straight chain type aliphatic diols include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol. Of these, considering the availability, ethylene glycol, 1,3-prpane diol, 1,4-butane diol, 1,6-hexane diol, 1,9-nonane diol, and 1,10-decane diol are preferable.

The content of the straight chain type aliphatic diol in a diol is 80% by weight or more and preferably 90% by weight or more. In this range, the crystallinity of a resin is improved while striking a balance between the low temperature fixability, the high temperature stability of toner, and the hardness thereof tends to become high.

Specific examples of the branch chain type aliphatic diols having 2 to 36 carbon atoms in the chain include, but are not limited to, 2-propane glycol, butane diol, hexane diol, octane diol, decane diol, dodecane diol, tetradecane diol, neopentyl glycol, and 2-diethyl-1,3-propane diol.

Specific examples of the alkylene ether glycol having 4 to 36 carbon atoms include, but are not limited to, diethylene glycol, triethylene glycol, dipropylene glycol, polyethylene glycol, polypropylene glycol, and polytetramethylene ether glycol.

There is no specific limit to the alicyclic diols having 4 to 36 carbon atoms. Specific examples thereof include, but are not limited to, 4-cyclohexane dimethanol and hydrogenated bisphenol A.

There is no specific limit to the adducts of aliphatic diol with AO, Specific examples thereof include, but are not limited to, an adduct of aliphatic diol with ethylene oxide (EO), an adduct of aliphatic diol with propylene oxide (PO), and an adduct of aliphatic diol with butylene oxide (BO).

The number of mols of the adducts of aliphatic diol with AO is from 1 mol to 30 mols.

There is no specific limit to the bisphenols. Specific examples thereof include, but are not limited to, adducts of bisphenol A, bisphenol F, and bisphenol S with 2 mols to 30 mols of AO (EO, PO, and BO).

A specific example of polylacotone diol is poly$\epsilon$-caprolactone diol.

Specific examples of diols having carboxylic groups include, but are not limited to, dialkylol alkanic acid having 6 to 24 carbon atoms such as 2,2-dimethylo propionic acid (DMPA), 2,2-dimethylol butanoic acid, 2,2-dimethylol heptanoic acid, and 2,2-dimethylol octanoic acid.

Specific examples of diol having a sulfonic acid group or a sulfamine acid group include, but are not limited to, N,N-bis(2-hydroxyethyl)sulfamic acid, sulfamic acid diol such as an adduct of N,N-bis(2-hydroxyethyl)sulfamic acid with 2 mols of PO, N,N-bis(2-hydroxyalkyl)sulfamic acid (number of carbons in alkyl is from 1 to 6), an adduct thereof with AO (EO, PO, etc.) (number of mols is from 1 mol to 6 mols), and bis(2-hydroxyethyl)phosphate.

There is no specific limit to the neutralizing salts of diol. Specific examples thereof include, but are not limited to, tertiary amines (for example, triethylamine) having 3 to 30 carbon atoms and hydroxides (for example, sodium hydroxide).

Of these, it is preferable to use an alkylene glycol having 2 to 12 carbon atoms, a diol having a carboxylic group, an adduct of a bisphenol with AO, and a combination thereof.

There is no specific limit to the tri- or higher alcohol components. Specific examples thereof include, but are not limited to, ialkane polyols and innter molecular dehydrated compounds thereof, e.g., glycerin, trimethylol ethane, trimethylol propane, pentaerythritol, sorbitol, sorbitane, and polyglycerine; aliphatic alcohols having 3 to 36 carbon atoms such as sugars and derivatives thereof e.g., sucrose and methyl glucoside; adducts of trisphenols (e.g., triphenol PA) with 2 mols to 30 mols of AO; adducts of novolac resins (e.g., phenolic novolac and cresol novolac) with 2 mols to 30 mols of AO; and copolymers of acrylic polyol (e.g., copolymers of hydroxyethyl (meth)acrylate and another vinyl-based monomer). Of these, aliphatic polyols and adducts of novolac resins with AO are preferable and novolac resins with AO are more preferable.

Specific examples of the polycarboxylic acid include, but are not limited to, dicarboxylic acids and tri- or higher polycarboxylic acids.

There is no specific limit to the dicarboxylic acid. Specific examples thereof include, but are not limited to, aliphatic dicarboxylic acids such as straight chain type aliphatic dicarboxylic acids and the branch-chained type aliphatic dicarboxylic acids and aromatic dicarboxylic acids. Of these, straight chain type aliphatic dicarboxylic acids is preferable.

Specific examples of the aliphatic dicarboxylic acids include, but are not limited to, alkene dicarboxylic acids having 4 to 36 carbon atoms such as succinic acid, adipic acid, sebacic acid, azelaic acid, dodecane dicarboxylic acid, octadecane dicarboxylic acid, and decyl succinic acid; alkenyl succinic acids such as dodecenyl succinic acid, pentadecenyl succinic acid, and octadecenyl succinic, alkene dicarboxylic acids having 4 to 36 carbon atoms such as maleic acid, fumaric acid, and citraconic acid, and alicyclic dicarboxylic acids having 6 to 40 carbon atoms such as dimer acid (dimerized linolic acid).

Specific examples of the aromatic dicarboxylic acids include, but are not limited to, aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid.

Specific examples of the polycarboxylic acids having three or more hydroxyl groups include, but are not limited to, aromatic polycarboxylic acids having 9 to 20 carbon atoms (e.g., trimellitic acid and pyromellitic acid).

Of these, it is preferable to use an aliphatic dicarboxylic acid alon such as adipic acid, sebacic acid, doddecane dicarboxylic acid, terephthalic acid, and isophthalic acid. It is also preferable to use an aromatic dicarbozylic acid such as terephtahlic acid, isophthalic acid, t-butylisophthalic acid in combination with such an aliphatic dicarboxylic acid.

The molar ratio of the aromatic dicarboxylic acid to the total content of the aliphatic dicarboxylic acid and the aromatic dicarboxylic acid is 0.2 or less.

Optionally, polycarboxylic anhydrides or lower alkyl esters (e.g., methyl esters, ethyl esters, or isopropyl esters) having one to four carbon atoms can be used instead of the polycaroboxylic acid.

There is no specific limit to the lactone ring-opening polymers. Specific examples thereof include, but are not limited to, lactone ring-opening polymers obtained by ring-opening polymerizing a monolactone having 3 to 12 carbon atoms such as $\beta$-propio lactone, $\gamma$-butylo lactone, $\delta$-valero lactone, and $\epsilon$-capro lactone using a catalyst such as a metal oxide and an organic metal compound; and lactone ring-opening polymers having hydroxyl groups at their ends obtained by ring-opening polymerizing the monolactone having 3 to 12 carbon atoms mentioned above by using a glycol (e.g., ethylene glycol and diethylene glycol) as an initiator.

There is no specific limit to the monolactone having 3 to 12 carbon atoms. It is preferable to use $\epsilon$-capro lactone in terms of crystallinity.

Products of lactone ring-opening polymers available on the market can be also used. These are, for example, high-crystalline polycapro lactones such as PLACCEL series H1P, H4, H5, and H7 (manufactured by DAICEL CORPORATION).

There is no specific limit to the synthesis method of the polyhydroxy carboxylic acids. Such polyhydroxy carboxylic acids as the polyester resins are obtained by, for example, a method of direct dehydrocondensation of hydroxycarboxylic acid such as a glycolic acid, lactic acid (L-, D- and racemic form); and a method of ring-opening a cyclic ester (the number of ester groups in the ring is two or three) having 4 to 12 carbon atoms corresponding to an inter two or three molecule dehydrocondensed compound of a hydroxycarboxylic acid such as glycolide and lactide (L-, D- and racemic form) with a catalyst such as a metal oxide and an organic metal compound. The method of ring-opening is preferable in terms of molecular weight control.

Of these, preferable cyclic esters are L-lactide and D-lactide in light of crystallinity.

In addition, these polyhydrocarboxylic acids that are modified to have a hydroxy group or a carboxyli group at the end are also suitable.

There is no specific limit to the synthesis method of the crystalline resin formed by linking crystalline polyester segments. A specific example thereof is linking crystalline polyesters having active hydrogen groups such as hydroxyl groups at their end with polyisocyanate. By this method, a urethane bonding is introduced into a resin skeleton, thereby improving the toughness of the resin.

There is no specific limit to the polyisocyanate. Specific examples thereof include, but are not limited to, diisocyanates, modified diisocyanates, and tri- or higher polyisocyanates.

Specific examples of the diisocyanates include, but are not limited to, aromatic diisocyanates, aliphatic diisocyanates, alicyclic diisocyanates, and aromatic aliphatic diisocyanates.

Specific examples of the aromatic diisocyanates include 1,3-phenylene diisocyanate, and/or 1,4-phenylene diisocyanate, 2,4-tolylene diisocyanate (TDI), crude TDI, 2,4'-diphenyl methane diisocyanate (MDI), 4,4'-diphenyl methane diisocyanate (MDI), crude MDI polyaryl polyisocyanate (PAPI) (phosgenized compound of crude diamino phenyl methane (condensed products of formaldehyde and aromatic amine (aniline) or its mixture; mixtures of diamino diphenyl methane with a small quantity (e.g., 5% by weight to 20% by weight) of tri- or higher polyamines), 1,5-naphtylene diisocyanate, 4,4'4"-triphenyl methane triisocyanate, m-isocyanato phenyl sulfonyl isocyanate, and p-isocyanato phenyl sulfonyl isocyanate.

Specific examples of the aliphatic diisocyanates include, but are not limited to, etyhlene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl) fumarate, bis(2-isocyanato ethyl) carbonate, and 2-isocyanatoethyl-2,6-diisocyanato hexanoate.

Specific examples of the alicyclic isocyanates include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Specific examples of the aromatic aliphatic diisocyanates include, but are not limited to, m-xylylene diisocyanate (XDI), p-xylylene diisocyanate (XDI), α, α, α', α'-tetramethyl xylylene diisocyanate (TMXDI).

Specific examples of modifying group of the modified compounds of the diisocyanates include, but are not limited to, a urethane group, a cabodiimide group, an allophanate group, a urea group, a biuret group, a uretdione group, a uretimine group, an isocyanulate group, and an oxazolidone group.

Specific examples of the modified compounds of diisocyanate include, but are not limited to, modified MDIs such as urethane modified MDI, carbodiimide modified MDI, and trihydrocarbyl phosphate modified MDI, modified compounds of diisocyanates such as urethane modified TDIs of a crystalline prepolymer containing an isocyanate group, and mixtures of modified diisocyanates such as modified MDI and urethane modified TDI.

Of these, aromatic diisocyanates having 6 to 20 carbon atoms (preferably 6 to 15) excluding carbons in the isocyanate group, aliphatic diisocyanates having 2 to 18 carbon atoms (preferably 4 to 12) excluding carbons in the isocyanate group, alicyclic diisocyanates having 4 to 15 carbon atoms excluding carbons in the isocyanate group, aromatic aliphatic diisocyanates having 8 to 15 carbon atoms excluding carbons in the isocyanate group, modified compounds of these dissocyanates (modified by urethane group, carbodiimide group, an allophanate group, a urea group, a biuret group, a uretdione group, a uretimine group, an isocyanulate group, an oxazolidone group, etc.), and mixtures thereof are preferable. TDI, MDI, HDI, hydrogenated MDI, and IPDI are particularly preferable.

Optionally, it is possible to use a tri- or higher polyisocyaante.

There is no specific limit to the another polymer segment. Specific examples thereof include, but are not limited to, non-crystalline polyester segments, polyurethane segments, and vinyl-based polymer segments.

There is no specific limit to the method of linking a crystalline polyester segment with another polymer segment. Specific examples thereof include, but are not limited to, a method of linking a crystalline polyester with another polymer, a method of linking with another polymer segment by polymerizing monomers under the presence of crystalline polyester or another polymer, a method of polymerizing monomers simultaneously or sequentially in the same reaction field. Of these, the first or second method is preferable in terms of reaction control.

Specific examples of the first methods include, but are not limited to, a method of linking a crystalline polyester having an active hydrogen group such as a hydroxyl group at its end and a polymer having an active hydrogen group such as a hydroxyl group at its end by a polyisocyanate and a method of a crystalline polyester having an active hydrogen group (or an isocyanate group) such as a hydroxyl group at its end and a polymer having an isocynate group (or active hydrogen group such as a hydroxyl group) at its end. By this method, a urethane bonding is introduced into a resin skeleton, thereby improving the toughness of the resin. It is possible to use the polyisocyante specified above in these methods.

Specific examples of the second methods include, but are not limited to, a method of reacting a hydroxyl group or a carboxyli group loccated at the end of a crystalline polyester and a monomer followed linking with another polymer segment. By this method, a crystalline resin is obtained in which a crystalline polyester segment is linked with another polymer segment such as a non-crystalline polyester segment, a polyurethane segment, and a polyurea segment.

There is no specific limit to the non-crystalline polyester segment. A specific examples thereof is a polycondensed compound of a polyol and a polycarboxylic acid.

As such a polyol and a polycarboxylic acid, it is possible to use the polyol and polycarboxylic acid used to synthesize the crystalline polyester segment. To design a polyester segment having no crystallinity, a folding point or a branch point is introduced into a polymer skeleton.

To introduce such a folding point into a polymer skeleton, it is suitable to use as the polyol bisphenols and derivatives such as adducts thereof (added number of mols is from 2 mols to 30 mols) such as adducts of bisphenol A, bisphenol F, or bisphenol S with AO (EP, PO, BO, etc.) and as the polycarboxylic acid phthalic acid, isophthalic acid, and t-butyl isophthalic acid.

To introduce a branch point into a polymer skeleton, it is suitable to use triols or higher alcohols or a polycarboxylic acid.

There is no limit to the polyurethane segment. For example, polyurethane segments can be synthesized by a polyol such as a diols a triol, and a higher alcohol and a polyisocyanate such as a diiscocyanate, a triisocyanate, or a higer isocyanate. Of these, it is preferable to use a polyurethane segment synthesized by a diol and a diisocyanate.

The polyols specified above can be used.

The polyisocyanates specified above can be used.

There is no specific limit to the polyurea segment. Specific examples thereof include, but are not limited to, polyurethane segments synthesized by a polyamine such as diamine or tri- or higher amine and a polyisocyanate such as diisocyanate or tri- or higher isocyanate. Of these, it is preferable to use a polyurea segment synthesized by a diamine and a diisocyanate.

The polyisocyanates specified above can be used.

Specific examples of the diamines include, but are not limited to, aromatic diamines, alicyclic diamines, and aliphatic diamines. Of these, an aliphatic diamine having 2 to 18 carbon atoms and an aromatic diamine having 6 to 20 carbon atoms are preferable.

Optionally, tri- or higher amines can be used.

There is no specific limit to the aliphatic diamines having 2 to 18 carbon atoms. Specific examples thereof include, but are not limited to, alkylene diamines such as ethylene diamine, propylene diamine, trimethylene diamine, tetramethylene diamine, and hexamethylene diamine; polyalkylene diamines having 2 to 6 carbon atoms such as diethylene triamine, iminobis propyl amine, bis(hexamethylene)triamine, triethylene tetramine, tetraethylne pentamine, and pentaethylene hexamine; substituted compounds thereof with an alkyl having 4 to 18 carbon atoms or a hydroxyl alkyl having 2 to 4 carbon atoms such as dialkyl aminopropyl amine, trimethyl hexamethylene diamine, aminoethyl ethanol amine, 2,5-dimethyl-2,5-hexamethylene diamine, and methyl iminobispropyl amine; alicyclic or heterocyclic aliphatic diamines such as alicyclic diamine having 2 to 4 carbon atoms such as 1,3-diamino cyclehexane, isophorone diamine, menthene diamine, 4,4'-methylene dicyclohexane diamine (hydrogenated methylene dianiline and heterocyclic diamine having 4 to 15 carbon atoms such as piperazine, N-aminoethyl piperazine, 1,4-diaminoethyl piperazine, 1,4,-bis(2-amino-2-methylpropyl) piperazine, 3,9-bis(3-aminopropyl)-2,4,8,10-tetraoxaspiro[5,5] undecane; and aromatic aliphatic amines having 8 to 15 carbon atoms such as xylylene diamine, tetrachlor-p-xylylene diamine.

Specific examples of the aromatic diamines having 6 to 20 carbon atoms include, but are not limited to, non-substituted aromatic diamines such as 1,2-, 1,3, or 1,4-phenylene diamine, 2,4,-diphenyl methane diamine, 4,4'-diphenyl methane diamine, crude diphenyl methane diamine (polyphenyl polymethylene polyamine), diaminodiphenyl sulfone, bendidine, thiodianiline, bis(3,4-diaminophenyl) sulfone, 2,6-diaminopilidine, m-aminobenzyl amine, triphenyl methane-4,4',4"-triamine, and naphtylene diamine; aromatic diamines having a nuclear substitution alkyl group having one to four carbon atoms such as 2,4- or 2,6-tolylene diamine, crude tolylene diamine, diethyle tolylene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3' diethyl-2,2'-diaminodiphenyl methane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminophenyl sulfone; mixtures of isomers of non-substituted aromatic diamines and aromatic diamines having a nuclear substitution alkyl group having one to four carbon atoms with various ratios; aromatic diamines having a nuclear substitution electron withdrawing group {such as halogen (e.g., Cl, Br, I, anf F), alkoxy groups such as methoxy group and ethoxy group, and nitro group} such as methylene bis-o-chloroaniline, 4-chlor-o-phenylene diamine, 3-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine, 3-dimethoxy-4-aminoaniline; 4,4'-diamino-3,3'-dimethyl-5,5'-dibromo-diphenyl methane, 3,3'-dichlorobenzidine, 3,3'dimethoxy benzidine, bis(4-amino-3-chlorophenyl)oxide, bis(4-amino-2-chlorophenyl)propane, bis(4-amino-2-chlorophenyl) sulfone, bis(4-amino-3-methoxyphenyl) decane, bis(4-aminophenyl)sufide, bis(4-aminophenyl) telluride, bis(4-aminophenyl) selenide, bis(4-amino-3-methoxyphenyl) disulfide, 4,4'-methylene bis(2-iodoaniline), 4,4'-methylene his (2-bromoaniline), 4,4'-methylene bis(2-fluoroaniline), 4-aminophenyl-2-chloroaniline); aromatic diamines having a secondary amino group such as 4-4'-bis(methylamino)diphenyl methane, and 1-methyl-2-methylamino-4-aminobenzene.

Specific examples of the aromatic diamines having a secondary amino group other than the specified above include, but are not limited to, non-substituted aromatic diamines, aromatic diamines having a nuclear substitution alkyl group having one to four carbon atoms, mixtures of isomers thereof with various mixing ratio, compounds in which part or entire of the primary amino group of the aromatic diamines having a nuclear substitution electron withdrawing group is substituted with a lower alkyl group such as a methyl group and an ethyl group to be a secondary amino group.

In addition to those, specific examples of the diamines include, but are not limited to, polyamide polyamines such as low-molecular weight polyamide polyamines obtained by condensation of dicarboxylix acid (e.g., dimeric acid) and excessive (2 mols or more to one mol of dicarboxylic acid) polyamines (e.g., the alkylene diamines and polyalkylene polyamines); and polyether polyamines scuh as hydrogenetaed compounds of cyanoethylated polyether polyols (e.g., polyalkeylene glycol).

Instead of the polyamine, it is possible to use a polymer in which the amino group of a polyamine is capped by a ketone, etc.

There is no specific limit to the vinyl-based polymer segment. Specific examples thereof include, but are not limited to homopolymers or copolymers of vinyl based-monomers.

There is no specific limit to the vinyl-based monomers. Specific examples thereof include, but are not limited to, the compounds of the following (1) to (10).

(1) Vinyl Based Hydrocarbon

Aliphatic vinyl based hydrocarbons: alkenes such as ethylene, propylene, butane, isobutylene, pentene, heptene, diisobutylene, octane, dodecene, octadecene, α-olefins other than the above mentioned; alkadiens such as butadiene, isoplene, 1,4-pentadiene, 1,6-hexadiene, and 1,7-octadiene.

Alicyclic vinyl based hydrocarbons: mono- or di-cycloalkenes and alkadiens such as cyclohexene, (di)cyclopentadiene, vinylcyclohexene, and ethylidene bicycloheptene; and terpenes such as pinene, limonene and indene.

Aromatic vinyl-based hydrocarbons: styrene and its hydrocarbyl (alkyl, cycloalkyl, aralkyl and/or alkenyl) substitutes, such as α-methylstyrene, vinyl toluene, 2,4-dimethylstyrene, ethylstyrene, isopropyl styrene, butyl styrene, phenyl styrene, cyclohexyl styrene, benzyl styrene, crotyl benzene, divinyl benzene, divinyl toluene, divinyl xylene, and trivinyl benzene; and vinyl naphthalene.

(2) Vinyl-Based Monomer Containing Carboxyl Group and Salts Thereof

Unsaturated mono carboxylic acid and unsaturated dicarboxylic acid having 3 to 30 carbon atoms, and their anhydrides and their monoalkyl (having 1 to 24 carbon atoms) esters such as (meth)acrylic acid, (anhydride of) maleic acid, mono alkyl esters of maleic acid, fumaric acid, mono alkyl esters of fumaric acid, crotonic acid, itoconic acid, mono alkyl esters of itaconic acid, glycol monoether of itaconic acid, citraconic acid, mono alkyl esters of citraconic acid and cinnamic acid.

(3) Vinyl-based Monomer Having Sulfonic Acid Group, Vinyl-based Sulfuric Acid MonoEsterified Compound, and Salts Thereof, Alkene sulfuric acid having 2 to 14 carbon atoms such as vinyl sulfuric acid, (meth)aryl sulfuric acid, methylvinylsufuric acid and styrene sulfuric acid; their alkyl delivatives having 2 to 24 carbon atoms such as α-methylstyrene sulfuric acid; sulfo(hydroxyl)alkyl-(meth)acrylate or (meth)acryl amide such as sulfopropyl(meth)acrylate, 2-hydroxy-3-(meth)acryloxy propylsulfuric acid, 2-(meth)acryloylamino-2,2-dimethylethane sulfuric acid, 2-(meth)acryloyloxyethane sulfuric acid, 3-(meth)acryloyloxy-2-hydroxypropane sulfuric acid, 2-(meth)acrylamide-2-methylpropane sulfuric acid, 3-(meth)avrylamide-2-hydroxy propane sulfuric acid, alkyl (having 3 to 18 carbon atoms) aryl sulfosuccinic acid, sulfuric esters of polyoxyalkylene (ethylene, propylene, butylenes: (mono, random, block) mono (meth)acrylate (n=2 to 30) such as sulfuric acid ester of polyoxypropylene monomethacrylate (n=5 to 15), and sulfuric acid ester of polyoxyethylene polycyclic phenyl ether.

(4) Vinyl-Based Monomer Having Phosphoric Acid Group and Salts Thereof

Phosphoric acid monoester of (meth)acryloyl oxyalkyl such as 2-hydroxyethyl(meth)acryloyl phosphate, phenyl-2-acyloyloxyethylphosphate; and (meth)acryloyloxyalkyl (having 1 to 24 carbon atoms) phosphonic acids such as 2-acryloyloxy ethylphosphonic acid.

Specific examples of the salts of the compounds of (2) to (4) include, but are not limited to, alkali metal salts (sodium salts, potassium salts, etc.), alkali earth metal salts (calcium salts, magnesium salts, etc.), ammonium salts, amine salts, quaternary ammonium salts, etc.

(5) Vinyl-Based Monomer Having Hydroxyl Group

Hydroxystyrene, N-methylol(meth)acryl amide, hydroxyethyl(meth)acrylate, (meth)arylalcohol, crotyl alcohol, isocrotyl alcohol, 1-butene-3-ol, 2-butene-1-ol, 2-butene-1,4-diol, propargyl alcohol, 2-hydroxyethylpropenyl ether, sucrose aryl ether, etc.

(6) Vinyl-based Monomer Containing Nitrogen and Salts Thereof

Vinyl based monomer having an amino group: aminoethyl (meth)acrylate, dimethylaminoethyl(meth)acrylate, diethylaminoethyl(meth)acrylate, t-butylaminoethyl(meth)acrylate, N-aminoethyl(meth)acrylamide, (metha)arylamine, morpholino ethyl(meth)acrylate, 4-vinylpyridine, 2-vinylpyridine, crotyl amine, N,N-dimethylaminostyrene, methyl-α-acetoaminoacrylate, vinylimidazole, N-vinylpyrrole, N-vinylthiopyrolidone, N-arylphenylene diamine, aminocarbozole, aminothiazole, aminoindole, aminopyrrole, aminoimidazole, and aminomercaptothiazole.

Vinyl Based Monomer Having Amide Group: (meth)acrylamide, N-methyl(meth)acrylamide, N-butylacrylamide, diacetone acrylamide, N-methylol(meth)acrylamide, N,N-methylene-bis(meth)acrylamide, cinnamic amide, N,N-dimethylacrylamide, N,N-dibenzylacrylamide, methacrylformamide, N-methyl-N-vinylacetoamide, and N-vinylpyrolidone.

Vinyl-Based Monomer Having Nitrile Group: (meth)acrylonitrile, cyanostyrene, and cyanoacrylate.

Vinyl-Based Monomer Having Quaternary Ammonium Group:

vinyl-based monomer having tertiary amine group such as dimethylaminoethyl(meth)acrylate, diethylaminoethyl (meth)acrylate, dimethylaminoethyl(meth)acrylamide, diethylaminoethyl(meth)acrylamide, diarylamine, etc. quaternaized by using a quaternarizing agent such as methylchloride, dimethyl sulfuric acid, benzyl chloride, dimethylcarbonate.

A specific example of the vinyl-based monomer having a nitro group is nitrostyrene.

(7) Vinyl Based Monomer Having Epoxy Group

Specific examples of the vinyl-based monomer having an epoxy group include, but are not limited to, glycidyl (meth) acrylate, tetrahydrofurfury (meth)acrylate, and p-vinylphenyl phenyl oxide.

(8): Vinyl Esters, Vinyl(thio) Ethers, Vinyl Ketones, Vinyl Sulfones, Vinyl Esters:

Vinyl acetate, vinyl butylate, vinyl propionate, vinyl butyrate, diarylphthalate, diaryladipate, isopropenyl acetate, vinylmethacrylate, methyl-4-vinylbenzoate, cyclohexylmethacrylate, benzylmethacrylate, phenyl(meth)acrylate, vinylmethoxyacetate, vinylbenzoate, ethyl-α-ethoxyacrylate, alkyl (having 1 to 50 carbon atoms) (meth)acrylate such as methyl(meth)acrylate, ethyl(meth)acrylate, propyl(meth) acrylate, butyl(meth)acrylate, 2-ethylhexyl(meth)acrylate, dodecyl(meth)acrylate, hexadecyl(meth)acrylate, heptadecyl (meth)acrylate, and eicocyl(meth)acrylate), dialkyl fumarate (in which two alkyl groups are independently straight chained or branch chained alkyl groups or cycloalkyl groups having 2 to 8 carbon atoms), dialkyl maleate (in which two alkyl groups are independently straight chained or branch chained alkyl groups or cycloalkyl groups having 2 to 8 carbon atoms), and poly(meth)aryloxyalkanes such as diaryloxyethane, triaryloxyethane, tetraaryloxyethane, tetraaryloxypropane, tetraaryloxybutane and tetrametharyloxyethane, vinyl-based monomers having polyalkylene glycol chain such as polyethylene glycol (molecular weight: 300) mono (meth)acrylate, polypropylene glycol (molecular weight: 500) monoacrylate, adducts of (meth)acrylate with 10 mol of methylalcoholethyleneoxide, and adducts of (meth)acrylate with 30 mol of lauryl alcohol ethylene oxide), poly(meth) acrylates such as poly(meth)acrylates of polyhydroxyl alcohols (e.g., ethylene glycol di(meth)acrylate, propylene glycol di(meth)acrylate, neopentylglycol di(meth)acrylate, trimethylol propane tri(meth)acrylate, and polyethylene glycol di(meth)acrylate).

Vinyl(thio)ethers: vinylmethyl ether, vinylethyl ether, vinylpropyl ether, vinylbutyl ether, vinyl-2-ethylhexyl ether, vinylphenyl ether, vinyl-2-methoxyethyl ether, methoxy butadiene, vinyl-2-buthxyethyl ether, 3,4-dihydro-1,2-pyrane, 2-buthoxy-2'-vinyloxy diethyl ether, vinyl-2-ethylmercapto ethylether, acetoxystyrene and phenoxy styrene.

Specific examples of vinyl ketones include, but are not limited to, vinyl methyl ketone, vinyl ethyl ketone, and vinyl pphenyl ketone.

Specific examples of vinyl sulfones include, but are not limited to, divinylsulfide, p-vinyldiphenyl sulfide, vinylethyl sulfide, vinylethyl sulfone, divinyl sulfone, and divinyl sulfoxide.

(9) Other Vinyl-Based Monomer

Specific exaples of the other vinyl-bsed monomers include, but are not limited to, isocyanate ethyl(meth)acrylate, m-isopropenyl-α,α-dimethyl benzyl isocyanate.

(10) Vinyl-based Monomer Having Fluoro Group 4-fluorostyrene, 2,3,5,6-tetrafluorostyrene, pentafluorophenyl(meth)acrylate, pentafluorobenzyl(meth)acrylate, perfluorocyclohexyl(meth)acrylate, perfluorocyclohexylmethyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,4H-hexafluorobutyl(meth)acrylate, 1H,1H,5H-ocatafluoropentyl(meth)acrylate, 1H,1H,7H-dodecafluoroheptyl(meth)acrylate, perfluorooctyl(meth)acrylate, 2-perfluorooctylethyl(meth)acrylate, heptadecafluorodecyl(meth)acrylate, trihydroperfluoroundecyl(meth)acrylate, perfluoronorbonyl(meth)acrylate, 1H-perfluoroisobornyl(meth)acrylate, 2-(N-butylperfluorooctane sulfone amide)ethyl(meth)acrylate, 2-(N-ethylperfluorooctane sulfone amide)ethyl(meth)acrylate, and derivatives introduced from α-fluoroacrylic acid. Bis-hexafluoroisopropyl itaconate, bis-hexafluoro isopropyl malate, bis-perfluorooctyl itaconate, bis-perfluorooctyl malate, bis-trifluoroethyl itaconate, and bis-trifluoroethyl malate. Vinylheptafluorobutylate, vinyl perfluoroheptanoate, vinyl perfluoro nonanoate and vinyl perfluoro octanoate.

The binder resin preferably contains a crystalline resin having a urea bond in its main chain.

According to Solubility Parameter Values (Polymer handbook 4th Edition), since the agglomeration energy of urea bond is 50,230 J/mol, which is about twice as large as 26,370 J/mol of urethane bond, it is possible to improve toughness and offset resistance during fixing even with a small amount.

Specific examples of the synthesis method of a crystalline resin having a urea bond in its main chain include, but are not limited to, a method of reacting a polyisocyaante and/or a crystalline prepolymer having an isocyanate group at its end or a side chain with a polyamine; and a method of reacting amino groups produced by hydrolyzing a polyisocyaante and/or a crystalline prepolymer having an isocyanate group at its end or a side chain with residual isocyanate groups.

The molar ratio ([NCO]/[$NH_2$]) of the isocyanate group of the polyisocyaante and/or the crystalline prepolymer having an isocyanate group at its end or a side chain to the amine group of the polyamine is from 1.01 to 5, preferably from 1.2 to 4, and more preferably from 1.5 to 2.5. When the molar ratio ([NCO]/[$NH_2$]) is too small, the molecular weight of a crystalline resin having a urea bond in its main chain tends to be excessively large. When the molar ratio ([NCO]/[$NH_2$]) is too large, the content of urea bond in a crystalline resin having urea bond in its main chain tends to be excessively large.

When synthesizing a crystalline resin having a urea bond in its main chain, it is possible to obtain wider freedom of designing the crystalline resin by reacting a polyol and/or a crystalline resin having a hydroxy group at its end or side chain simultaneously.

There is no specific limit to the synthesis method of the crystalline prepolymer having an isocyanate group at its end or side chain. Specific examples thereof include, but are not limited to, a method of reacting a polyamine with an excessive amount of a polyisocyanate to synthesize a crystalline polyurea prepolymer having an isocyanate group at its end; and a method of reacting a polyol and/or a crystalline resin having a hydroxy group at its end or side chain with an excessive amount of a polyisocyanate to synthesize a crystalline polyurethane prepolymer having an isocyanate group at its end.

Prepolymer having an isocyanate group at its end can be used in combination.

The polyamine specified above can be used.

The polyols specified above can be used.

There is no specific limit to the synthesis method of a crystalline resin having a hydroxy group at its end or side chain. Specific examples thereof include, but are not limited to, a method of reacting a polyisocyanate with an excessive amount of a polyol to synthesize a crystalline polyurethane having a hydroxy group at its end; and a method of reacting a polycarboxylic acid with an excessive amount of a polyol to synthesize a crystalline polyester having an isocyanate group at its end.

Specific examples of tri- or higher carboxylic acids include, but are note limited to, aromatic tri- or higher carboxylic acids.

The molar ratio ([OH]/[NCO]) of the hydroxy group of the poyol and the isocyanate group of the polyisocyaante is from 1 to 2, preferably from 1 to 1.5, and more preferably from 1.02 to 1.3 when synthesizing the crystalline polyurethane having a hydroxy group at its end. When the molar ratio ([OH]/[NCO]) is too small, the molecular weight of the crystalline polyurethane having a hydroxy group at its end tends to be excessively large. When the molar ratio ([OH]/[NCO]) is too large, the molecular weight of the crystalline polyurethane having a hydroxy group at its end tends to be excessively large.

Similarly, the molar ratio ([OH]/[COON]) of the hydroxy group of the polyol to the carboxylic group of the polycarboxylic acid is from 1 to 2, preferably from 1 to 1.5, and more preferably from 1.02 to 1.3 when synthesizing the crystalline polyester having a hydroxy group at its end.

The crystalline resin preferably contains a urethane bond and/or a urea bond at its main chain. This contributes to improvement of the hardness of the crystalline resin and aldo a decrease of ductility of toner during melt-fusing.

The crystalline resin preferably contains a first crystalline resin and a second crystalline resin having a weight average molecular weight larger than that of the first crystalline resin. This makes it possible to strike a balance between the low temperature fixing property and the hot offset resistance of toner. Also, the degree of crystallinity of toner can be controlled.

It is preferable that the second crystalline resin is synthesized by reacting a crystalline prepolymer having an isocyanate group at its end and a polyamine. In this case, it is preferable to conduct the reaction of a crystalline prepolymer having an isocyanate group at its end and a polyamine during the manufacturing process of toner. As a result, a crystalline resin having a large weight average molecular weight can be dispersed evenly in toner, thereby suppressing variation of properties among toner particles.

The first crystalline resin has a urethane bond and/or a urea bond in its main chain. The second crystalline resin has a constitution unit derived from the first crystalline resin and is preferably synthesized by reacting a crystalline prepolymer having an isocyanate group at its end and a polyamine. Since the structures of the first crystalline resin and the second crystalline resin are similar to each other, both crystalline resins are easily dispersed uniformly in toner, thereby suppressing variation of properties among toner particles.

The ratio of the temperatures of maximum endotherm peaks during second time temperature rising to the softening point of a crystalline resin is from 0.8 to 1.6, preferably from 0.8 to 1.5, more preferably from 0.8 to 1.4, and particularly preferably from 0.8 to 1.3. Within this range, the crystalline resin softens steeply, thereby striking a balance between low temperature fixability and high temperature stability.

Tthe temperature of maximum endotherm peak during second time temperature rising can be measured by a differential scanning calorimetry (DSC). In addition, the softening point can be measured by an elevated flow tester.

The weight average molecular weight of a crystalline resin is from 2,000 to 100,000, preferably from 5,000 to 60,000, and more preferably from 8,000 to 30,000. When the weight average molecular weight of a crystalline resin is too small, the high temperature stability of toner tends to deteriorate. When the weight average molecular weight is too large, the low temperature fixing property of toner tends to deteriorate.

The weight average molecular weight is measured by a gel permeation chromatography (GPC) and is polystyrene conversion molecular weight.

The toner contains a binder resin and other optional components such as an external additive, a nucleating agent, a coloring agent, a releasing agent, and a charge control agent. The toner can be manufactured by granulation by a known method.

In a case in which the binder resin contains a crystalline resin having a urea bond, toner can be manufactured by using a polyisocyanate and/or a crystalline prepolymer having an isocyanate group at its end or side chain and a composition containing a poloyamine or water. In particular, when using a crystalline prepolymer having an isocyanate group at its end or side chain, it is possible to introduce a large molecular weight crystalline resin having a urea bond uniformly into toner. As a result, the thermal properties and the chargeability of toner become uniform, which makes it easy to strike a balance between the fixability and the stress resistance of toner. Furthermore, the viscoelasticity of toner is suppressed if a crystalline polyurethane prepolymer having an isocyanate group at its end which is synthesized by reacting a polyol and/or a crystalline resin having a hydroxy group at its side chain with an excessive amount of polyisocyanate is used as a crystalline prepolymer having an isocyanate group at its end or a side chain. At this point, to obtain thermal properties suitable for toner, it is preferable to use a crystalline polyester having a hydroxy group at its end prepared by reacting a polycarboxylic acid with an excessive amount of polyol as a crystalline resin having a hydroxy group at its end or side chain. Furthermore, it the crystalline polyester is formed of a crystalline polyester segment, the high molecular weight component in the toner demonstrates sharp melt. Therefore, toner having excellent low temperature fixability is obtained.

When manufacturing toner by granulation in an aqueous medium, a urea bond can be formed under moderate conditions by hydrolysis of a polyisocyanate.

Toner also can be manufactured by a method disclosed in JP-4531076-B1 (JP-2008-287088-A), that is, after toner materials are dissolved liquid carbon dioxide or supercritical carbonoxide, the liquid carbon dioxide or supercritical carbonoxide is removed.

When a binder resin contains a crystalline resin, the X-ray diffraction spectrum of toner has a diffraction peak derived from the crystalline structure thereof. In addition, when a binder resin does not contain a crystalline resin, the X-ray diffraction spectrum of toner does not have a diffraction peak derived from the crystalline structure thereof.

The crystallinity of the toner of the present disclosure is 15% or more, preferably 20% or more, more preferably 30% or more, and particularly preferably 45% or more. Due to this, the toner strikes a balance between the low temperature fixing property and the hot offset resistance thereof.

The crystallinity of the toner can be calculated by the area of the peak derived from the crystal structure of the binder resin and the area of the halo derived from the non-crystal structure thereof.

FIG. 11 is a diagram illustrating the method of calculating the crystallinity of toner.

Figure 11A:
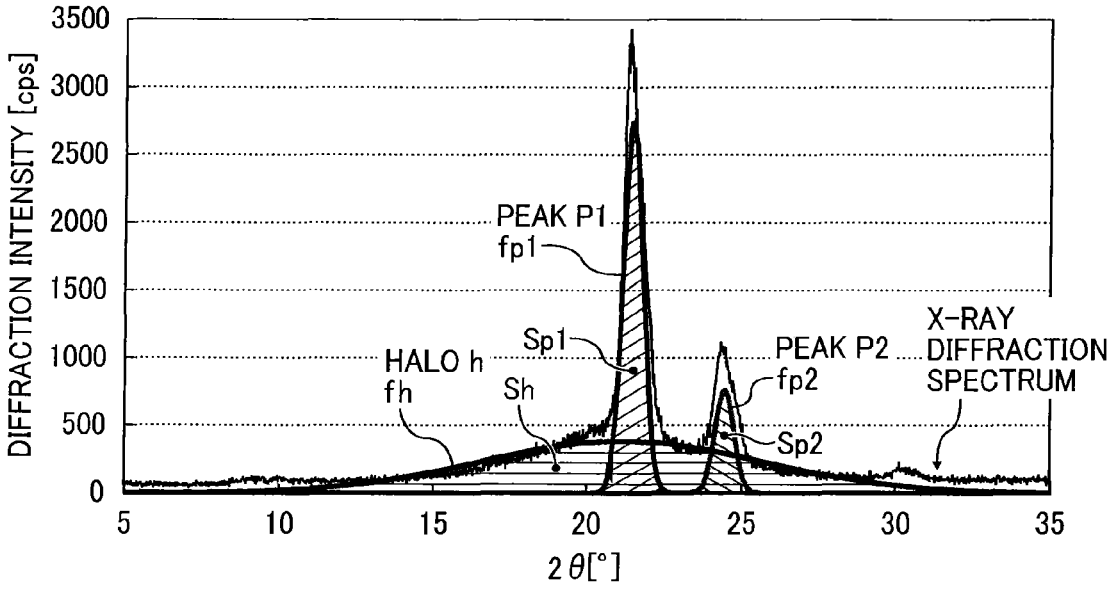
FIGS. 11A and 11B are diagrams illustrating how to calculate the crystal degree of toner.

As illustrated in FIG. 11A, in the X-ray diffraction spectrum of toner, the main peaks of P1 and P2 are present at 2θ of 21.3° and 24.2°. Halo (h) is present in a wide range including these two peaks. The main peaks are derived from the crystal structure of the binder resin and, the halo, from the non-crystal structure.

Figure 11B:
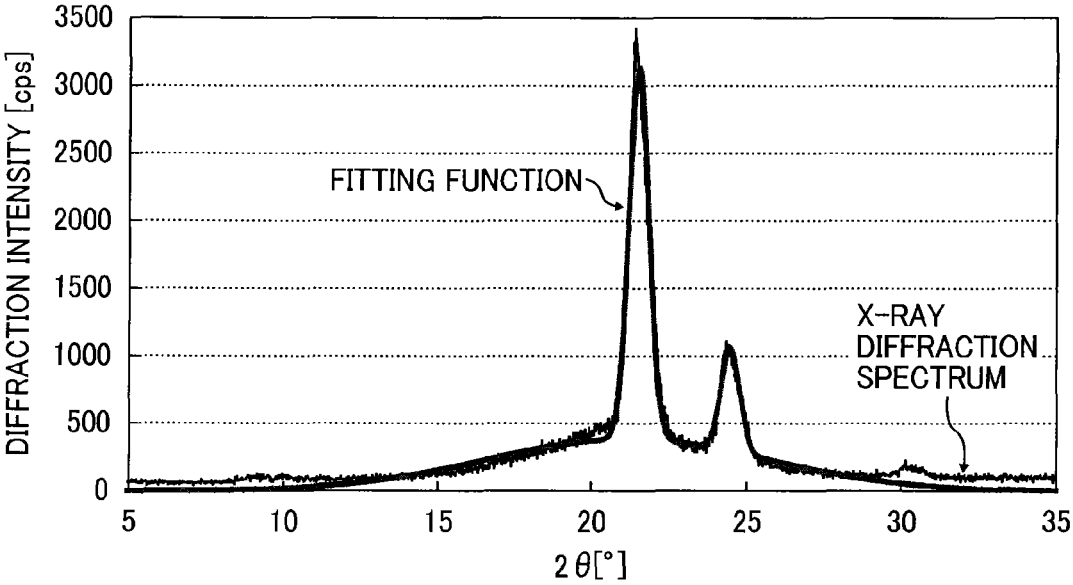

Gaussian function of these two main peaks and halo are as follows:

$$f_{p1}(2\theta)=a_{p1}\exp(-(2\theta-b_{p1})^2/(2c_{p1}^2)) \quad \{\text{Relation A (1)}\}$$

$$f_{p2}(2\theta)=a_{p2}\exp(-(2\theta-b_{p2})^2/(2c_{p2}^2)) \quad \{\text{Relation A (2)}\}$$

$$f_h(2\theta)=a_h\exp(-(2\theta-b_h)^2/(2c_h^2)) \quad \{\text{Relation A (3)}\}$$

fp1(2θ), fp2(2θ), and fh(2θ) are functions corresponding to the main peaks P1 and P2 and the halo, respectively. The sum of these three functions: $f(2\theta)=f_{p1}(2\theta)+f_{p2}(2\theta)+f_h(2\theta)$ {Relation A (4)} is defined as the fitting function of the entire X-ray diffraction spectrum as illustrated in FIG. 11B and fitting is conducted by the least-square approach.

The fitting variables are nine variables of ap1, $b_{p1}$, $c_{p1}$, $a_{p2}$, $b_{p2}$, $c_{p2}$, $a_h$, $b_h$, and $c_h$. As the initial values for fitting of each variable, the peak positions of the X-ray diffraction are assigned for $b_{p1}$, $b_{p2}$, and $b_h$ (21.3=$b_{p1}$, 24.2=$b_{p2}$, 22.5=$b_h$ in the example illustrated in FIGS. 11A and 11B) and suitable values are assigned for the other variables to match the two main peaks and the halo with the X-ray diffraction spectrum as much as possible. Fitting may be conducted by, for example, SOLVER of EXCEL 2003 manufactured by MICROSOFT CORPORATION.

The crystallinity (%) can be calculated from the equation of $(S_{p1}+S_{p2})/(S_{p1}+S_{p2}+S_h)\times 100$, based on each area of Gaussian functions ($f_{p1}(2\theta)$ and $f_{p2}(2\theta)$ corresponding to the two main peaks (p1, p2) and Gaussian function $f_h(2\theta)$ corresponding to the halo after the fitting.

The maximum endotherm peak temperature during the second time temperature rising is from 50° C. to 70° C., preferably from 55° C. to 68° C., and more preferably from 60° C. to 65° C. When the maximum endotherm peak temperature is too low, the high temperature stability of toner may deteriorate. When the maximum endotherm peak temperature is too high, the low temperature fixing property of toner may deteriorate.

The amount of melting heat during the second time temperature rising is from 30 J/g to 75 J/g, preferably from 45 J/g to 70 J/g, and more preferably from 50 J/g to 60 J/g. When the amount of melting heat during the second time temperature rising is too small, the high temperature storage tends to deteriorate. When the weight average molecular weight during the second time temperature rising is too large, the low temperature fixing property tends to deteriorate.

The amount of the maximum endotherm peak temperature during the second time temperature rising and the amount of the melting heat during the second time temperature rising can be measured by a differential scanning calorimetry (DSC).

The content of nitrogen element in the toner component soluble in tetrahydrofuran (THF) is from 0.3% by weight to 2.0% by weight, preferably 0.5% by weight to 1.8% by weight, and more preferably from 0.7% by weight to 1.6% by weight. When the content of nitrogen element in the toner component soluble in tetrahydrofuran (THF) is too small, the hot offset resistance of the toner tends to deteriorate. By contrast, when the content is too high, the low temperature fixability of the toner easily deteriorates.

The content of nitrogen element in the toner component soluble in tetrahydrofuran (THF) can be measured by element analysis.

The toner preferably has a urea bond.

The existence of the urea bond in the toner can be confirmed by $^{13}$CNMR of the component of the toner soluble in tetrahydrofuran. To be specific, it can be checked by chemical shift derived from carbonyl carbon of a urea bond. The chemical shift derived from carbonyl carbon of a urea bond is observed between 150 ppm and 160 ppm.

The storage elastic modulus G'(80) of the toner at 80° C. ranges from $1.0\times10^4$ Pa to $5.0\times10^5$ Pa, preferably from $1.0\times10^4$ Pa to $1.0\times10^5$ Pa, and more preferably from $5.0\times10^4$ Pa to $1.0\times10^5$ Pa. When storage elastic modulus G'(80) is too small, the high temperature stability of toner tends to deteriorate. When the storage elastic modulus G'(80) is too large, the low temperature fixing property of toner tends to deteriorate.

The storage elastic modulus G'(140) of the toner at 140° C. ranges from $1.0\times10^3$ Pa to $5.0\times10^4$ Pa, preferably from $1.0\times10^3$ Pa to $1.0\times10^4$ Pa, and more preferably from $5.0\times10^3$ Pa to $1.0\times10^4$ Pa. When storage elastic modulus G'(140) is too small, the high temperature stability of toner tends to deteriorate. When the storage elastic modulus G'(140) is too large, the low temperature fixing property of toner tends to deteriorate.

When storage elastic modulus G' can be measured by a dynamic viscoelasticity measuring equipment.

Second Embodiment of Toner

The toner of the second embodiment does not contain a crystalline resin as a main component. The toner contains a non-linear non-crystalline polyester and a linear non-crystalline polyester. The non-linear non-crystalline polyester is insoluble in tetrahydrofuran and the linear non-crystalline polyester is soluble in tetrahydrofuran.

Also, the toner optionally contains a crystalline polyester.

To improve the low temperature fixability, the glass transition of toner is lowered or the molecular weight of toner is reduced in order for a non-crystalline polyester to be eutectic with a crystalline polyester. However, the high temperature stability of toner and the hot offset resistance thereof are degraded by simply lowering the glass transition temperature of a non-crystalline polyester or reducing the molecular weight to lower the melt viscosity of toner.

By contrast, since the non-crystalline polyester has an extremely low glass transition temperature, it tends to be deformed at low temperatures. Therefore, the polyester is deformed upon application of heat and pressure during fixing. That is, it is easily attached to a recording medium, typically paper, at lower temperatures. In addition, precursors of the non-linear polyester are non-linear as described later. Therefore, it has a branch structure in its molecule skeleton and the molecule chain thereof takes three-dimensional network structure. As a result, the polyester is deformed at low temperatures but with no fluidity like rubber. Therefore, it is possible to strike a balance between high temperature stability and hot offset resistance. In a case in which the non-linear non-crystalline polyester has a urethane bond or a urea bond, which have high agglomeration energy, the polyester behaves like a pseudo-cross-linking point. This enhances the characteristic of rubber, thereby improving the hot offset resistance and the high temperature stability of toner.

Such toner has a glass transition temperature in an extremely low temperature range but has a high melt-viscosity. For this reason, the high temperature stability and the hot offset resistance of toner are maintained by a combinational use of a non-linear non-crystalline polyester having less fluidity and a linear crystalline polyester, optionally together with a crystalline polyester, even when toner is designed to have a lower glass transition temperature than conventional toner. Moreover, the lower temperature fixability becomes excellent because the glass transition temperature is lowered.

The non-linear non-crystalline polyester is prepared by reacting a non-linear reactive precursor and a curing agent.

There is no specific limit to the non-linear non-crystalline polyester if it is a polyester prepolymer having a group reactive with a curing agent.

There is no specific limit to the group reactive with a curing agent. Specific examples thereof include, but are not limited to, an isocyanate group, an epoxy group, a carboxylic acid group, and an acid chloride group. Of these, an isocyanate group is preferable because it can introduce a urethane bond and/or a urea bond into a non-linear non-crystalline polyester.

In addition, "non-linear" represents it has a branch structure based on a tri- or higher alcohols and/or a tri- or higher carboxylic acid.

In addition, the polyester prepolymer having an isocyanate group is obtained by reacting a polyester having a hydroxyl group with a polyisocyanate.

Polyester having an active hydrogen group is prepared by polycondensation of a diol and dicarboxylic acid and a tri- or higher alcohol and/or tri- or higher carboxylic acid.

A tri- or higher alcohol and a tri- or higher carboxylic acid provides a polyester having an isocyanate group with a branch structure Specific examples of diols include, but are not limited to, aliphatic diols such as ethylene glycol, 1,2-propylene glycol, 1,3-propylene glycol, 1,4-butane diol, 3-methyl-1,5-pentante diol, 1,6-hexane diol, 1,8-octane diol, 1,10-decane diol, and 1,12-dodecane diol; diols having oxyalkylene groups such as diethylene glycol, triethylene glycol, dipropylene glycol, polyethylene glycol, polypropylene glycol, and polytetramethylene glycol; alicyclic diols such as 1,4-cyclohexane dimethanol and hydrogenated bisphenol A; adducts of alicyclic diols with an alkylene oxide such as ethylene oxide, propylene oxide, and butylene oxide; bisphenols such as bisphenol A, bisphenol F, and bisphenol S; and adducts of bisphenols with an alkylene oxide such as ethylene oxide, propylene oxide, and butylene oxide. These can be used alone or in combination. Of these, aliphatic diols having 4 to 12 carbon atoms are preferable.

There is no specific limit to dicarboxylic acid.

Specific examples thereof include, but are not limited to, aliphatic dicarboxylic acids having 4 to 20 carbon atoms (e.g., succinic acid, adipic acid, sebacic acid, dodecanedioic acid, maleic acid, and fumaric acid); aromatic dicarboxylic acids (e.g., phthalic acid, isophthalic acid, terephthalic acid, and naphthalene dicarboxylic acids). These can be used alone or in combination. Of these, aliphatic dicarboxylic acid having 4 to 12 carbon atoms are preferable.

Instead of dicarboxylic acid, anhydrides of dicarboxylic acids, lower alkyl esters having 1 to 3 carbon atoms, and a halogenized compound can be used.

There is no specific limit to tri- or higher aliphatic alcohol. Specific examples thereof include, but are not limited to, tri- or higher alcohols (glycerin, trimethylol ethane, trimethylol propane, pentaerythritol, and sorbitol); polyphenols having three or more hydroxyl groups (such as trisphenol PA, phenolic novolak and cresol novolak); and adducts of polyphenols having three or more hydroxyl groups mentioned above with an alkylene oxide (ethylene oxide, propylene oxide, and butylene oxide).

There is no specific limit to tri- or higher carboxylic acid. Specific examples thereof include, but are not limited to, tri- or higher aromatic carboxylic acids having 9 to 20 carbon atoms such as trimellitic acid and pyromellitic acid.

Instead of tri- or higher carboxylic acid, anhydrides of tri- or higher carboxylic acids, lower alkyl esters having 1 to 3 carbon atoms, and a halogenized compound can be used.

There is no specific limit to polyisocyanate. Specific examples thereof include, but are not limited to, diisocyanates (aliphatic diisocyanates, alicyclic diisocyanates, aromatic diisocyanates, aromatic aliphatic diisocyanates, isocyanulates), and tri- or higher isocyanates. Theses can be used alone or in combination.

Specific examples of aliphatic diisocyanates include, but are not limited to, tetramethylene diisocyanate, hexamethylene diisocyanate and 2,6-diisocyanate methylcaproate, octamethylene diisocyanate, decamethylene diisocyanate, dodecamethylene diisocyanate, tetradecamethylene diisocyanate, trimethyl hexane diisocyanate, and tetramethyl hexane diisocyanate.

Specific examples of the alicyclic diisocyanates include, but are not limited to, isophorone diisocyanate and cyclohexylmethane diisocyanate.

Specific examples of aromatic diisoycantes include, but are not limited to, tolylene diisocyanate, diphenylmethane diisocyanate, 1,5-naphtylene diisocyanate, 4,4'-diisocyanate-3,3'-dimethyldiphenyl, 4,4'-diisocyanate-3-methyl diphenylmethane, and 4,4'-diisocyanate-diphenyl ether.

Specific examples of the aromatic aliphatic diisocyanates include, but are not limited to, α, α, α', α'-tetramethyl xylylene diisocyanate.

Specific examples of the isocyanurates include, but are not limited to, tris(isocyanate alkyl)isocyanulate, and tris(isocyanate cycloalkyl)isocyanulate.

Instead of polyisocyanate, blocked polyisocyanates in which the isocyante group is blocked with phenolic derivatives, oximes, or caprolactams are suitably used.

Any curing agent that reacts with a non-linear reactive precursor to produce a non-linear non-crystalline polyester can be suitably used. For example, compounds having active hydrogen groups are usable.

There is no specific limit to active hydrogen groups. Specific examples thereof include, but are not limited to, hydroxyl groups (alcohol hydroxyl groups and phenolic hydroxyl groups), an amino group, a carboxyl group, and a mercarpto group. These can be used alone or in combination. Of these, amino group is preferable because it can form a urea bond.

There is no specific limit to the compound having an amino group. Specific examples thereof include, but are not limited to, diamines such as aromatic diamines, alicyclic diamines, and aliphaitc diamines, tri- or higher amines such as diethylene triamine and triethylene tetraamine), amino alcohols such as ethenol anmine, and hydroxyethyel aniline), aminomercaptanes such as aminoethyl meracaptane, and aminopropyl mercaptane), amino acids such as amino propionic acids and aminocaprolactonic acid). These can be used alone or in combination. Of these, diamine and a mixture of a dmaine with a small amount of a tri- or higher amine are preferable.

Specific examples of aromatic diamines include, but are note limited to, phenylene diamines, diethyl toluene diamines, and 4,-4'-diamino diphenyl methane.

Specific examples of alicyclic diamines include, but are not limited to, 4,4'-diamino-3,3-dimethyl dicyclohexyl methane, diaminocyclohexane, and isophoron diamine.

Specific examples of the aliphatic diamines include, but are not limited to, ethylene diamine, tetramethylene diamine, and hexamethylene diamine.

Instead of a compound having an amino group, a compound having a blocked amino group can be used.

There is no specific limit to the compound having a blocked amino group. Specific examples of ketimines and oxazolines having amino groups blocked by ketones such as acetone, methylethyl ketone, and methylisobutyl ketone.

The non-linear non-crystalline polyester preferably satisfies the following (a) to (c) to lower the glass transition temperature of toner and impart properties of being easily deformed at low temperatures.

(a): the content of aliphatic diol having 4 to 12 carbon atoms in diol is 50% by weight or more:

(b): the content of aliphatic diol having 4 to 12 carbon atoms in diol or tri- or higher alcohols is 50% by weight or more.

(c): the content of aliphatic dicarboxylic acid having 4 to 12 carbon atoms in dicarboxylic acid is 50% by weight or more.

The non-linear non-crystalline polyester has a glass transition temperature of from −60° C. to 0° C. and preferably from −40° C. to −20° C. When the glass transition temperature of a non-linear non-crystalline polyester is too low, the fluidity of toner at low temperatures may not be able to be controlled, thereby degrading high temperature stability and filming resistance. When the glass transition temperature of a non-linear non-crystalline polyester is too high, deformation of toner upon application of heat and pressure during fixing tends to be insufficient, thereby degrading the low temperature fixability of toner.

The weight average molecular weight of the non-linear non-crystalline polyester ranges from 20,000 to 100,000. When the weight average molecular weight of the non-linear non-crystalline polyester is too small, the fluidity of toner tends to be increased, thereby degrading the high temperature stability of toner or lowering the viscosity thereof during melt-fusing, which leads to deterioration of hot offset resistance. When the weight average molecular weight of the non-linear non-crystalline polyester is too large, the low temperature fixability of toner tends to deteriorate.

The weight average molecular weight of the non-linear non-crystalline polyester can be obtained as a molecular weight in polystyrene conversion by a gel permeation chromatography (GPC).

The molecular structure of the non-linear non-crystalline polyester can be confirmed by X-ray diffraction, GC/MS, LC/MS, IR measuring, etc. in addition to measuring a solution or solid by NMR. In an infra red absorption spectrum, a portion having no absorption between 955 $cm^{-1}$ and 975 $cm^{-1}$ and 980 $cm^{-1}$ and 1,000 $cm^{-1}$ based on δCH (deformation of out-of-plane) of an olefin is detected as a non-crystalline polyester.

The content of the non-linear non-crystalline polyester of toner ranges from 5% by weight to 25% by weight and preferably from 10% by weight to 20% by weight. When the content of the non-linear non-crystalline polyester of toner is too small, the low temperature fixability and the hot offset resistance of toner tend to deteriorate. When the content of the non-linear non-crystalline polyester of toner is too large, the high temperature stability of toner and the gloss of an image easily lowers.

The linear non-crystalline polyester is preferably a linear non-modified polyester.

The non-modified polyester represents not being modified by a polyisocyanate, etc.

The linear non-modified polyester is obtained by polyceondensation of a diol and a dicarboxylic acid.

There is no specific limit to diol. Specific examples thereof include, but are not limited to, adducts of bisphenol A of polyoxypropylene (2,2)-2,2-bis(4-hydroxyphenyl)propane, polyoxyethylene (2,2)-2,2-bis 4-hydroxyphenyl) propane, etc. with an average added mol of from 1 to 10 of an alkylene oxide having 2 or 3 carbon atoms; ethylene glycol and proplyene glycol; hydrogenated bisphenol A; and adducts of hydrogenated bisphenol A with an average added mol of from 1 to 10 of an alkylene oxide having 2 or 3 carbon atoms. These can be used alone or in combination.

There is no specific limit to dicarboxylic acid. Specific examples thereof include, but are not limited to, adipic acid, phthalic acid, isophthalic acid, terephthalic acid, fumaric acid, malic acid, and succinic acid substituted by an alkyl group having 1 to 20 carbon atoms or an alkenyl group having 2 to 20 carbon atoms such as deodecenyl succinic acid and octyl succinic acid.

The linear non-crystalline polyester may have a constitution unit derived from tri- or higher carboxylic acid and/or a constitution unit derived from tri- or higher alcohol at its end to adjust the acid value and/or the hydroxyl value.

There is no specific limit to tri- or higher carboxylic acid. Specific examples thereof include, but are not limited to, trimellitic acid and pyromellitic acid.

There is no specific limit to tri- or higher alcohol. Specific examples thereof include, but are not limited to, glycerin, trimethylol propane, and pentaerythritol.

The weight average molecular weight of the linear non-crystalline polyester is from 3,000 to 10,000 and preferably from 4,000 to 7,000. The number average molecular weight of the linear non-crystalline polyester is from 1,000 to 4,000 and preferably from 1,500 to 3,000. Furthermore, the ratio of the weight average molecular weight of the linear non-crystalline polyester to the number average molecular weight thereof is from 1.0 to 4.0 and preferably from 1.0 to 3.5. When the weight average molecular weight of the linear non-crystalline polyester is too small, the high temperature stability of toner tends to deteriorate and the durability of toner to stress such as stirring in a development device tends to deteriorate. When the weight average molecular weight of the linear non-crystalline polyester is too large, the melt-viscosity of melted toner tends to be high, thereby having an adverse impact on the low temperature stability.

The weight average molecular weight and the number average molecular weight of the linear non-crystalline polyester is obtained as a molecular weight in polystyrene conversion by measuring by GPC.

The acid value of the linear non-crystalline polyester is from 1 mgKOH/g to 50 mgKOH/g and preferably from 5 mgKOH/g to 30 mgKOH/g. When the acid value of the linear non-crystalline polyester is 1 mgKOH/g or more, toner tends to be negatively charged, thereby improving affinity between paper and the toner during fixing, resulting in improvement of the low temperature fixability thereof. When the acid value of the linear non-crystalline polyester is too large, charging stability, in particular charging stability to environmental change tends to deteriorate.

The hydroxyl value of the linear non-crystalline polyester is 5 mgKOH/g or more.

The glass transition temperature of the linear non-crystalline polyester is from 40° C. to 80° C. and preferably from 50° C. to 70° C. When the glass transition temperature of the linear non-crystalline polyester is too low, the higher temperature stability of toner, the durability thereof to stress such as stirring in a development device, and the filming resistance of toner tend to deteriorate. When the glass transition temperature of the linear non-crystalline polyester is too high, the deformation of toner upon application of heat and pressure during fixing thereof tends to be insufficient, thereby degrading the low temperature fixability.

The molecule structure of the linear non-crystalline polyester can be confirmed by X-ray diffraction, GC/MS, LC/MS, IR measuring, etc. in addition to measuring a solution or solid by NMR. In an infra red absorption spectrum, a portion having no absorption between 955 $cm^{-1}$ and 975 $cm^{-1}$ and 980 $cm^{-1}$ and 1,000 $cm^{-1}$ based on δCH (deformation of out-of-plane) of an olefin is detected as a non-crystalline polyester.

The content of the linear non-crystalline polyesterin toner is from 50% by weight to 90% by weight and preferably from 60% by weight to 80% by weight. When the content of the linear non-crystalline polyester n toner is too small, the dispersability of a pigment and a releasing agent in toner tends to deteriorate, thereby causing fogging and disturbance of an image. When the content of the linear non-crystalline polyester in toner is too large, the low temperature fixability of toner tends to deteriorate because the content of the crystalline polyester resin and the non-linear non-crystalline polyester becomes small.

The crystalline polyester has a high crystallinity. For this reason, it has a heat melting property indicating a sharp viscosity drop around a fixing starting temperature. By using both a crystalline polyester and a non-crystalline polyester, the high temperature stability of toner is good at temperatures up to the melt-fusing starting temperature. At the melt-fusing starting temperature, the viscosity of toner drops sharply by melting of the crystalline polyester. For this reason, the crystalline polyester becomes compatible with the linear non-crystalline polyester, which leads to fixing. As a result, toner having a good combination of high temperature stability and low temperature fixability is obtained. In addition, the fixing range (difference between the lowest fixing temperature and the highest fixing temperature) is good.

The crystalline polyester is obtained by polycondensation of a polyol and a polycarboxylic acid. Therefore, the crystalline polyester excludes a crystalline polyester prepolymer having an isocyanate group and a crystalline modified polyester obtained by cross-linking and/or elongating a crystalline polyester prepolymer having an isocyanate group.

There is no specific limit to polyols. Specific examples thereof include, but are not limited to, diols and tri- or higher alcohols.

Specific examples of diols include, but are not limited to, saturated aliphatic diols (linear saturated aliphatic diols, non-linear saturated diols). These can be used in combination. Of these, linear saturated aliphatic diols are preferable and linear saturated aliphatic diols having 2 to 12 carbon atoms are more preferable. When a saturated aliphatic diols has a side chain, the crystallinity of the crystalline polyester tends to deteriorate, which leads to lowering of melting points. When the saturated aliphatic diol has too many number of carbon atoms, availability thereof on the market becomes low.

Specific examples of the saturated aliphatic diols include, but are not limited to, ethylene glycol, 1,3-propane diol, 1,4-butane diol, 1,5-pentane diol, 1,6-hexane diol, 1,7heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,14-eicosane diol. Of these, in terms of crystallinity and a sharp melt of a crystalline polyester, ethylene glycol, 1,4-butane diol, 1,6-hexane diol, 1,8-octane diol, 1,10-decane diol, and 1,12-dodecane diol.

Specific examples of the alcohols having three or more hydroxyl groups include, but are not limited to, glycerin, trimethylol ethane, trimethylol propane, and pentaerythritol.

There is no specific limit to the polycarboxylic acids. Specific examples thereof include, but are not limited to, dicarboxylic acids and tri- or higher carboxylic acid.

Specific examples of dicarboxylic acids include, but are not limited to, saturated aliphatic dicarboxylic acids such as oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid; and aromatic dicarboxylic acids of dibasic acids such as phthalic acid, isophthalic acid, terephthalic acid, naphthalene-2,6-dicarboxylic acid, manoic acid, and mesaconic acid.

Specific examples of tri- or higher carboxylic acids include, but are not limited to, 1,2,4-benzene tricarboxylic acid, 1,2,5-benzene tricarboxylic acid, 1,2,4-naphtalene tricarboxylic acid.

Instead of polycarboxylic acid, anhydrides thereof or lower alkyl esters having one to three carbon atoms can be used.

In addition, dicarboxylic acid having a sulfonic acid group can be used in combination with the saturated alipahtic dicarboxylic acid and the aromatic dicarboxylic acid mentioned above.

Furthermore, dicarboxylic acid having a carbon carbon double bond can be used in combination with the saturated alipahtic dicarboxylic acid and the aromatic dicarboxylic acid mentioned above.

The crystalline polyester preferably contains a constitution unit derived from a saturated alipahtic dicarboxylic acid having 4 to 12 carbon atoms and a constitution unit derived from a saturated aliphatic diol having 2 to 12 carbon atoms. By these constitutions, the crystallinity of toner is increased and the sharp-melt property thereof becomes excellent, thereby improving the low temperature fixability.

The crystalline polyester has a melting point of from 60° C. to 80° C. When the melting point of the crystalline polyester is too low, the crystalline polyester tends to be melted at low temperatures, thereby degrading the high temperature stability of toner. When the melting point of the crystalline polyester is too low, the crystalline polyester is not melted sufficiently by heat applied during fixing, degrading the low temperature fixability.

The weight average molecular weight of the crystalline polyester is from 3,000 to 30,000 and preferably from 5,000 to 15,000. The number average molecular weight of the crystalline polyester is from 1,000 to 10,000 and preferably from 2,000 to 10,000. Furthermore, the ratio of the weight average molecular weight of the crystalline polyester to the number average molecular weight thereof is from 1.0 to 10 and preferably from 1.0 to 5.0. The low temperature fixability of toner is excellent when the non-crystalline polyester has a sharp molecular weight distribution and a low molecular weight. When the content of components having a crystalline polyester having a small molecular weight is too large, the high temperature stability thereof tends to deteriorate.

The weight average molecular weight and the number average molecular weight of the crystalline polyester is obtained as a molecular weight in polystyrene conversion by measuring by GPC.

The acid value of the crystalline polyester is 5 mgKOH/g or more and preferably 10 mgKOH/g or more to demonstrate good low temperature fixability in terms of affinity with paper. The acid value of the crystalline polyester is 45 mgKOH/g or less to improve hot offset resistance.

The hydroxyl value of the crystalline polyester is from 0 mgKOH/g to 50 mgKOH/g and preferably from 5 mgKOH/g to 50 mgKOH/g.

The molecular structure of the crystalline polyester can be confirmed by X-ray diffraction, GC/MS, LC/MS, IR measuring, etc. in addition to measuring a solution or solid by NMR. In an infra red absorption spectrum, a portion having absorptions between 955 $cm^{-1}$ and 975 $cm^{-1}$ and 980 $cm^{-1}$ and 1,000 $cm^{-1}$ based on δCH (deformation of out-of-plane) of an olefin is detected as a crystalline polyester.

The content of the crystalline polyester in toner is from 3% by weight to 20% by weight and preferably from 5% by weight to 15% by weight. When the content of the crystalline polyester in toner is too small, the low temperature fixability thereof tends to deteriorate since sharp-melting is insufficient due to the crystalline polyester is insufficient. When the content of the crystalline polyester in toner is too large, the high temperature stability of toner tends to deteriorate and fogging of an image tends to occur.

The glass transition temperature (Tg1st) during the first time temperature rising in measuring of differential scanning calorimetry of toner ranges from 30° C. to 50° C. When Tgist is too low, the high temperature stability of toner tends to deteriorate, which leads to occurrence of blocking in a development device and filming on an image bearing member. When Tgist is too low, the low temperature fixability of toner tends to deteriorate.

Conventionally, toner easily agglomerates due to temperature change during transfer or storage of toner in summer or a tropical zone when the glass transition temperature of toner is around 50° C. or lower. As a consequence, solidification of toner in a toner bottle or fixation thereof in a development device occurs. In addition, toner is not replenished properly due to clogging of toner in a toner bottle or defective images are produced due to fixation of toner in a development device. To the contrary, although the toner of this embodiment of the present invention has a lower glass transition temperature than that of a conventional toner, the high temperature stability of the toner can be maintained since the toner contains a non-linear crystalline polyester having a low glass transition temperature.

It is preferable that the difference between Tg1st and Tg2nd, which represents the glass transition temperature during the second time temperature rising in the measuring by differential scanning calorimetry, is 10° C. or more (Tg1st-Tg2nd). As a result, the low temperature fixability of toner is improved. The difference (Tg1st-Tg2nd) of 10° C. or more means that the crystalline polyester, the non-linear non-crystalline polyester, and the linear non-crystalline polyester present incompatible before first time temperature rising become compatible after the first time temperature rising. Being compatible does not necessarily mean complete compatible. The difference (Tg1st-Tg2nd) is 50° C. or less.

The melting point of toner is normally from 60° C. to 80° C.

The toner of this embodiment preferably satisfies the following relation: $T2-T1 \geq 20$, where T1° C. represents a temperature when the storage elastic modulus of toner is $3.0 \times 10^4$ Pa and T2° C. represents a temperature when the storage elastic modulus of toner is $1.0\times10^4$ Pa.

As the difference (T2−T1) becomes larger, the storage elastic modulus is more dependent on temperature. As the difference (T2−T1) becomes smaller, the storage elastic modulus is less dependent on temperature. In addition, as the difference (T2−T1) becomes larger, the difference between the gloss degree at the lowest fixing temperature and the gloss degree at 20° C. higher than the lowest fixing temperature, i.e., the gloss degree variation, becomes small. As the difference (T2−T1) becomes smaller, the gloss degree variation, becomes large. The usage temperature range of a fixing device is 20° C. or less. Therefore, the gloss degree variation of an image in a page can be suppressed if T2−T1 is 20° C. or more.

The toner of this embodiment is preferably 30° C. or more. In this case, if the temperature control of a fixing device is overshot, the gloss degree variation in a page is not a problem if the temperature control range is within 30° C.

The upper limit of the difference (T2−T1) is about 40° C. To have a difference (T2−T1) of greater than 40° C., it is required to broaden the molecular weight distribution or increase the cross-linking density. In this case, the gloss degree variation can be suppressed but the low temperature fixability of toner significantly deteriorates. In a typical usage, it is not difficult to control temperatures within an overshooting of a fixing device of 40° C.

Moreover, if the difference (T2−T1) is large, hot offset resistance becomes excellent. To the contrary, if the difference (T2−T1) is small, hot offset resistance deteriorates.

It is preferable that, in the toner of this embodiment, Tg2nd of the component insoluble in THF is from −40° C. to 30° C. When Tg2nd of the component insoluble in THF is too low, the high temperature stability tends to deteriorate. When Tg2nd of the component insoluble in THF is too high, the low temperature fixing property easily deteriorates.

Tg2nd of the component in toner insoluble in THF corresponds to Tg2nd of a non-linear non-crystalline polyester. When Tg2nd of the component in toner insoluble in THF is lower than that of a linear non-crystalline polyester, it has a positive impact on the low fixing temperature fixability of toner. Furthermore, when a non-linear non-crystalline polyester has a urethane bond or a urea bond, which has a high agglomerating force, high temperature stability is sustained greatly.

The toner preferably satisfies the following relation:

$$1\times10^5 \geq G'(100)(Pa) \geq 1\times10^7$$

$$G'(40)(Pa)/G'(100)(Pa) \leq 35,$$

where G'(40)(Pa) represents the storage elastic modulus of a toner component insoluble in THF at 40° C. and, G'(100)(Pa), at 100° C. By satisfying these relations, the compatibility of a linear non-crystalline polyester and an optional crystalline polyester is promoted, thereby improving the low temperature fixability of toner.

Furthermore, G'(100) is preferably from $5\times10^5$ Pa to $5\times10^6$ Pa. In this range, the low temperature fixability, the high temperature stability, and the hot offset resistance of toner are sustained.

When toner contains a crystalline polyester, Tg2nd of a toner component soluble in THF ranges from 20° C. to 35° C. The toner component soluble in THF is formed of a linear non-crystalline polyester and a crystalline polyester. Since the crystalline polyester is crystalline, the viscosity thereof drops sharply around the fixing starting temperature. By using a crystalline polyester having such a property and a non-crystalline polyester in combination, the high temperature stability of toner is good up to a temperature just below the fixing starting temperature due to the crystalline polyester. In addition, at the melt-fusing starting temperature, the viscosity of toner drops sharply due t melting of the crystalline polyester. As a result, the crystalline polyester becomes compatible with the linear non-crystalline polyester so that both lose viscosity sharply followed by fixing. Therefore, toner having a good combination of high temperature stability and low temperature fixability is obtained. When Tg2nd of the component in toner soluble in THF is too low, for example, lower than 20° C., blocking (sticking) resistance of fixed images (printed matter) tends to deteriorate. When Tg2nd of the toner component soluble in THF is too high, for example, higher than 35° C., low temperature fixability and gloss tend to be insufficient.

The content of the component in toner insoluble in THF is from 20% by weight to 35% by weight. When the content of the component in toner insoluble in THF is too low, the glass transition temperature of toner is not lowered, thereby degrading low temperature fixability in some cases. When the content of the component in toner insoluble in THF is too high, the glass transition temperature of toner is excessively lowered, thereby degrading high temperature stability in some cases.

The toner of this embodiment optionally contains a releasing agent, a coloring agent, a charge control agent, a fluidity improver, a cleaning helping agent, a magnetic material, etc.

There is no specific limit to the releasing agent. Specific examples thereof include, but are not limited to, waxes.

Specific examples of waxes include, but are not limited to, natural waxes including: plant waxes such as carnauba wax, cotton wax, and rice wax; animal waxes such as bee wax, lanolin; mineral waxes such as ozokerite and Cercine; and petroleum waxes such as paraffin wax, microcrystalline wax, and petrolatum wax.; petroleum waxes such as paraffin, microcrystalline, and petrolatum; synthesis hydrocarbon waxes such as Fischer-Tropsch wax, polyethylene wax, and polypropylene wax and synthesis wax such as ester, ketone, and ether; and aliphatic acid amide compounds such as 12-hydroxy stearic acid amide, stearic acid amide, anhydride of phthalic acid imide, and chlorinated hydrocarbon. Of these, paraffin wax, mcrocrystalline wax, Fischer-Tropsch wax, polyethylene wax, and polypropylene wax are preferable.

The melting point of a releasing agent is from 60° C. to 80° C. When the melting point is too low, the releasing agent tends to be melted at low temperatures, thereby degrading the high temperature stability of toner. When the melting point is too high, the releasing agent is not sufficiently melted, thereby causing fixing offset, even when a binder resin is melted and toner is in the fixing temperature range. As a result, image deficiency occurs in some cases.

The content of the releasing agent in the toner is from 2% by weight to 40% by weight and preferably from 3% by weight to 30% by weight. When the content of the releasing agent in toner is too low, the hot offset resistance and the low temperature fixability of the toner tend to deteriorate. When the content of the releasing agent in toner is too high, the high temperature stability tends to deteriorate and fogging of an image tends to occur.

Specific examples of the coloring agents for use in the toner of the present disclosure include, but are not limited to, known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like.

The content of the coloring agent in the toner is from 1% by weight to 15% by weight and preferably from 3% by weight to 10% by weight.

Master batch pigments, which are prepared by combining a coloring agent with a binder resin, can be used as the coloring agent of the toner composition of the present disclosure.

Such a master batch is obtained obtained by applying a shearing force to mix and knead a binder resin and a pigment. When manufacturing a master batch, an organic solvent can be used to improve the mutual interaction between the binder resin and the pigment. In addition, so-called flushing methods in which an aqueous paste containing a coloring agent is mixed and kneaded with a binder resin and an organic solvent to transfer the coloring agent to the binder resin followed by removing the organic solvent and water are preferably used because the resultant wet cake of the coloring agent can be used as it is without drying.

There is no specific limit to the device of applying a sharing force for mixing and kneading. A specific example thereof is a triplet roll mill.

There is no specific limit to the charge control agent. Specific examples thereof include, but are not limited to, nigrosine dyes, triphenylmethane dyes, chrome containing metal complex dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surface active agents, metal salts of salicylic acid, copper phthalocyanine, perylene, metal salts of salicylic acid derivatives, quinacridone, and azo-based pigments.

Specific examples of the of the charge control agents available on the market include, but are not limited to, BONTRON 03 (nigrosine dye), BONTRON P-51 (quaternary ammonium salt), BONTRON S-34 (azo dyes containing metal), E-82 (metal complex of oxynaphthoic acid), E-84 (metal complex of salicylic acid), and E-89 (phenolic condensation product), all of which are manufactured by Orient Chemical Industries Co., Ltd.; TP-302 and TP-415 (molybdenum complex of quaternary ammonium salts), which are manufactured by Hodogaya Chemical Co., Ltd.; and LRA-901 and LR-147 (boron complex), which are manufactured by Japan Carlit Co., Ltd.

The content of the charge control agent in toner is from 0.1% by weight to 10% by weight and preferably from 0.2% by weight to 5% by weight. When the content of the charge control agent is too large, the toner tends to have an excessively large charge size, which reduces the effect of the charge control agent, thereby increasing the electrostatic attraction force between a developing roller and the toner, which invites deterioration of the fluidity of a development agent containing the toner and a decrease of the image density of output images.

The charge control agent can be fuse-melted and kneaded together with a binder resin to prepare a master batch and thereafter dispersed in an organic solvent. Alternatively, the charge control agent can be directly dispersed in an organic solvent. Also, it is possible to fix it on the surface of mother toner particle.

There is no specific limit to the fluidizer. Specific examples thereof include, but are not limited to, organic particles such as silica particles, titania particles, and alumina particles.

It is preferable that such a fluidizer is hydrophobized by a surfactant.

There is no specific limit to such a surfactant. Specific examples thereof include, but are not limited to, silane coupling agents, silylating agents, silane coupling agents containing a fluoroalkyl group, organic titanate-based coupling agents, aluminum-based coupling agents, silicone oils, and modified silicone oils.

The content of the fluidizer in toner is from 0.1% by weight to 5% by weight and preferably from 0.3% by weight to 3% by weight.

The primary particle diameter of the fluidizer is 100 nm or less and preferably from nm 3 nm to 70 nm. When the average primary particle diameter of the fluidizer is too small, the fluidizer are easily buried in the toner particle, so that its features are not suitably demonstrated. When the average particle diameter is too large, the surface of the image bearing member may be damaged unevenly.

There is no specific limit to the cleaning helping agent. Specific examples thereof include, but are not limited to, aliphatic metal salts such as zinc stearate and calcium stearate; and polymer particles such as polymethyl methacrylate particles and polystyrene particles prepared by soap-free emulsification polymerization.

The polymer particles have a volume average particle diameter of from 0.01 μm to 1 μm.

There is no specific limit to the magnetic material. Specific examples thereof include, but are not limited to, iron powder, magnetite, and ferrite. Among these, white materials are preferable in terms of coloring.

The resin particles have a volume average particle diameter of from 3 μm to 7 μm. The ratio of the volume average particle diameter of toner to the number average particle diameter thereof is 1.2 or less. The content of particles having a particle diameter of 2 μm or less in toner is 1% by number to 10% by number.

The volume average particle diameter and the number average particle diameter of toner can be measured by Coulter Counter Multisizer II (manufactured by Beckman Coulter Inc.).

There is no specific limit to the method of manufacturing toner. A specific example thereof is a dissolution suspension method. To be specific, toner is manufactured by processes of adjusting an oil phase by dissolving and/or dispersing a toner composition containing a binder resin and/or a precursor thereof in an organic solvent; dispersing the oil phase in an aqueous phase; and removing the organic solvent therefrom to form mother toner particle.

The aqueous phase is prepared by, for example, dispersing resin particles in an aqueous medium.

The content of the resin particle in the aqueous phase is 0.5% by weight to 10% by weight.

There is no specific limit to the aqueous medium. Specific examples thereof include, but are not limited to, water and a solvent mixable with water. Such a solvent can be used alone or in combination. Of these, water is preferable.

Specific examples of such solvents mixable with water include, but are not limited to, alcohols (e.g., methanol, isopropanol, and ethylene glycol), dimethylformamide, tetrahydrofuran, cellosolves, lower ketones (e.g., acetone and methyl ethyl ketone).

The organic solvent has a melting point of 150° C. or lower. There is no specific limit to the organic solvent, which is easily removed. Specific examples thereof include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methylisobuthyl ketone. These can be used alone or in combination. Of these, ethyl aceate, toluene, xylene, benzene, methylene chloride, 1,2-dichloroethane, chloroform, and carbon tetrachloride are preferable. Ethyl acetate is particularly preferable.

When the oil phase contains a precursor of a binder resin, the precursor forms a binder resin when dispersing the oil phase in the aqueous phase.

When the precursor of a binder resin is the non-linear reactive precursor and a curing agent, the non-linear non-crystalline polyester is produced by the following methods of (1) to (3).

(1): Method of producing a non-linear non-crystalline polyester by dispersing an oil phase containing a non-linear reactive precursor and a curing agent in an aqueous phase; and conducting elongation reaction and/or cross-linking reaction of the curing agent and the non-linear reactive precursor in the aqueous phase.

(2): Method of producing a non-linear non-crystalline polyester by dispersing an oil phase containing a non-linear reactive precursor in an aqueous phase to which a curing agent is preliminarily added, and conducting elongation reaction and/or cross-linking reaction of the curing agent and the non-linear reactive precursor in the aqueous phase.

(3): Method of producing a non-linear non-crystalline polyester by dispersing an oil phase containing a non-linear reactive precursor in an aqueous phase; and conducting elongation reaction and/or cross-linking reaction of a curing gent and the non-linear reactive precursor at particle interfaces in the aqueous phase.

In the case of conducting elongation reaction and/or cross-linking reaction of a curing gent and the non-linear reactive precursor at particle interfaces, the non-linear non-crystalline polyester is preferentially formed on the surface of produced mother particle.

The reaction time to produce the non-linear non-crystalline polyester is from 10 minutes to 40 hours and preferably from 2 hours to 24 hours.

The reaction temperature at which the non-linear non-crystalline polyester is produced is from 0° C. to 150° C. and preferably from 40° C. to 98° C.

A catalyst can be used in the elongation reaction and/or cross-linking reaction of the curing gent and the non-linear reactive precursor.

There is no specific limit to the catalyst. Specific examples thereof include, but are not limited to, dibutyl tin laurate, and dioctyl tin laurate.

There is no specific limit to the method of dispersing an oil phase in an aqueous phase. A specific method includes adding an oil phase to an aqueous phase and conducting dispersion by a shearing force.

Specific examples of the dispersion device for use in dispersing an oil phase in an aqueous phase include, but are not limited to, a low speed shearing type dispersion device, a high speed shearing type dispersion device, a friction type dispersion device, a high pressure jet type dispersion device, and an ultrasonic dispersion device. Of these, the high speed shearing type dispersion device is preferable because it can control the particle diameter of the dispersion element, i.e., oil droplet, in the range of from 2μ to 20 μm.

When a high speed shearing type dispersion machine is used, the rotation speed is from 1,000 rpm to 30,000 rpm, and preferably from 5,000 rpm to 20,000 rpm.

The dispersion time when using a high speed shearing type dispersion machine, is from 0.1 minutes to 5 minutes in the batch system.

The dispersion temperature when using a high speed shearing type dispersion machine, is from 0° C. to 150° C. and preferably from 40° C. to 98° C. under a pressure.

The weight ratio of the aqueous medium to the toner material is from 0.5 to 20 and preferably from 1 to 10. When the mass ratio of the aqueous phase to the composition is too small, the dispersion state of the composition tends to be worsened. As a result, the resultant mother toner particle may not have a desired particle diameter. When the mass ratio of the aqueous phase to the composition is too large, the production cost tends to rise.

The aqueous phase preferably contains a dispersant to stabilize dispersion element to obtain a desired form and make the particle size distribution sharp.

There is no specific limit to the dispersant. Specific examples thereof include, but are not limited to, a surfactant, a water-insoluble inorganic compound dispersant, and a protection colloid polymer. These can be used in combination. Of these, surfactants (surface active agents) are preferable.

Specific examples of the surface active agents include, but are not limited to, anionic surface active agents, cationic surface active agents, non-ion active agents, and ampholytic surface active agents.

Specific examples of the anionic surface active agents include, but are not limited to, alkylbenzene sulfonic acid salts, α-olefin sulfonic acid salts, and phosphoric acid salts. Of these, an anionic surface active agent having a fluoroalkyl group is preferable.

There is not specific limit to the method of removing an organic solvent. Specific examples thereof include, but are not limited to, an evaporating method in which the temperature of the system is gradually raised to evaporate and remove an organic solvent; and a method in which the reaction liquid is sprayed in a dry atmosphere to remove an organic solvent.

Mother toner particles is optionally washed and dried and furthermore, classified, if desired.

When classifying mother toner particles, fine particles are removed by cyclone, decanter, centrifugal, etc. before drying the mother toner particles or can be classified after the mother toner particles is dried.

The thus-obtained mother toner particles are optionally mixed with particles such as a fluidizer and a charge control agent. When mixing these, it is possible to prevent particles from being detached from the surface of the mother toner particles by applying a mechanical impact.

There is no specific limit to the method of applying such a mechanical impact. Specific examples thereof include, but are not limited to, a method in which an impact is applied to a mixture by using a blade rotating at a high speed; and a method in which a mixture is put into a jet air to collide particles against each other or into a collision plate.

There is no specific limit to a device to apply such an impact. Specific examples thereof include, but are not limited to, ONG MILL (manufactured by Hosokawa Micron Co., Ltd.), a device remodeled based on I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), and KRYPTRON SYSTEM (manufactured by Kawasaki Heavy Industries, Ltd.), automatic mortars.

The toner of the present disclosure can be used as a single component development agent or a two component development agent formed by mixing with carrier.

A cover layer is formed on the surface of the core metal of a carrier.

There is no specific limit to the material that forms a core metal. For example, manganese-strontium (Mn—Sr) based materials and manganese-magnesium (Mn—Mg) based materials having a mass susceptibility of 50 emu/g to 90 emu/g are preferable. These can be used in combination. To secure image density, highly magnetized materials such as iron having a mass susceptibility of 100 emu/g or more and magnetite having a mass susceptibility of 75 emu/g to 120 emu/g are suitable. In addition, weakly magnetized copper-zinc (Cu—Zn) based materials having a mass susceptibility of from 30 emu/g to 80 emu/g are preferable in terms of reducing the impact of a toner filament formed on a development roller on an image bearing member, which is advantageous in improvement of the image quality.

The core material preferably has a volume average particle diameter of from 10 μm to 150 μm and more preferably from 40 μm to 100 μm. When the volume average particle diameter is too small, fine powder component in carrier tends to increase and the magnetization per particle tends to decrease, which leads to scattering of the carrier particles. When the weight average particle diameter is too large, the specific surface area of the core metal tends to decrease, resulting in scattering of toner. In a full color image in which solid portions account for a large ratio, reproducibility tends to deteriorate particularly in the solid portions.

The cover layer contains a resin.

There is no specific limit to such a resin. Specific examples thereof include, but are not limited to, amino resins, polyvinyl resins, polystyrene resins, polyhalogenated olefin, polyester resins, polycarbonate resins, polyethylene, polyfluoro vinyl, polyfluoro vinylidene, polytrifluoroethylene, polyhexafluoropropylene, a copolymer of polyfluoro vinylidene and an acryl monomer, a copolymer of polyfluoro vinyl and polyfluoro vinylidene, fluoroterpolymers such as a copolymer of tetrafluoroethylene, fluorovinylidene and a monomer including no fluorine atom, and silicone resins. These can be used in combination.

Specific examples of the amino-based resins include, but are not limited to, urea-formaldehyde resins, melamine resins, benzoguanamine resins, urea resins, polyamide resins, and epoxy resins.

Specific examples of the polyvinyl-based resins include, but are not limited to, acrylic resins, polymethyl methacrylate resins, polyacrylonitrile resins, polyvinyl acetate resins, polyvinyl alcohol resins, and polyvinyl butyral resins.

Specific examples of polystyrene resins include, but are not limited to, polystyrene resins and styrene-acrylic copolymers.

A specific example of the halogenated olefin resin is polyvinly chloride.

Specific examples of polyester resins include, but are not limited to, polyethyleneterephthalate resins and polybutyleneterephthalate resins.

The cover layer optionally contains electroconductive powder.

There is no specific limit to such electroconductive powder. Specific examples thereof include, but are not limited to, metal powder, carbon blacks, titanium oxide powder, tin oxide powder, and zinc oxide powder.

The average particle diameter of the electroconductive powder is 1 μm or less. When the average particle diameter of the electroconductive powder is too large, controlling the electric resistance may become difficult.

The cover layer described above can be formed by, for example, dissolving or dispersing a composition containing a resin in a solvent to prepare a liquid application and applying the liquid application to the surface of a core material followed by drying and baking.

There is no specific limit to the application method of a liquid application. Specific examples thereof include, but are not limited to, a dip coating method, a spray coating method, and a brushing method.

There is no specific limit to the solvent. Specific examples thereof include, but are not limited to, toluene, xylene, methylethyl ketone, methylisobutyll ketone, and butyl cellosolve acetate.

There is no specific limit to the baking method. Both an external heating system or an internal heating system can be used. Specific examples thereof include, but are not limited to, a fixed electric furnace, a fluid electric furnace, a rotary electric furnace, a method of using a burner furnace, and a method of using a microwave.

The content of the carrier in a two-component development agent is preferably from 90% by weight to 98% by weight and more preferably from 93% by weight to 97% by weight.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto.

Manufacturing of [Toner 1] to [Toner 9]

Synthesis of [Urethane-Modified Crystalline Polyester Resin A-1]

202 parts of sebacic acid, 15 parts of adipic acid, 177 parts of 1,6-hexane diol, and 0.5 parts of tetrabuthoxy titanate serving as a condensing catalyst were placed in a reaction container equipped with a condenser, a stirrer, and a nitrogen introducing tube to conduct reaction at 180° C. for eight hours in a nitrogen atmosphere while produced water was distilled away. Next, the system was gradually heated to 220° C. to conduct reaction for four hours in a nitrogen atmosphere while produced water and 1,6-hexane diol were distilled away. The reaction was continued with a reduced pressure of from 5 mmHg to 20 mmHg until the weight average molecular weight reached about 12,000. A crystalline polyester was thus obtained. The obtained crystalline polyester had a weight average molecular weight of 12,000.

After the obtained crystalline polyester was transfered to a reaction container equipped with a condenser, a stirrer, and a nitrogen introducing tube, 350 parts of ethyl acetate and 30 parts of 4,4'-diphenyl methane diisocyanate (MDI) were added thereto to conduct reaction at 80° C. for five hours in a nitrogen atmosphere. Next, ethyl acetate was distiled away under a reduced pressure to obtain [Urethane-modified crystalline polyester A-1]. [Urethane-modified crystalline polyester A-1] had a weight average molecular weight of 22,000 and a melting point of 62° C.

Synthesis of Urethane-Modified Crystalline Polyester Resin A-2Synthesis of Urethane-Modified Crystalline Polyester Resin A-1

185 parts of sebacic acid, 13 parts of adipic acid, 106 parts of 1,4-butane diol, and 0.5 parts of titanium dihydroroxybis (triethanol aminate) serving as a condensing catalyst were placed in a reaction container equipped with a condenser, a stirrer, and a nitrogen introducing tube to conduct reaction at 180° C. for eight hours in a nitrogen atmosphere while produced water is distilled away. Next, the system was gradually heated to 220° C. to conduct reaction for four hours while produced water and 1,4-butane diol were distilled away in a nitrogen atmosphere. The reaction was continued with a reduced pressure of from 5 mmHg to 20 mmHg until the weight average molecular weight reached about 14,000. A crystalline polyester was thus obtained. The thus-obtained crystalline polyester had a weight average molecular weight of 14,000.

After the obtained crystalline polyester was transfered to a reaction container equipped with a condenser, a stirrer, and a nitrogen introducing tube, a stirrer, and a nitrogen introducing tube, 250 parts of ethyl acetate and 12 parts of hexamethylene diisocyanate (HDI) were added thereto to conduct reaction at 80° C. in a nitrogen atmosphere for five hours. Next, ethyl acetate was distilled away under a reduced pressure to obtain [Urethane-modified crystalline polyurethane A-2].

[Urethane-modified crystalline polyester A-2] had a weight average molecular weight of 39,000 and a melting point of 63° C.

Synthesis of [Crystalline Polyurea A-3]

123 parts of 1,4-butane diol, 212 parts of 1,6-hexane diol, and 100 parts of methylethylketone (MEK) were placed in a reaction container equipped with a condenser, a stirrer, and a nitrogen introducing tube followed by stirring. 336 parts of hexamethylene diisocyanate (HDI) was added thereto to conduct reaction at 60° C. in a nitrogen atmosphere for five hours. MEK was removed by distilling away under a reduced pressure to obtain [Crystalline polyurea A-3]. [Crystalline polyurea A-3] had a weight average molecular weight of 23,000 and a melting point of 64° C.

Synthesis of [Crystalline Polyester A-4]

185 parts of sebacic acid, 13 parts of adipic acid, 125 parts of 1,4-butane diol, and 0.5 parts of titanium dihydroroxybis (triethanol aminate) serving as a condensing catalyst were placed in a reaction container equipped with a condenser, a stirrer, and a nitrogen introducing tube to conduct reaction at 180° C. for eight hours in a nitrogen atmosphere while produced water was distilled away. Next, the system was gradually heated to 220° C. to conduct reaction for four hours in a nitrogen atmosphere while produced water and 1,4-butane diol were distilled away. The reaction was continued with a reduced pressure of from 5 mmHg to 20 mmHg until the weight average molecular weight reached about 10,000. [Crystalline polyester A-4] was thus obtained. [Crystalline polyester A-4] had a weight average molecular weight of 9,500 and a melting point of 57° C.

Synthesis of [Crystalline Block Copolymer A-5]

39 parts of 1,2-propylene glycol and 270 parts of methylethyl ketone (MEK) were placed in a reaction container equipped with a condenser, a stirrer, and a nitrogen introducing tube followed by stirring. 228 parts of 4,4'-diphenyl methane diisocyanate (MDI) were added thereto to conduct reaction at 80° C. in a nitrogen atmosphere for five hours to obtain an MEK solution of a non-crystalline polyester having an isocyanate group at its end.

202 parts of sebacic acid, 160 parts of 1,6-hexane diol, and 0.5 parts of tetrabuthoxy titanate serving as a condensing catalyst were placed in a reaction container equipped with a condenser, a stirrer, and a nitrogen introducing tube to conduct reaction at 180° C. for eight hours in a nitrogen atmosphere while produced water was distilled away. Next, the system was gradually heated to 220° C. to conduct reaction for four hours while produced water and 1,6-hexane diol were distilled away in a nitrogen atmosphere. The reaction was continued with a reduced pressure of from 5 mmHg to 20 mmHg until the weight average molecular weight reached about 8,000. A crystalline polyester was thus obtained. The thus-obtained crystalline polyeser had a weight average molecular weight of 7,500 and a melting point of 62° C.

A solution in which 320 parts of the thus-obtained crystalline polyester was dissolved in 320 parts of MEK was added to 540 parts of the obtained MEK solution of a non-crystalline polyester having an isocyanate group at its end to conduct reaction at 80° C. for five hours in a nitrogen atmosphere. Next, MEK was distilled away under a reduced pressure to obtain [Crystalline block copolymer A-5]. [Crystalline block copolymer A-5] had a weight average molecular weight of 23,000 and a melting point of 61° C.

Synthesis of Crystalline Polyurea B-1

79 parts of 1,4-butane diamine, 116 parts of 1,6-hexane diamine, and 600 parts of methylethylketone (MEK) were placed in a reaction container equipped with a condenser, a stirrer, and a nitrogen introducing tube followed by stirring. Thereafter, 475 parts of 4,4-diphenyl methane diisocycnate (MDI) was added thereto to conduct reaction at 60° C. for five hours in a nitrogen atmosphere. Next, MEK was distilled away under a reduced pressure to obtain [Crystalline polyurea B-1].

[Crystalline Polyurea B-1] had a Weight Average Molecular Weight of 57,000 and a melting point of 66° C.

Synthesis of [Crystalline Polyester B-2]

230 parts of dodecanedioic acid, 118 parts of 1,6-hexane diol, and 0.5 parts of tetrabuthoxy titanate serving as a condensing catalyst were placed in a reaction container equipped with a condenser, a stirrer, and a nitrogen introducing tube to conduct reaction at 180° C. for eight hours in a nitrogen atmosphere while produced water was distilled away. Next, the system was gradually heated to 220° C. to conduct reaction for four hours while produced water and 1,6-hexane diol were distilled away in a nitrogen atmosphere. The reaction was continued with a reduced pressure of from 5 mmHg to 20 mmHg until the weight average molecular weight reached about 50,000. [Crystalline polyester B-2] was thus obtained. [Crystalline polyester B-2] had a weight average molecular weight of 52,000 and a melting point of 66° C.

Synthesis of [Crystalline Polyester Prepolymer B-3]

202 parts of sebacic acid, 122 parts of 1,6-hexane diol, and 0.5 parts of titanium dihydroroxybis (triethanol aminate) serving as a condensing catalyst were placed in a reaction container equipped with a condenser, a stirrer, and a nitrogen introducing tube to conduct reaction at 180° C. for eight hours in a nitrogen atmosphere while produced water was distilled away. Next, the system was gradually heated to 220° C. to conduct reaction for four hours while produced water and 1,6-hexane diol were distilled away in a nitrogen atmosphere. The reaction was continued with a reduced pressure of from 5 mmHg to 20 mmHg until the weight average molecular weight reached about 25,000. A crystalline polyester was thus obtained.

After the obtained crystalline polyester was transfered to a reaction container equipped with a condenser, a stirrer, and a nitrogen introducing tube, a stirrer, and a nitrogen introducing tube, 300 parts of ethyl acetate and 27 parts of hexamethylene diisocyanate (HDI) were added thereto to conduct reaction at 80° C. in a nitrogen atmosphere for five hours to obtain a 50% by weight ethyl acetate solution of [Crystalline polyester prepolymer B-3] having an isocyanate group at its end.

50 parts of the 50% by weight ethyl acetate solution of [Crystalline polyester prepolymer B-3] was mixed with 10 parts of tetrahydrofuran (THF) followed by an addition of 1 part of dibutyl amine and a two-hour stirring. The thus-obtained sample was subject to GPC measuring. [Crystalline polyester prepolymer B-3] had a weight average molecular weight of 54,000. After the solvent was removed from the thus-obtained sample, the resultant was measured by DSC. [Crystalline polyester prepolymer B-3] had a melting point of 57° C.

Synthesis of Non-Crystalline Polyester C-1

222 parts of an adduct of bisphenol A with 2 mols of ethylene oxide, 129 parts of an adduct of bisphenol A with 2 mols of propylene oxide, 166 parts of isophthalic acid, and 0.5 parts of tetrabuthoxy titanate were placed in a reaction container equipped with a condenser, a stirrer, and a nitrogen introducing tube to conduct reaction at 230° C. for eight hours in a nitrogen atmosphere while produced water was distilled away. Next, the reaction was continued under a reduced pressure of from 5 mmHG to 20 mmHG until the acid value reached 2 mgKOH/g followed by cooling down to 180° C. Furthermore, 35 parts of trimellitic anhydride was added thereto to continue reaction for three hours to obtain [Non-crystalline polyester C-1]. [Non-crystalline polyester C-1] had a weight average molecular weight of 8,000, and a glass transition temperature of 62° C.

Weight Average Molecular Weight

The weight average molecular weight was measured by using a high speed GPC (HLC-8220 GPC, manufactured by TOSOH CORPORATION). The column was TSK gel Super HZM-M 15 cm triplet (manufactured by TOSOH CORPORATION). The sample was dissolved in tetrahydrofuran (manufactured by Wako Pure Chemical Industries, Ltd.) containing a stabilizer to prepare 0.15% by weight solution. Thereafter, the solution was filtered by a filter having a pore diameter of 0.2 μm. Thereafter, 10 μl was poured. At 40° C., the flow speed was 0.35 mL/min. during measuring. The molecular weight of the sample was calculated based on the relation between the logarithmic value and the count number of the standard curve, which were made by standard samples and toluene. The standard samples were simple-dispersion polystyrenes of Showdex STANDARD series (Std. No S-7300, S-210, S-390, S-875, S-1980, S-10.9, S-629, S-3.0, and S-0.580 (manufactured by Showa Denko K. K). A refractive index (RI) detector was used as the detector.

Melting Point and Glass Transition Temperature

The melting point and the glass transition temperature were measured by using a differential scanning calorimeter Q-200 (manufactured by TA Instruments. Japan). About 5.0 mg of a sample was placed in an aluminum sample container. Then, the sample container was placed on a holder unit and the container and the unit were set in an electric furnace. Thereafter, in a nitrogen atmosphere, the unit and the container were heated from −80° C. to 150° C. at a temperature rising speed of 10° C./min. (first time temperature rising). Thereafter, the sample was cooled down from 150° C. to −80° C. at a temperature falling speed of 10° C./min. Thereafter, the sample was heated from −80° C. to 150° C. at a temperature rising speed of 10° C./min. (second time temperature rising).

The glass transition temperature was obtained from the DSC curve in the second time temperature rising using analysis program installed on Q-200 system. In addition, the endotherm peak top temperature obtained from the DSC curve in the second time temperature rising using analysis program installed on Q-200 system was defined as the melting point.

Synthesis of [Graft Polymer 1]

480 parts of xylene and 100 parts of a low molecular weight polyethylene (SANWAX LEL-400, manufactured by Sanyo Chemical Industries, Ltd.) having a softening point of 128° C. were placed in a reaction container equipped with a stirrer and a thermometer followed by nitrogen replacement. Next, the system was heated to 170° C. Thereafter, a liquid mixture of 740 parts of styrene, 100 parts of acrylonitrile, 60 parts of butyl acrylate, 36 parts of di-t-butylperoxy hexahydroterephthalate, and 100 parts of xylene were dripped thereto in three hours. Furthermore, after maintaining the system at 170° C. for 30 minutes, the solvent was removed to obtain [Graft polymer 1]. [Graft polymer 1] had a weight average molecular weight of 24,000 and a glass transition temperature of 67° C.

Preparation of [Liquid Dispersion 1 of Releasing Agent]

50 parts of paraffin wax (HNP-9, manufactured by NIPPON SEIRO CO., LTD.) having a melting point of 75° C., 30 parts of [Graft polymer 1], and 420 parts of ethyl acetate were placed in a contained equipped with a stirrer and a thermometer followed by heating to 80° C. Next, the system was maintained at 80° C. for five hours and thereafter cooled down to 30° C. in one hour. The resultant was dispersed under the condition of liquid transfer speed of 1 kg/hour, disc circumference speed of 6 m/s, 80 volume % filling of 0.5 mm zirconia beads, and 3 pass using a beads mill (ULTRAVISCOMILL, manufactured by Aimex Co., Ltd.) to obtain [Liquid dispersion 1 of releasing agent].

Preparation of [Master Batch 1]

100 parts of [Urethane modified crystalline polyester A-1], 100 parts of carbon black (Printex 35, manufactured by Evonik Degussa GmbH) having an DBP oil absorption amount of 42 mL/100 g and a pH of 9.5, and 50 parts of deionized water were mixed by a HENSCHEL MIXER (manufactured by NIPPON COKE & ENGINEERING CO., LTD.) followed by kneading by twin rolls. Kneading was started at 90° C. and thereafter the system was cooled down gradually to 50° C. The thus-obtained mixture was pulverized by a pulverizer (manufactured by HOSOKWA MICRON CORPORATION) to obtain [Master batch 1].

Preparation of [Master Batch 2]

[Master batch 2] was prepared in the same manner as in [Master batch 1] except that [Urethane-modified crystalline polyester A-2] was used in place of [Urethane-modified crystalline polyester A-1].

Preparation of [Master Batch 3]

[Master batch 3] was prepared in the same manner as in [Master batch 1] except that [Crystalline polyurea A-3] was used in place of [Urethane-modified crystalline polyester A-1].

Preparation of [Master Batch 4]

[Master batch 4] was prepared in the same manner as in [Master batch 1] except that [Crystalline polyester A-4] was used in place of [Urethane-modified crystalline polyester A-1].

Preparation of [Master Batch 5]

[Master batch 5] was prepared in the same manner as in [Master batch 1] except that [Crystalline block copolymer A-5] was used in place of [Urethane-modified crystalline polyester A-1].

Preparation of [Oil Phase 1]

31.5 parts of [Urethane-modified crystalline polyester A-1] and 31.5 parts of ethyl acetate were placed in a container equipped with a thermometer and a stirrer and thereafter heated to a temperature not lower than the melting point of the resin to melt it. Next, 100 parts of 50% by weight ethyl acetate solution of [Non-crystalline polyester C-1], 60 parts of [Releasing agent liquid dispersion 1], and 12 parts of [Master batch 1] were added thereto. Thereafter, the solution was stirred at 50° C. at 5,000 rpm by using a TK HOMOMIXER (manufactured by Primix Corporation) to obtain [Oil phase 1]. [Oil phase 1] was maintained at 50° C. in the container not to be crystallized and used within five hours of preparation.

Preparation of [Oil Phase 2]

46.5 parts of [Urethane-modified crystalline polyester A-1] and 46.5 parts of ethyl acetate were placed in a container equipped with a thermometer and a stirrer and thereafter heated to a temperature not lower than the melting point of the resin to melt it. Next, 60 parts of 50% by weight ethyl acetate solution of [Non-crystalline polyester C-1], 60 parts of [Releasing agent liquid dispersion 1], and 12 parts of [Master batch 1] were added thereto. Thereafter, the solution was stirred at 50° C. at 5,000 rpm by using a TK HOMOMIXER (manufactured by Primix Corporation) to obtain [Oil phase 1]. [Oil phase 2] was maintained at 50° C. in the container not to be crystallized and used within five hours of preparation.

Preparation of [Oil Phase 3]

50 parts of [Urethane-modified crystalline polyester A-1] and 50 parts of ethyl acetate were placed in a container equipped with a thermometer and a stirrer and thereafter heated to a temperature not lower than the melting point of the resin to melt it. Next, 40 parts of 50% by weight ethyl acetate solution of [Non-crystalline polyester C-1], 60 parts of [Releasing agent liquid dispersion 1], and 12 parts of [Master batch 1] were added thereto. Thereafter, the solution was stirred at 50° C. at 5,000 rpm by using a TK HOMOMIXER (manufactured by Primix Corporation) to obtain [Oil phase 3]. [Oil phase 3] was maintained at 50° C. in the container not to be crystallized and used within five hours of preparation.

Preparation of [Oil Phase 4]

54 parts of [Urethane-modified crystalline polyester A-2] and 54 parts of ethyl acetate were placed in a container equipped with a thermometer and a stirrer and thereafter heated to a temperature not lower than the melting point of the resin to melt it. Next, 40 parts of 50% by weight ethyl acetate solution of [Non-crystalline polyester C-1], 60 parts of [Liquid dispersion 1 of releasing agent], and 12 parts of [Master batch 2] were added thereto. Thereafter, the solution was stirred at 50° C. at 5,000 rpm by using a TK HOMOMIXER (manufactured by Primix Corporation) to obtain [Oil phase 4]. [Oil phase 4] was maintained at 50° C. in the container not to be crystallized and used within five hours of preparation.

Preparation of [Oil Phase 5]

54 parts of [Urethane-modified crystalline polyester A-3] and 20 parts of [Crystalline polyurea B-1], and 74 parts of ethyl acetate were placed in a container equipped with a thermometer and a stirrer and thereafter heated to a temperature not lower than the melting point of the resin to melt it. Next, 40 parts of 50% by weight ethyl acetate solution of [Non-crystalline polyester C-1], 60 parts of [Releasing agent liquid dispersion 1], and 12 parts of [Master batch 3] were added thereto. Thereafter, the solution was stirred at 50° C. at 5,000 rpm by using a TK HOMOMIXER (manufactured by Primix Corporation) to obtain [Oil phase 5]. [Oil phase 5] was maintained at 50° C. in the container not to be crystallized and used within five hours of preparation.

Preparation of [Oil Phase 6]

54 parts of [Urethane-modified crystalline polyester A-5] and 54 parts of ethyl acetate were placed in a container equipped with a thermometer and a stirrer and thereafter heated to a temperature not lower than the melting point of the resin to melt it. Next, 40 parts of 50% by weight ethyl acetate solution of [Non-crystalline polyester C-1], 60 parts of [Liquid dispersion 1 of releasing agent], and 12 parts of [Master batch 5] were added thereto. Thereafter, the solution was stirred at 50° C. at 5,000 rpm by using a TK HOMOMIXER (manufactured by Primix Corporation) to obtain [Oil phase 6]. [Oil phase 6] was maintained at 50° C. in the container not to be crystallized and used within five hours of preparation.

Preparation of [Oil Phase 7]

54 parts of [Urethane-modified crystalline polyester A-4] and 20 parts of [Crystalline polyurea B-2], and 74 parts of ethyl acetate were placed in a container equipped with a thermometer and a stirrer and thereafter heated to a temperature not lower than the melting point of the resin to melt it. Next, 40 parts of 50% by weight ethyl acetate solution of [Non-crystalline polyester C-1], 60 parts of [Liquid dispersion 1 of releasing agent], and 12 parts of [Master batch 4] were added thereto. Thereafter, the solution was stirred at 50° C. at 5,000 rpm by using a TK HOMOMIXER (manufactured by Primix Corporation) to obtain [Oil phase 7]. [Oil phase 7] was maintained at 50° C. in the container not to be crystallized and used within five hours of preparation.

Preparation of [Oil Phase 8]

74 parts of [Urethane-modified crystalline polyester A-1] and 74 parts of ethyl acetate were placed in a container equipped with a thermometer and a stirrer and thereafter heated to a temperature not lower than the melting point of the resin to melt it. Next, 40 parts of 50% by weight ethyl acetate solution of [Non-crystalline polyester C-1], 60 parts of [Releasing agent liquid dispersion 1], and 12 parts of [Master batch 1] were added thereto. Thereafter, the solution was stirred at 50° C. at 5,000 rpm by using a TK HOMOMIXER (manufactured by Primix Corporation) to obtain [Oil phase 8]. [Oil phase 8] was maintained at 50° C. in the container not to be crystallized and used within five hours of preparation.

Preparation of [Aqueous Liquid Dispersion of Vinyl Resin]

600 parts of water, 120 parts of styrene, 100 parts of methacrylic acid, 45 parts of butyl acrylate, 10 parts of a sodium salt of alkyl aryl sulfosuccinic acid (ELEMINOL JS-2, manufactured by Sanyo Chemical Industries, Ltd.), and 1 part of ammonium persulfate were placed in a reaction container equipped with a stirrer and a thermometer followed by stirring at 400 rpm for 20 minutes. Next, the system was heated to 75° C. and reacted for 6 hours. Furthermore, 30 parts of 1 weight % aqueous solution of ammonium persulfate was added and the system was aged at 75° C. for 6 hours to obtain a aqueous liquid dispersion of vinyl resin. The vinyl resin had a volume average particle diameter of 80 nm, a weight average molecular weight of 160,000, and a glass transition temperature of 74° C.

Preparation of Aqueous Phase 990 parts of deionized water, 83 parts of the aqueous liquid dispersion of vinyl resin, 37 parts of 48.5% by weight aqueous solution of sodium dodecyldiphenyl etherdisulfonate (EREMINOR MON-7, manufactured by Sanyo Chemical Industries, Ltd.), and 90 parts of ethyl acetate were mixed and stirred to obtain an aqueous phase.

Manufacturing of [Toner 1]

25 parts of 50% by weight ethyl acetate of [Crystalline polyester prepolymer B-3] was added to [Oil phase 1] maintained at 50° C. followed by stirring at 5,000 rpm by a TK type HOMOMIXER (manufactured by Primix Corporation) to obtain [Oil phase 1'].

520 parts of the aqueous phase was placed in a container equipped with a stirrer and a thermometer followed by heating to 40° C. [Oil phase 1'] was added to 520 parts of the aqueous phase maintained at 40° C. to 50° C. while the aqueous phase was stirred at 13,000 rpm by a TK type HOMOMIXER (manufactured by PRIMIX Corporation) followed by one-minute emulsification to obtain an emulsified slurry.

The emulsified slurry was placed in a container equipped with a stirrer and a thermometer. Thereafter, the emulsified slurry was removed at 60° C. for six hours to obtain a slurry dispersion. After filtration of the thus-obtained slurry dispersion under a reduced pressure, the filtered cake was washed as follows:

(1): 100 parts of deionized water was added to the filtered cake followed by mixing by a TK HOMOMIXER (manufactured by PRIMIX Corporation) at 6,000 rpm for 5 minutes) and filtration;

(2): 100 parts of 10% by weight sodium hydroxide aqueous solution was added to the filtered cake followed by mixing by a TK HOMOMIXER (manufactured by PRIMIX Corporation) at 6,000 rpm for 10 minutes and filtration under a reduced pressure;

(3): 100 parts of 10% by weight hydrochloric acid was added to the filtered cake followed by mixing by a TK HOMOMIXER (manufactured by PRIMIX Corporation) at 6,000 rpm for 5 minutes and filtration; and (4): 300 parts of deionized water was added to the filtered cake followed by mixing by a TK HOMOMIXER (manufactured by PRIMIX Corporation) at 6,000 rpm for 5 minutes and filtration twice.

The obtained filtered cake was dried by a circulation drier at 45° C. for 48 hours. The dried cake was sieved by using a screen having an opening size of 75 μm to obtain mother particles.

100 parts of the mother particles and 1.0 part of hydrophobic silica (HDK-2000, manufactured by WACKER-CHEMIE AG) were mixed by a HENSCEL MIXER (manufactured by NIPPON COKE & ENGINEERING CO., LTD.) at a peripheral speed of 30 m/s for 30 seconds followed by one-minute break. This cycle was repeated five times and the mixture was screened by a mesh having an opening size of 35 μm to manufacture [Toner 1].

Manufacturing of [Toner 2]

[Toner 2] was prepared in the same manner as [Toner 1] except that [Oil phase 2] was used instead of [Oil phase 1] and the addition amount of ethyl acetate solution of [Crystalline polyester prepolymer B-3] was changed to 35 parts.

Manufacturing of [Toner 3]

[Toner 3] was prepared in the same manner as [Toner 1] except that [Oil phase 3] was used instead of [Oil phase 1] and the addition amount of ethyl acetate solution of [Crystalline polyester prepolymer B-3] was changed to 48 parts.

Manufacturing of Toner 4

[Toner 4] was prepared in the same manner as [Toner 1] except that [Oil phase 4] was used instead of [Oil phase 1] and the addition amount of ethyl acetate solution of [Crystalline polyester prepolymer B-3] was changed to 40 parts.

Manufacturing of Toner 5

60 parts of [Urethane-modified crystalline polyester A-1], 20 parts of [Urethane-modified crystalline polyester B-1], 20 parts of [Non-crystalline polyester C-1], 5 parts of paraffin wax (HNP-9, manufactured by NIPPON SEIRO CO., LTD), and 12 parts of [Master batch 1] were preliminarily mixed by a HENSCHEL MIXER (FM10B, manufactured by NIPPON COKE & ENGINEERING CO., LTD.) followed by melt-kneading at 80° C. to 120° C. by a twin shaft kneader (PCM-30, manufactured by Ikegai Corp.). The kneaded matters were cooled down to room temperature and thereafter coarsely-pulverized by a hammer mill to obtain particles having a particle diameter of from 200 μm to 300 μm. Next, the particles were finely-pulverized by a supersonic jet mill (Labo-jet, manufactured by NIPPON PNEUMATIC MFG. Co., LTD.) in order to obtain particles having a weight average particle diameter of from 5.9 μm to 6.5 μm while adjusting the pulverization air pressure. Thereafter, the resultant was classified by an air current classifier (MDS-1, manufactured by NIPPON PNEUMATIC MFG. Co., LTD.) in order that the weight average particle diameter became from 6.8 μm to 7.2 μm and the amount of fine powder having a weight average particle diameter of 4 μm or less was 10% by number or less while adjusting the louver opening to obtain mother particles.

100 parts of the mother particles and 1.0 part of hydrophobic silica (HDK-2000, manufactured by WACKER-CHEMIE AG) were mixed by a HENSCEL MIXER (manufactured by NIPPON COKE & ENGINEERING CO., LTD.) at a peripheral speed of 30 m/s for 30 seconds followed by one-minute break. This cycle was repeated five times and the mixture was screened by a mesh having an opening size of 35 μm to manufacture [Toner 5].

Manufacturing of [Toner 6]

[Toner 6] was prepared in the same manner as [Toner 1] except that [Oil phase 5] was used instead of [Oil phase 1] and the addition amount of ethyl acetate solution of [Crystalline polyester prepolymer B-3] was changed to 0 parts.

Manufacturing of Toner 7

[Toner 7] was prepared in the same manner as [Toner 1] except that [Oil phase 6] was used instead of [Oil phase 1] and the addition amount of ethyl acetate solution of [Crystalline polyester prepolymer B-3] was changed to 40 parts.

Manufacturing of Toner 8

[Toner 8] was prepared in the same manner as [Toner 1] except that [Oil phase 7] was used instead of [Oil phase 1] and the addition amount of ethyl acetate solution of [Crystalline polyester prepolymer B-3] was changed to 0 parts.

Manufacturing of Toner 9

[Toner 9] was prepared in the same manner as [Toner 1] except that [Oil phase 8] was used instead of [Oil phase 1] and the addition amount of ethyl acetate solution of [Crystalline polyester prepolymer B-3] was changed to 0 parts.

Table 1 shows properties of [Toner 1] to [Toner 9].

TABLE 1

| | S(120)/S(23) | Amount of Nitrogen element (% by weight) | Presence of Urea bond | Crystallinity (%) |
|---|---|---|---|---|
| Toner 1 | 1.55 | 0.43 | Yes | 15 |
| Toner 2 | 1.20 | 0.62 | Yes | 21 |
| Toner 3 | 1.15 | 0.73 | Yes | 25 |
| Toner 4 | 1.45 | 0.62 | Yes | 25 |
| Toner 5 | 1.35 | 0.60 | No | 27 |

TABLE 1-continued

| | S(120)/S(23) | Amount of Nitrogen element (% by weight) | Presence of Urea bond | Crystallinity (%) |
|---|---|---|---|---|
| Toner 6 | 1.47 | 2.45 | Yes | 18 |
| Toner 7 | 1.12 | 0.00 | No | 39 |
| Toner 8 | 1.75 | 8.99 | Yes | 13 |
| Toner 9 | 1.72 | 0.62 | No | 24 |

S(120)/S(23)

The projected area S(23) of a single particle on a recording medium at 23° C. and the projected area S(120) of a single particle on a recording medium at 120° C. were measured as follows and the ratio of S(120)/S(23) was calculated. A development agent was placed on a mesh and sprayed on POD gloss coat 128 (manufactured by Oji Paper Co., Ltd.) by air in order that toner was attached onto the POD gloss coat 128 by particle by particle. Next, after cutting out a square 10 mm×10 mm from the portion of the POD gloss coat 128 on which toner was attached, the square was placed on a heating plate. Thereafter, the heating plate was heated at a temperature rising speed of 10° C./min. A still image thereof was taken being observed by an optical microscope. Then, from the still image, the projected area of a single particle was measured by using an image analysis software to calculate the ratio of S(120)/S(23). S(120)/S(23) was the average of 50 particles.

Amount of Nitrogen Element 5 g of toner was put in a Soxhlet extractor followed by extraction by 70 mL of tetrahydrofuran for 20 hours. Thereafter, tetrahydrofuran was removed by heating with a reduced pressure to obtain a component soluble in tetrahydrofuran.

CHN of the component soluble in tetrahydrofuran was measured simultaneously by vario MICROcube (manufactured by Elementar Analysensysteme GmbH) at a temperature of the burning furnace of 950° C., a temperature of the reducing furnace of 550° C., a flow rate of helium of 200 mL/min., and a flow rate of oxygen of from 25 mL/min. to 35 mL/min. This was conducted twice and the average thereof was defined as the amount of nitrogen element.

When the amount of the nitrogen element was too low, for example, 0.5% by weight, the amount of nitrogen element was further measured by a minute amount of nitrogen analyzer (model ND-100, Mitsubishi Chemical Corporation). The conditions were: Electric furnace temperature (horizontal reactor). Pyrolysis part: 800° C.; Catalytic portion: 900° C.; Oxygen flow rate: 300 mL/min.; Argon flow rate: 400 mL/min.; Sensitivity: Low. The component was quantified based on standard curve made by pyridine standard liquid.

Presence of Urea Bond 5 g of toner was put in a Soxhlet extractor followed by extraction by 70 mL of tetrahydrofuran for 20 hours. Thereafter, tetrahydrofuran was removed by heating with a reduced pressure to obtain a component soluble in tetrahydrofuran.

2 g of the component soluble in tetrahydrofuran was dipped in 200 mL of methanol solution of 0.1 mol/L potassium hydroxide at 50° C. for 24 hours. Thereafter, the residual was washed in deionized water until pH indicated neutral followed by drying. The thus-obtained dried matter was added to a liquid mixture of dimethyl acetoamide (DMAc) and deuterated dimethyl sulfoxide (DMSO-d6) with a volume ratio of 9:1 in order that the concentration was 100 mg/0.5 mL and dissolved at 70° C. for 12 hours to 24 hours.

Next, the solution was cooled down to 50° C. to measure $^{13}$CNMR. The measuring frequency was set to 125.77 MHz and 1H_60° pulse was 5.5 μs. The reference material was tetramethyl silane (TMS).

Crystallinity

X-ray diffraction spectra of toner were measured by using a two dimension detector installed X-ray diffraction instrument (D8-DISCOVER with GADDS, manufactured by Bruker Corporation).

For the measuring, a capillary tube, which was a mark tube (Lindemann glass) having a diameter of 0.70 mm was filled with toner up to its upper portion. When the tube was filled up with the toner, the tube was tapped ten times.

The measuring conditions were specified below:

Tube current: 40 mA

Voltage: 40 kV

Goniometer 2θ axis: 20.0000°

Goniometer Ω axis: 0.0000°

Goniometer ϕ axis: 0.0000°

Detector distance: 15 cm (wide angle measuring)

Measuring range: 3.2≤2θ (°)≤37.2

Measuring time: 600 sec.

A collimator having a 1 mm ϕ pinhole was used as the incident light optical system. The obtained two-dimensional data were integrated (χ axis: 3.2° to 37.2)° and converted by an installed software to a single-dimensional data of the diffraction intensity and 20.

Manufacturing of [Toner 10] to [Toner 27]

Synthesis of [Ketimine 1]

170 parts of isophoronediamine and 75 parts of methyl ethyl ketone were placed in a reaction container equipped with a stirrer and a thermometer to conduct reaction at 50° C. for 5 hours to obtain [Ketimine 1]. [Ketimine 1] had an amine value of 418 mgKOH/g.

Synthesis of [Non-Linear Non-Crystalline Polyester D-1]

3-methyl-1,5-pentane diol, isophthalic acid, adipic acid, and trimethylol propane were placed in a reaction container equipped with a condenser, a stirrer, and a nitrogen-introducing tube in such a manner that the molar ratio ([OH]/[COOH]) of a hydroxy group to a carboxylic group was 1.1. Dicarboxylic acid was formed of 45% by mol of isophthalic acid and 55 mol % of adipic acid. Trimethylol propane was set to be 1.5% by mol to the total of monomers. 1,000 ppm of titanium tetraisopropoxide was added to all of the monomers. Next, the system was heated to 200° C. in about four hours and to 230° C. in two hours and reacted until effluent water became nil.

Furthermore, the reaction was continued with a reduced pressure of from 10 mmHg to 15 mmHG for five hours to obtain a polyester having a hydroxy group.

The thus-obtained polyester having a hydroxy group and isophorone diisocyanate (IPDI) were placed in a reaction container equipped with a condenser, a stirrer, and a nitrogen introducing tube in such a manner that the molar ratio ([NCO]/[OH]) of an isocyanate group to a hydroxy group was 2.0. Subsequent to dilution by ethyl acetate, the reaction was conducted at 100° C. for five hours to obtain 50% by weight ethyl acetate solution of a polyester prepolymer having an isocyanate group.

The-thus-obtained 0% by weight ethyl acetate solution of a polyester prepolymer having an isocyanate group was stirred in a reaction container equipped with a heating device, a stirrer, and a nitrogen introducing tube. [Ketimine 1] was dripped thereto in such a manner that the molar ratio ([NCO]/[$NH_2$]) of an amino group to an isocyanate group was 1.0. Next, the solution was stirred at 45° C. for ten hours. Thereafter, the solution was dried with a reduced pressure until the content of ethyl acetate was 100 ppm or less to obtain [Non-linear non-crystalline polyester D-1]. [Non-linear non-crystalline polyester D-1] had a weight average molecular weight of 164,000 and a glass transition temperature of −40° C.

Synthesis of [Non-Linear Non-Crystalline Polyester D-2]

3-methyl-1,5-pentane diol, adipic acid, and trimethylol propane were placed in a reaction container equipped with a condenser, a stirrer, and a nitrogen-introducing tube in such a manner that the molar ratio ([OH]/[COOH]) of a hydroxy group to a carboxylic group was 1.1. Trimethylol propane was set to be 1.5% by mol to the total of monomers. 1,000 ppm of titanium tetraisopropoxide was added to all of the monomers. Next, the system was heated to 200° C. in about four hours and to 230° C. in two hours and reacted until effluent water became nil. Furthermore, the reaction was continued with a reduced pressure of from 10 mmHg to 15 mmHG for five hours to obtain a polyester having a hydroxy group.

[Non-linear non-crystalline polyester D-2] was prepared in the same manner as [Non-linear non-crystalline polyester D-1] except that the thus-obtained polyester having a hydroxy group was used. [Non-linear non-crystalline polyester D-2] had a weight average molecular weight of 175,000 and a glass transition temperature of −55° C.

Synthesis of [Non-Linear Non-Crystalline Polyester D-3]

An adduct of bisphenol A with 2 mols of ethylene oxide, bisphenol A with 2 mols of propylene oxide, terephtaric acid, and trimellitic anhydride were placed in a reaction container equipped with a condenser, a stirrer, and a nitrogen-introducing tube in such a manner that the molar ratio ([OH]/[COOH]) of a hydroxy group to a carboxylic group was 1.3. Diol was formed of 90% by mol of bisphenol A with 2 mols of ethylene oxide and 10% by mol of bisphenol A with 2 mols of propylene oxide. Polycarboxylic acid was formed of 90% by mol of terephtaric acid and 10% by mol of trimellitic anhydride. 1,000 ppm of titanium tetraisopropoxide was added to all of the monomers. Next, the system was heated to 200° C. in about four hours and to 230° C. in two hours and reacted until effluent water became nil. Furthermore, the reaction was continued with a reduced pressure of from 10 mmHg to 15 mmHG for five hours to obtain a polyester having a hydroxy group.

[Non-linear non-crystalline polyester D-3] was prepared in the same manner as [Non-linear non-crystalline polyester D-1] except that the thus-obtained polyester having a hydroxy group was used. [Non-linear non-crystalline polyester D-3] had a weight average molecular weight of 130,000 and a glass transition temperature of 54° C.

Synthesis of [Non-Linear Non-Crystalline Polyester D-4]

1,2-propylene glycol, terephthalic acd, adipic acid, and trilmellitic anhydride were placed in a reaction container equipped with a condenser, a stirrer, and a nitrogen-introducing tube in such a manner that the molar ratio ([OH]/[COOH]) of a hydroxy group to a carboxylic group was 1.3. Dicarboxylic acid was formed of 80% by mol of terephthalic acid and 20% by mol of adipic acid. Trilmellitic anhydride was set to be 2.5% by mol to the total of monomers. 1,000 ppm of titanium tetraisopropoxide was added to all of the monomers. Next, the system was heated to 200° C. in about four hours and to 230° C. in two hours and reacted until effluent water became nil. Furthermore, the reaction was continued with a reduced pressure of from 10 mmHg to 15 mmHG for five hours to obtain a polyester having a hydroxy group.

[Non-linear non-crystalline polyester D-4] was prepared in the same manner as [Non-linear non-crystalline polyester D-1] except that the thus-obtained polyester having a hydroxy group was used. [Non-linear non-crystalline polyester D-4] had a weight average molecular weight of 140,000 and a glass transition temperature of 56° C.

Synthesis of [Non-Linear Non-Crystalline Polyester D-5]

3-methyl-1,5-pentane diol, isophthalic acid, adipic acid, and trilmellitic anhydride were placed in a reaction container equipped with a condenser, a stirrer, and a nitrogen-introducing tube in such a manner that the molar ratio ([OH]/[COOH]) of a hydroxy group to a carboxylic group was 1.5. Dicarboxylic acid was formed of 40% by mol of isophthalic acid and 60% by mol of adipic acid. Trilmellitic anhydride was set to be 1% by mol to the total of monomers. 1,000 ppm of titanium tetraisopropoxide was added to all of the monomers. Next, the system was heated to 200° C. in about four hours and to 230° C. in two hours and reacted until effluent water became nil. Furthermore, the reaction was continued with a reduced pressure of from 10 mmHg to 15 mmHG for five hours to obtain a polyester having a hydroxy group.

[Non-linear non-crystalline polyester D-5] was prepared in the same manner as [Non-linear non-crystalline polyester D-1] except that the thus-obtained polyester having a hydroxy group was used. [Non-linear non-crystalline polyester D-5] had a weight average molecular weight of 150,000 and a glass transition temperature of −35° C.

Synthesis of [Linear Non-Crystalline Polyester E-1]

An adduct of bisphenol A with 2 mols of ethylene oxide, bisphenol A with 2 mols of propylene oxide, terephtaric acid, and adipic acid were placed in a reaction container equipped with a thermocouple, a stirrer, a dewatering tube, and a nitrogen-introducing tube in such a manner that the molar ratio ([OH]/[COOH]) of a hydroxy group to a carboxylic group was 1.3. Diol was formed of 60% by mol of bisphenol A with 2 mols of ethylene oxide and 40% by mol of bisphenol A with 3 mols of propylene oxide. Dicarboxylic acid was formed of 93% by mol of terephtaric acid and 7% by mol of adipic acid. 500 ppm of titanium tetraisopropoxide was added to the total of monomers. Next, reaction was conducted at 230° C. for eight hours and continued with a reduced pressure of from 10 mmHg to 15 mmHG for four hours. Furthermore, trilmellitic anhydride was added to be 1% by mol to the total of monomers followed by three hour reaction at 180° C. to obtain [Linear non-crystalline polyester E-1].

[Linear non-crystalline polyester E-1] had a weight average molecular weight of 5,300 and a glass transition temperature of 67° C.

Synthesis of [Linear Non-Crystalline Polyester E-2]

An adduct of bisphenol A with 2 mols of propylene oxide, 1,3-propylene glycol, terephtaric acid, and adipic acid were placed in a reaction container equipped with a thermocouple, a stirrer, a dewatering tube, and a nitrogen-introducing tube in such a manner that the molar ratio ([OH]/[COOH]) of a hydroxy group to a carboxylic group was 1.4. Diol was formed of 90% by mol of bisphenol A with 2 mols of ethylene oxide and 10% by mol of 1,3-propylene glycol. Dicarboxylic acid was formed of 80% by mol of terephtaric acid and 20% by mol of adipic acid. 500 ppm of titanium tetraisopropoxide was added to all of the monomers. Next, reaction was conducted at 230° C. for eight hours and continued with a reduced pressure of from 10 mmHg to 15 mmHG for four hours. Furthermore, trilmellitic anhydride was added to be 1% by mol to the total of monomers followed by three hour reaction at 180° C. to obtain [Linear non-crystalline polyester E-2]. [Linear non-crystalline polyester E-2] had a weight average molecular weight of 5,600 and a glass transition temperature of 61° C.

Synthesis of [Linear Non-Crystalline Polyester E-3]

An adduct of bisphenol A with 2 mols of ethylene oxide, bisphenol A with 2 mols of propylene oxide, isophtaric acid, and adipic acid were placed in a reaction container equipped with a thermocouple, a stirrer, a dewatering tube, and a nitrogen-introducing tube in such a manner that the molar ratio ([0H]/[COOH]) of a hydroxy group to a carboxylic group was 1.2. Diol was formed of 80% by mol of bisphenol A with 2 mols of ethylene oxide and 20% by mol of bisphenol A with 2 mols of propylene oxide. Dicarboxylic acid was formed of 80% by mol of isophtaric acid and 20% by mol of adipic acid. 500 ppm of titanium tetraisopropoxide was added to all of the monomers. Next, reaction was conducted at 230° C. for eight hours and continued with a reduced pressure of from 10 mmHg to 15 mmHG for four hours. Furthermore, trilmellitic anhydride was added to be 1% by mol to the total of monomers followed by three hour reaction at 180° C. to obtain [Linear non-crystalline polyester E-3]. [Linear non-crystalline polyester E-3] had a weight average molecular weight of 5,500 and a glass transition temperature of 50° C.

Synthesis of [Linear Non-Crystalline Polyester E-4]

An adduct of bisphenol A with 2 mols of ethylene oxide, bisphenol A with 3 mols of propylene oxide, isophtaric acid, and adipic acid were placed in a reaction container equipped with a thermocouple, a stirrer, a dewatering tube, and a nitrogen-introducing tube in such a manner that the molar ratio ([OH]/[COON]) of a hydroxy group to a carboxylic group was 1.3. Diol was formed of 85% by mol of bisphenol A with 2 mols of ethylene oxide and 15% by mol of bisphenol A with 3 mols of propylene oxide. Dicarboxylic acid was formed of 80% by mol of isophtaric acid and 20% by mol of adipic acid. 500 ppm of titanium tetraisopropoxide was added to all of the monomers. Next, reaction was conducted at 230° C. for eight hours and continued with a reduced pressure of from 10 mmHg to 15 mmHG for four hours. Furthermore, trilmellitic anhydride was added to be 1% by mol to the total of monomers followed by three hour reaction at 180° C. to obtain [Linear non-crystalline polyester E-4]. [Linear non-crystalline polyester E-4] had a weight average molecular weight of 5,000 and a glass transition temperature of 48° C.

Synthesis of [Linear Non-Crystalline Polyester E-5]

An adduct of bisphenol A with 2 mols of ethylene oxide, bisphenol A with 3 mols of propylene oxide, terephtaric acid, and adipic acid were placed in a reaction container equipped with a thermocouple, a stirrer, a dewatering tube, and a nitrogen-introducing tube in such a manner that the molar ratio ([OH]/[COOH]) of a hydroxy group to a carboxylic group was 1.3. Diol was formed of 85% by mol of bisphenol A with 2 mols of ethylene oxide and 15% by mol of bisphenol A with 3 mols of propylene oxide. Dicarboxylic acid was formed of 80% by mol of terephtaric acid and 20% by mol of adipic acid. 500 ppm of titanium tetraisopropoxide was added to all of the monomers. Next, reaction was conducted at 230° C. for eight hours and continued with a reduced pressure of from 10 mmHg to 15 mmHG for four hours. Furthermore, trilmellitic anhydride was added to be 1% by mol to the total of monomers followed by three hour reaction at 180° C. to obtain [Linear non-crystalline polyester E-5]. [Linear non-crystalline polyester E-5] had a weight average molecular weight of 5,000 and a glass transition temperature of 51° C.

Synthesis of [Crystalline Polyester F-1]

Sebacic acid and 1,6-hexane diol were placed in a reaction container equipped with a thermocouple, a stirrer, a dewatering tube in such a manner that the molar ratio ([OH]/[COOH]) of a hydroxy group to a carboxylic group was 0.9. 500 ppm of titanium tetraisopropoxide was added to the total of monomers and thereafter reaction was conducted at 180° C. for ten hours. Next, the system was heated to 200° C. followed by three hour reaction. Reaction was conducted for two hours with a reduced pressure of 8.3 kPa to obtain [Crystalline polyester F-1]. [Crystalline polyester F-1] had a weight average molecular weight of 25,000 and a melting point of 67° C.

Manufacturing of [Toner 10]

Preparation of Master Batch 1,200 parts of water, 500 parts of carbon black (Printex 35, manufactured by Evonik Degussa GmbH) having an DBP oil absorption amount of 42 mL/100 g and a pH of 9.5, and 500 parts of a non-linear [Linear non-crystalline polyester E-1] were mixed by a HENSCHEL MIXER (manufactured by NIPPON COKE & ENGINEERING CO., LTD.) followed by kneading at 150° C. for 30 minutes by twin rolls. Next, subsequent to rolling and cooling down, the resultant was pulverized by a pulverizer to obtain a master batch.

Preparation of Liquid Dispersion of Releasing Agent 50 parts of paraffin wax (HNP-9, manufactured by NIPPON SEIRO CO., LTD.) having a melting point of 75° C. and 450 parts of ethyl acetate were placed in a container equipped with a stirrer and a thermometer followed by heating to 80° C., which was maintained for five hours. The resultant was cooled down to 30° C. in one hour followed by dispersion under the condition of liquid transfer speed of 1 kg/hour, disc circumference speed of 6 m/sec, 80 volume % filling of 0.5 mm zirconia beads, and 3 pass using a beads mill (ULTRAVISCOMILL, manufactured by Aimex Co., Ltd.) to obtain a liquid dispersion of releasing agent.

Preparation of Liquid Dispersion of Crystalline Polyester 50 parts of [Crystalline polyester F-1] and 450 parts of ethyl acetate were placed in a container equipped with a stirrer and a thermometer followed by heating to 80° C., which was maintained for five hours. The resultant was cooled down to 30° C. in one hour followed by dispersion under the condition of liquid transfer speed of 1 kg/hour, disc circumference speed of 6 m/sec, 80 volume % filling of 0.5 mm zirconia beads, and 3 pass using a beads mill (ULTRAVISCOMILL, manufactured by Aimex Co., Ltd.) to obtain a liquid dispersion of crystalline polyester.

Preparation of Oil Phase 50 parts of the liquid dispersion of releasing agent, 150 parts of [Non-linear non-crystalline polyester D-1], 500 parts of the liquid dispersion of crystalline polyester, 750 parts of [Linear non-crystalline polyester E-1], 50 arts of the master batch, and 2 parts of [Ketimine 1] were placed in a container followed by mixing by a TK HOMOMIXER (manufactured by Primix Corporation) to obtain an oil phase.

Preparation of Aqueous Liquid Dispersion of Vinyl Resin

The following recipe was placed in a container equipped with a stirrer and a thermometer and thereafter stirred at 400 rpm for 15 minutes:

| | |
|---|---|
| Water: | 683 parts |
| Sodium salt of sulfate of an adduct of methacrylic acid with ethyleneoxide (EREMINOR RS-30, manufactured by Sanyo Chemical Industries, Ltd.): | 11 parts |
| Styrene: | 138 parts |
| Methacrylic acid: | 138 parts |
| Ammonium persulfate: | 1 part |

Furthermore, after the system was heated to 75° C. followed by five hour reaction, 30 parts of 1% by weight aqueous solution of ammonium persulfate was added. Thereafter the system was aged at 75° C. for five hours to obtain an aqueous liquid dispersion of vinyl resin.

The volume average particle diameter of the aqueous liquid dispersion of vinyl resin was 0.14 μm (measure by a laser diffraction/scattering particle size distribution measuring instrument LA-920, manufactured by HORIBA Ltd.).

Preparation of Aqueous Phase 990 parts of deionized water, 83 parts of the aqueous liquid dispersion of vinyl resin, 37 parts of 48.5% by weight aqueous solution of sodium dodecyldiphenyl etherdisulfonate (EREMINOR MON-7, manufactured by Sanyo Chemical Industries, Ltd.), and 90 parts of ethyl acetate were mixed and stirred to obtain an aqueous phase.

Emulsification•Removal of Solvent 1,200 parts of the aqueous phase was added to a container that accommodated 1,052 parts of the oil phase followed by mixing by a TK HOMOMIXER at 13,000 rpm for 20 minutes to obtain an emulsified slurry.

The emulsified slurry was placed in a container equipped with a stirrer and a thermometer followed by removal of the solvent at 30° C. for 8 hours. Subsequent to a 4 hour aging at 45° C., a slurry dispersion was obtained.

Washing and Drying

After 100 parts of the slurry dispersion was filtered with a reduced pressure to obtain a filtered cake. The operations (1) to (4) were repeated twice for the obtained filtered cake.

(1): 100 parts of deionized water was added to the filtered cake followed by mixing by a TK HOMOMIXER (manufactured by PRIMIX Corporation) at 12,000 rpm for 10 minutes and filtration;

(2): 100 parts of 10% by weight sodium hydroxide aqueous solution was added to the filtered cake of (1) followed by mixing by a TK HOMOMIXER (manufactured by PRIMIX Corporation) at 12,000 rpm for 30 minutes and filtration under a reduced pressure;

(3): 100 parts of 10% by weight hydrochloric acid was added to the filtered cake of (2) followed by mixing by a TK HOMOMIXER (manufactured by PRIMIX Corporation) at 12,000 rpm for 10 minutes and filtration; and (4): 300 parts of deionized water was added to the filtered cake of (3) followed by mixing by a TK HOMOMIXER (manufactured by PRIMIX Corporation) at 12,000 rpm for 10 minutes and filtration.

The thus-obtained filtered cake was dried by a circulation drier at 45° C. for 48 hours. The dried cake was screened by using a screen having an opening size of 75 μm to obtain mother particles.

100 parts of the mother particles and 1.0 part of hydrophobic silica (HDK-2000, manufactured by WACKER-CHEMIE AG) were mixed by a HENSCEL MIXER (manufactured by NIPPON COKE & ENGINEERING CO., LTD.) at a peripheral speed of 30 m/s for 30 seconds followed by one-minute break. This cycle was repeated five times and the mixture was screened by a mesh having an opening size of 35 μm to manufacture [Toner 10].

Manufacturing of [Toner 11]

[Toner 11] was manufactured in the same manner as [Toner 10] except that the addition amount of the [Non-linear non-crystalline polyester D-1] and [Linear non-crystalline polyester E-1] in the preparation of oil phase were changed to 120 parts and 780 parts, respectively.

Manufacturing of [Toner 12]

[Toner 12] was manufactured in the same manner as [Toner 10] except that the addition amount of the [Non-linear non-crystalline polyester D-1] and [Linear non-crystalline polyester E-1] in the preparation of oil phase were changed to 180 parts and 720 parts, respectively.

Manufacturing of [Toner 13]

[Toner 13] was manufactured in the same manner as [Toner 10] except that [Non-linear non-crystalline polyester D-2] and [Linear non-crystalline polyester E-3] were used instead of [Non-linear non-crystalline polyester D-1] and [Linear non-crystalline polyester E-1], respectively.

Manufacturing of [Toner 14]

[Toner 14] was manufactured in the same manner as [Toner 10] except that the addition amount of the [Non-linear non-crystalline polyester D-1], [Linear non-crystalline polyester E-1], and the liquid dispersion of crystalline polyester in the preparation of oil phase were changed to 120 parts, 820 parts, and 100 parts, respectively.

Manufacturing of [Toner 15]

[Toner 15] was manufactured in the same manner as [Toner 10] except that the addition amount of the [Non-linear non-crystalline polyester D-1], [Linear non-crystalline polyester E-1], and the liquid dispersion of crystalline polyester in the preparation of oil phase were changed to 180 parts, 750 parts, and 200 parts, respectively.

Manufacturing of [Toner 16]

[Toner 16] was manufactured in the same manner as [Toner 12] except that [Non-linear non-crystalline polyester D-2] and [Linear non-crystalline polyester E-3] were used instead of [Non-linear non-crystalline polyester D-1] and [Linear non-crystalline polyester E-1], respectively.

Manufacturing of [Toner 17]

[Toner 17] was manufactured in the same manner as [Toner 11] except that [Linear non-crystalline polyester E-2] was used instead of [Linear non-crystalline polyester E-1].

Manufacturing of [Toner 18]

[Toner 18] was manufactured in the same manner as [Toner 10] except that [Non-linear non-crystalline polyester D-2] was used instead of [Non-linear non-crystalline polyester D-1].

Manufacturing of [Toner 19]

[Toner 19] was manufactured in the same manner as [Toner 10] except that [Linear non-crystalline polyester E-2] was used instead of [Linear non-crystalline polyester E-1].

Manufacturing of [Toner 20]

[Toner 20] was manufactured in the same manner as [Toner 10] except that the addition amount of the [Non-linear non-crystalline polyester D-1], [Linear non-crystalline polyester E-1], and the liquid dispersion of crystalline polyester in the preparation of oil phase were changed to 125 parts, 825 parts, and 0 parts, respectively.

Manufacturing of [Toner 21]

[Toner 21] was manufactured in the same manner as [Toner 16] except that the addition amount of the [Non-linear non-crystalline polyester D-2] and [Linear non-crystalline polyester E-3] in the preparation of oil phase were changed to 200 parts and 700 parts, respectively.

Manufacturing of [Toner 22]

[Toner 22] was manufactured in the same manner as [Toner 10] except that [Non-linear non-crystalline polyester D-4] and [Linear non-crystalline polyester E-3] were used instead of [Non-linear non-crystalline polyester D-1] and [Linear non-crystalline polyester E-1], respectively.

Manufacturing of [Toner 23]

[Toner 23] was manufactured in the same manner as [Toner 12] except that [Non-linear non-crystalline polyester D-5] and [Linear non-crystalline polyester E-5] were used instead of [Non-linear non-crystalline polyester D-1] and [Linear non-crystalline polyester E-1], respectively.

Manufacturing of [Toner 24]

[Toner 24] was manufactured in the same manner as [Toner 22] except that the addition amount of the liquid dispersion of crystalline polyester in the preparation of oil phase was changed to 0 parts.

Manufacturing of [Toner 25]

[Toner 25] was manufactured in the same manner as [Toner 12] except that [Non-linear non-crystalline polyester D-5] and [Linear non-crystalline polyester E-4] were used instead of [Non-linear non-crystalline polyester D-1] and [Linear non-crystalline polyester E-1], respectively.

Manufacturing of [Toner 26]

[Toner 26] was manufactured in the same manner as [Toner 10] except that [Non-linear non-crystalline polyester D-3] and [Linear non-crystalline polyester E-2] were used instead of [Non-linear non-crystalline polyester D-1] and [Linear non-crystalline polyester E-1], respectively.

Manufacturing of [Toner 27]

[Toner 27] was manufactured in the same manner as [Toner 10] except that the addition amount of the [Non-linear non-crystalline polyester D-1] and [Linear non-crystalline polyester E-1] in the preparation of oil phase were changed to 80 parts and 820 parts, respectively.

Table 2 shows properties of [Toner 10] to [Toner 27].

TABLE 2

| | S(120)/S(23) | Tg1st (° C.) | T1 (° C.) at which G' is $3.0 \times 10^4$ Pa | T2 (° C.) at which G' is $1.0 \times 10^4$ Pa | T2 − T1 (° C.) |
|---|---|---|---|---|---|
| Toner 10 | 1.48 | 43 | 83 | 107 | 24 |
| Toner 11 | 1.57 | 45 | 90 | 111 | 21 |
| Toner 12 | 1.26 | 41 | 85 | 114 | 29 |
| Toner 13 | 1.41 | 35 | 82 | 110 | 28 |
| Toner 14 | 1.48 | 45 | 95 | 117 | 22 |
| Toner 15 | 1.17 | 42 | 93 | 119 | 26 |
| Toner 16 | 1.26 | 40 | 92 | 118 | 26 |
| Toner 17 | 1.32 | 44 | 93 | 118 | 25 |
| Toner 18 | 1.47 | 38 | 85 | 109 | 24 |
| Toner 19 | 1.38 | 41 | 87 | 112 | 25 |
| Toner 20 | 1.42 | 48 | 98 | 120 | 21 |
| Toner 21 | 1.20 | 31 | 80 | 113 | 32 |
| Toner 22 | 1.19 | 47 | 99 | 120 | 22 |
| Toner 23 | 1.60 | 29 | 80 | 98 | 18 |
| Toner 24 | 1.02 | 52 | 103 | 127 | 24 |
| Toner 25 | 1.63 | 28 | 78 | 97 | 19 |
| Toner 26 | 1.76 | 53 | 105 | 114 | 9 |
| Toner 27 | 1.76 | 50 | 101 | 120 | 21 |

Properties of the component soluble and the component insoluble in THF of [Toner 10] to [Toner 27] are shown in Table 3.

TABLE 3

| | Component soluble in THF | Component insoluble in THF | | | | |
|---|---|---|---|---|---|---|
| | Tg2nd (° C.) | G'(100) (Pa) | G'(40) (Pa) | G'(100) (Pa)/G'(40) (Pa) | Content (% by weight) | Tg2nd (° C.) |
| Toner 10 | 30 | 5.00E+05 | 1.55E+07 | 3.10E+01 | 23 | 3 |
| Toner 11 | 33 | 3.20E+06 | 1.12E+08 | 3.50E+01 | 20 | 5 |
| Toner 12 | 28 | 3.80E+05 | 9.50E+06 | 2.50E+01 | 25 | 0 |
| Toner 13 | 26 | 3.90E+05 | 8.97E+06 | 2.30E+01 | 22 | −7 |
| Toner 14 | 35 | 4.80E+06 | 1.63E+08 | 3.40E+01 | 20 | 6 |
| Toner 15 | 46 | 7.00E+06 | 2.31E+08 | 3.30E+01 | 27 | −1 |
| Toner 16 | 27 | 2.80E+05 | 7.28E+06 | 2.60E+01 | 21 | −13 |
| Toner 17 | 32 | 3.00E+06 | 1.02E+08 | 3.40E+01 | 27 | 6 |
| Toner 18 | 28 | 4.80E+05 | 1.44E+07 | 3.00E+01 | 22 | −10 |
| Toner 19 | 29 | 5.20E+05 | 1.72E+07 | 3.30E+01 | 25 | 4 |
| Toner 20 | 35 | 6.80E+06 | 2.38E+08 | 3.50E+01 | 21 | 6 |
| Toner 21 | 22 | 4.00E+05 | 8.80E+06 | 2.20E+01 | 29 | −9 |
| Toner 22 | 40 | 7.00E+04 | 4.55E+06 | 6.50E+01 | 30 | 33 |
| Toner 23 | 35 | 9.00E+05 | 6.30E+09 | 7.00E+01 | 25 | −49 |
| Toner 24 | 45 | 8.00E+04 | 5.60E+06 | 7.00E+01 | 36 | 35 |
| Toner 25 | 33 | 7.50E+07 | 4.50E+09 | 6.00E+01 | 24 | −45 |
| Toner 26 | 42 | 8.50E+04 | 1.28E+07 | 1.50E+02 | 12 | 32 |
| Toner 27 | 68 | 4.50E+05 | 1.44E+07 | 3.20E+01 | 13 | −35 |

Separation of Component Soluble in THF from Component Insoluble in THF 1 g of toner was put in 100 mL of THF followed by stirring at 25° C. for 30 minutes. The resultant was filtered with a membrane filter having an opening size of 0.2 μm. The substance remaining on the filter was defined as the component insoluble in THF. The filtrate was dried to obtain the component soluble in THF.

Storage Elastic Modulus G'

The storage elastic modulus G' of the toner was measured by a dynamic viscoelasticity measuring device (ARES, manufactured by TA INSTRUMENT JAPAN INC.) as follows: A sample was molded to a pellet having a diameter of 8 mm and a thickness of 1 mm and fixed on a parallel plate having a diameter of 8 mm. Thereafter, the sample was stabilized at 40° C. and then heated to 200° C. at 2.0° C./min. with a frequency of 1 Hz (6.28 rad/s) and a distortion amount of 0.1% (Distortion amount control mode) to measure a temperature T1 at which the storage elastic modulus G' was $3.0 \times 10^4$ Pa, a temperature T2 at which the storage elastic modulus G' was $1.0 \times 10^4$ Pa, a storage elastic modulus G'(100) at 100° C., and a storage elastic modulus G'(140) at 140° C.

Glass Transition Temperature Tg1st and Tg2nd at First Time and Second Time Temperature Rising The melting point and the glass transition temperature were measured by using a differential scanning calorimeter Q-200 (manufactured by TA Instruments. Japan). Specifically, about 5.0 mg of a sample was placed in an aluminum sample container. Then, the sample container was placed on a holder unit and the container and the unit were set in an electric furnace. Thereafter, in a nitrogen atmosphere, the unit and the container were heated from −80° C. to 150° C. at a temperature rising speed of 10° C./min. (first time temperature rising). Thereafter, the sample was cooled down from 150° C. to −80° C. at a temperature falling speed of 10° C./min. Thereafter, the sample was heated from −80° C. to 150° C. at a temperature rising speed of 10° C./min. (second time temperature rising).

The glass transition temperature Tg1st was obtained from the DSC curve in the first time temperature rising using an analysis program installed on Q-200 system.

The glass transition temperature Tg2nd was obtained from the DSC curve in the second time temperature rising using the analysis program installed on Q-200 system.

The evaluation results of the high temperature stability of [Toner 1] to [Toner 27] are shown in Table 4.

TABLE 4

| | High temperature stability |
|---|---|
| Toner 1 | F |
| Toner 2 | E |
| Toner 3 | E |
| Toner 4 | E |
| Toner 5 | G |
| Toner 6 | F |
| Toner 7 | G |
| Toner 8 | F |
| Toner 9 | G |
| Toner 10 | E |
| Toner 11 | G |
| Toner 12 | G |
| Toner 13 | F |
| Toner 14 | E |
| Toner 15 | E |
| Toner 16 | G |
| Toner 17 | G |
| Toner 18 | E |
| Toner 19 | E |
| Toner 20 | E |
| Toner 21 | F |
| Toner 22 | E |
| Toner 23 | F |
| Toner 24 | E |
| Toner 25 | F |
| Toner 26 | E |
| Toner 27 | E |

High Temperature Stability

A glass container (50 mL) was filled with the toner and left in a constant bath at 50° C. for 24 hours. Subsequent to cooling-down to 24° C., the needle penetration level of the toner was measured by a needle penetration test (according to JIS K2235-1991) to evaluate the high temperature stability of the toner according to the following criteria: Penetration degree:

E (Excellent): 25 mm or greater

G (Good): 15 mm to less than 25 mm

F (Fair): 5 mm to less than 15 mm

B (Bad): less than 5 mm

Manufacturing of Carrier 100 parts of silicone resin (organo straight silicone), 5 parts of γ-(2-aminoethyl)aminopropyl trimethoxy silane, 10 parts of carbon black, and 100 part of toluene were dispersed by a HOMOMIXER for 20 minutes to prepare a liquid application of cover layer.

Using a fluid bed type coating device, the liquid application of cover layer was applied to the surface of 1,000 parts of spherical ferrite having a volume average particle diameter of 35 μm to obtain a toner carrier.

Manufacturing of Development Agent 5 parts of toner and 95 parts of a carrier were mixed to obtain a development agent.

Manufacturing of [Fixing Belt 1] to [Fixing Belt 5]

Manufacturing of [Fixing Belt 1]

Silicone primer resin (DY-39-051, manufactured by Dow Corning Toray Co., Ltd.) was applied to the surface of a polyimide substrate having a thickness of 35 μm and an outer diameter of 30 mm followed by drying to form a primary primer layer. Next, a heat resistant silicone resin (DX35-2083, manufactured by Dow Corning Toray Co., Ltd.) was applied to the surface of the primary primer layer followed by vulcanization to form an elastic layer having a thickness of 150 μm. In addition, PFA primer (manufactured by Du Pont-Mitsui Fluorochemicals Co., Ltd.) was applied to the surface of the elastic layer followed by drying to form a secondary primer layer. Next, PFA340-J (manufactured by Du Pont-Mitsui Fluorochemicals Co., Ltd.) was applied to the surface of the secondary primer layer followed by baking at 340° C. for 30 minutes to form a releasing layer having a thickness of 5 μm to manufacture [Fixing belt 1]. [Fixing Belt 1] had a Martens hardness of 0.2 N/mm$^2$.

Manufacturing of [Fixing Belt 2]

[Fixing belt 2] was manufactured in the same manner as [Fixing belt 1] except that a nickel substrate having a thickness of 35 μm and an outer diameter of 30 mm was used, the thickness of the elastic layer was changed to 100 μm, and the thickness of the releasing layer was changed to 10 μm. [Fixing Belt 2] had a Martens hardness of 0.4 N/mm$^2$.

Manufacturing of [Fixing Belt 3]

[Fixing belt 3] was manufactured in the same manner as [Fixing belt 2] except that the thickness of the releasing layer was changed to 15 μm. [Fixing Belt 3] had a Martens hardness of 0.9 N/mm$^2$.

Manufacturing of [Fixing Belt 4]

[Fixing belt 4] was manufactured in the same manner as [Fixing belt 1] except that a stainless copper substrate having a thickness of 35 μm and an outer diameter of 30 mm was used, the thickness of the elastic layer was changed to 100 μm, and the thickness of the releasing layer was changed to 20 μm. [Fixing Belt 4] had a Martens hardness of 1.3 N/mm$^2$.

Manufacturing of [Fixing Belt 5]

[Fixing belt 5] was manufactured in the same manner as [Fixing belt 4] except that the thickness of the elastic layer was changed to 50 μm and the thickness of the releasing layer was changed to 30 μm. [Fixing Belt 5] had a Martens hardness of 2.0 N/mm$^2$.

Table 5 shows properties of [Fixing belt 1] to [Fixing belt 5].

TABLE 5

| | Material constituting substrate | Thickness (μm) of elastic layer | Thickness (μm) of releasing layer | Martens hardness (N/mm$^2$) |
|---|---|---|---|---|
| Fixing belt 1 | Polyimide | 150 | 5 | 0.2 |
| Fixing belt 2 | Nickel | 100 | 10 | 0.4 |
| Fixing belt 3 | Nickel | 100 | 15 | 0.9 |
| Fixing belt 4 | SUS | 100 | 20 | 1.3 |
| Fixing belt 5 | SUS | 50 | 30 | 2.0 |

Martens Hardness

The martens hardness of a fixing belt was measured as follows: A fixing belt was cut out to a square 10 mm×100 mm, thereafter placed on a stage of a hardness measuring device (Fischerscope H-100, manufactured by Fischer Instruments K.K. Japan) with the releasing layer upward, and measured at 23° C.

A microVickers indenter was used. A test of repeating application of load and no load to the fixing belt in turns with the press-in depth of 20 μm at most and the holding time of 30 seconds. The average of ten portions was defined as Martens hardness of the fixing belt.

Example 1

A solid image 3 cm×8 cm with a small attachment amount of toner of from 0.30 mg/cm$^2$ to 0.50 mg/cm$^2$ and a solid images 3 cm×8 cm with large attachment amount of toner of from 0.70 mg/cm$^2$ to 0.90 mg/cm$^2$ were formed on photocopying paper (<70>, manufactured by Ricoh Business Expert Co., Ltd.) using a development agent containing [Toner 1] and a cascade development device. [Fixing belt 1] was mounted onto the fixing device of imagio MP C5002 (manufactured by Ricoh Co., Ltd.) to fix the solid images while changing the temperature of the fixing belt.

The temperature of the fixing belt below which cold offset occurred was defined as the lowest fixing temperature and the temperature of the fixing belt above which hot offset occurred was defined as the highest fixing temperature. The fixing range was defined as the difference between the highest fixing temperature and the lowest fixing temperature in the case of the large attachment of toner.

The linear speed of the nip of the fixing device was set to 250 mm/s.

In addition, the surface pressure of the nip was adjusted by adjusting the distance between the fixing roller and the pressure roller. To be specific, the surface pressure at the center portion about the shaft direction measured by using a surface pressure distribution measuring system (I-SCAN, manufactured by NITTA Corporation) was adjusted to be 1.2 kgf/cm$^2$.

Example 2

Solid images were formed and fixed in the same manner as in Example 1 except that [Toner 2] was used instead of [Toner 1] and [Fixing belt 2] was used instead of [Fixing belt 1].

Example 3

Solid images were formed and fixed in the same manner as in Example 1 except that [Toner 3] was used instead of [Toner 1] and [Fixing belt 3] was used instead of [Fixing belt 1].

Example 4

Solid images were formed and fixed in the same manner as in Example 1 except that [Toner 4] was used instead of [Toner 1].

Example 5

Solid images were formed and fixed in the same manner as in Example 1 except that [Toner 5] was used instead of [Toner 1].

Comparative Example 1

Solid images were formed and fixed in the same manner as in Example 1 except that [Toner 4] was used instead of [Toner 1] and [Fixing belt 4] was used instead of [Fixing belt 1].

Comparative Example 2

Solid images were formed and fixed in the same manner as in Example 1 except that [Toner 5] was used instead of [Toner 1] and [Fixing belt 5] was used instead of [Fixing belt 1].

Example 6

Solid images were formed and fixed in the same manner as in Example 1 except that [Toner 6] was used instead of [Toner 1].

Example 7

Solid images were formed and fixed in the same manner as in Example 1 except that [Toner 7] was used instead of [Toner 1].

Comparative Example 3

Solid images were formed and fixed in the same manner as in Example 1 except that [Toner 8] was used instead of [Toner 1].

Comparative Example 4

Solid images were formed and fixed in the same manner as in Example 1 except that [Toner 9] was used instead of [Toner 1].

Example 8

Solid images were formed and fixed in the same manner as in Example 1 except that [Toner 10] was used instead of [Toner 1].

Example 9

Solid images were formed and fixed in the same manner as in Example 1 except that the surface pressure of the nip was changed to 0.6 kgf/cm$^2$.

Example 10

Solid images were formed and fixed in the same manner as in Example 8 except that the surface pressure of the nip was changed to 1.4 kgf/cm$^2$.

Example 11

Solid images were formed and fixed in the same manner as in Example 8 except that the surface pressure of the nip was changed to 0.4 kgf/cm$^2$.

Example 12

Solid images were formed and fixed in the same manner as in Example 8 except that [Fixing belt 2] was used instead of [Fixing belt 1].

Example 13

Solid images were formed and fixed in the same manner as in Example 8 except that [Fixing belt 3] was used instead of [Fixing belt 1].

Comparative Example 5

Solid images were formed and fixed in the same manner as in Example 8 except that the surface pressure of the nip was changed to 1.6 kgf/cm$^2$.

Comparative Example 6

Solid images were formed and fixed in the same manner as in Example 8 except that [Fixing belt 4] was used instead of [Fixing belt 1].

Comparative Example 7

Solid images were formed and fixed in the same manner as in Example 8 except that [Fixing belt 5] was used instead of [Fixing belt 1].

Example 14

Solid images were formed and fixed in the same manner as in Example 1 except that [Toner 11] was used instead of [Toner 1].

Example 15

Solid images were formed and fixed in the same manner as in Example 1 except that [Toner 12] was used instead of [Toner 1] and [Fixing belt 2] was used instead of [Fixing belt 1].

Example 16

Solid images were formed and fixed in the same manner as in Example 1 except that [Toner 13] was used instead of [Toner 1] and [Fixing belt 3] was used instead of [Fixing belt 1].

Example 17

Solid images were formed and fixed in the same manner as in Example 1 except that [Toner 14] was used instead of [Toner 1].

Example 18

Solid images were formed and fixed in the same manner as in Example 1 except that [Toner 15] was used instead of [Toner 1] and [Fixing belt 2] was used instead of [Fixing belt 1].

Example 19

Solid images were formed and fixed in the same manner as in Example 1 except that [Toner 16] was used instead of [Toner 1] and [Fixing belt 3] was used instead of [Fixing belt 1].

Example 20

Solid images were formed and fixed in the same manner as in Example 1 except that [Toner 17] was used instead of [Toner 1].

Example 21

Solid images were formed and fixed in the same manner as in Example 1 except that [Toner 18] was used instead of [Toner 1] and [Fixing belt 2] was used instead of [Fixing belt 1].

Example 22

Solid images were formed and fixed in the same manner as in Example 1 except that [Toner 19] was used instead of [Toner 1] and [Fixing belt 3] was used instead of [Fixing belt 1].

Example 23

Solid images were formed and fixed in the same manner as in Example 1 except that [Toner 20] was used instead of [Toner 1].

Example 24

Solid images were formed and fixed in the same manner as in Example 1 except that [Toner 21] was used instead of [Toner 1] and [Fixing belt 2] was used instead of [Fixing belt 1].

Example 25

Solid images were formed and fixed in the same manner as in Example 1 except that [Toner 22] was used instead of [Toner 1] and [Fixing belt 3] was used instead of [Fixing belt 1].

Example 26

Solid images were formed and fixed in the same manner as in Example 1 except that [Toner 23] was used instead of [Toner 1].

Example 27

Solid images were formed and fixed in the same manner as in Example 1 except that [Toner 24] was used instead of [Toner 1] and [Fixing belt 2] was used instead of [Fixing belt 1].

Comparative Example 8

Solid images were formed and fixed in the same manner as in Example 1 except that [Toner 25] was used instead of [Toner 1].

Comparative Example 9

Solid images were formed and fixed in the same manner as in Example 1 except that [Toner 26] was used instead of [Toner 1] and [Fixing belt 2] was used instead of [Fixing belt 1].

Comparative Example 10

Solid images were formed and fixed in the same manner as in Example 1 except that [Toner 27] was used instead of [Toner 1] and [Fixing belt 3] was used instead of [Fixing belt 1].

The combinations of the toners and the fixing belt of Examples 1 to Examples 24 and Comparative Examples 1 to 10 are shown in Table 6d.

TABLE 6

| | Toner | Fixing belt |
|---|---|---|
| Example 1 | Toner 1 | Fixing belt 1 |
| Example 2 | Toner 2 | Fixing belt 2 |
| Example 3 | Toner 3 | Fixing belt 3 |
| Example 4 | Toner 4 | Fixing belt 1 |
| Example 5 | Toner 5 | Fixing belt 1 |
| Comparative Example 1 | Toner 4 | Fixing belt 4 |
| Comparative Example 2 | Toner 5 | Fixing belt 5 |

TABLE 6-continued

| | Toner | Fixing belt |
|---|---|---|
| Example 6 | Toner 6 | Fixing belt 1 |
| Example 7 | Toner 7 | Fixing belt 1 |
| Comparative Example 3 | Toner 8 | Fixing belt 1 |
| Comparative Example 4 | Toner 9 | Fixing belt 1 |
| Example 8 | Toner 10 | Fixing belt 1 |
| Example 9 | Toner 10 | Fixing belt 1 |
| Example 10 | Toner 10 | Fixing belt 1 |
| Example 11 | Toner 10 | Fixing belt 1 |
| Example 12 | Toner 10 | Fixing belt 2 |
| Example 13 | Toner 10 | Fixing belt 3 |
| Comparative Example 5 | Toner 10 | Fixing belt 1 |
| Comparative Example 6 | Toner 10 | Fixing belt 4 |
| Comparative Example 7 | Toner 10 | Fixing belt 5 |
| Example 14 | Toner 11 | Fixing belt 1 |
| Example 15 | Toner 12 | Fixing belt 2 |
| Example 16 | Toner 13 | Fixing belt 3 |
| Example 17 | Toner 14 | Fixing belt 1 |
| Example 18 | Toner 15 | Fixing belt 2 |
| Example 19 | Toner 16 | Fixing belt 3 |
| Example 20 | Toner 17 | Fixing belt 1 |
| Example 21 | Toner 18 | Fixing belt 2 |
| Example 22 | Toner 19 | Fixing belt 3 |
| Example 23 | Toner 20 | Fixing belt 1 |
| Example 24 | Toner 21 | Fixing belt 2 |
| Example 25 | Toner 22 | Fixing belt 3 |
| Example 26 | Toner 23 | Fixing belt 1 |
| Example 27 | Toner 24 | Fixing belt 2 |
| Comparative Example 8 | Toner 25 | Fixing belt 1 |
| Comparative Example 9 | Toner 26 | Fixing belt 2 |
| Comparative Example 10 | Toner 27 | Fixing belt 3 |

The evaluation results of the toners of Examples and Comparative Examples are shown in Table 7.

TABLE 7

| | Surface pressure (kg/cm$^2$) of nip | Lowest fixing temperature (° C.) Large amount of attachment | Lowest fixing temperature (° C.) Small amount of attachment | Highest fixing temperature (° C.) | Fixing Range (° C.) |
|---|---|---|---|---|---|
| Example 1 | 1.2 | 123 | 118 | 180 | 57 |
| Example 2 | 1.2 | 105 | 101 | 180 | 75 |
| Example 3 | 1.2 | 115 | 114 | 190 | 75 |
| Example 4 | 1.2 | 110 | 105 | 170 | 60 |
| Example 5 | 1.2 | 108 | 103 | 170 | 62 |
| Comparative Example 1 | 1.2 | 110 | 110 | 170 | 60 |
| Comparative Example 2 | 1.2 | 108 | 112 | 170 | 62 |
| Example 6 | 1.2 | 115 | 110 | 170 | 55 |
| Example 7 | 1.2 | 115 | 110 | 190 | 75 |
| Comparative Example 3 | 1.2 | 105 | 99 | 150 | 45 |
| Comparative Example 4 | 1.2 | 110 | 104 | 150 | 40 |
| Example 8 | 1.2 | 110 | 105 | 170 | 60 |
| Example 9 | 0.6 | 113 | 112 | 170 | 57 |
| Example 10 | 1.4 | 108 | 101 | 160 | 52 |
| Example 11 | 0.4 | 115 | 116 | 170 | 55 |
| Example 12 | 1.2 | 110 | 106 | 170 | 60 |
| Example 13 | 1.2 | 110 | 108 | 170 | 60 |
| Comparative Example 5 | 1.6 | 108 | 100 | 155 | 47 |
| Comparative Example 6 | 1.2 | 110 | 110 | 170 | 60 |

TABLE 7-continued

| | Surface pressure (kg/cm$^2$) of nip | Lowest fixing temperature (° C.) Large amount of attachment | Lowest fixing temperature (° C.) Small amount of attachment | Highest fixing temperature (° C.) | Fixing Range (° C.) |
|---|---|---|---|---|---|
| Comparative Example 7 | 1.2 | 110 | 114 | 170 | 60 |
| Example 14 | 1.2 | 117 | 112 | 170 | 53 |
| Example 15 | 1.2 | 112 | 108 | 180 | 68 |
| Example 16 | 1.2 | 109 | 107 | 170 | 61 |
| Example 17 | 1.2 | 122 | 117 | 180 | 58 |
| Example 18 | 1.2 | 120 | 120 | 190 | 70 |
| Example 19 | 1.2 | 119 | 118 | 190 | 71 |
| Example 20 | 1.2 | 120 | 115 | 180 | 60 |
| Example 21 | 1.2 | 112 | 108 | 170 | 58 |
| Example 22 | 1.2 | 114 | 112 | 170 | 56 |
| Example 23 | 1.2 | 125 | 120 | 180 | 55 |
| Example 24 | 1.2 | 107 | 103 | 180 | 73 |
| Example 25 | 1.2 | 126 | 126 | 200 | 74 |
| Example 26 | 1.2 | 107 | 102 | 160 | 53 |
| Example 27 | 1.2 | 130 | 130 | 210 | 80 |
| Comparative Example 8 | 1.2 | 105 | 99 | 150 | 45 |
| Comparative Example 9 | 1.2 | 132 | 127 | 170 | 38 |
| Comparative Example 10 | 1.2 | 128 | 126 | 170 | 42 |

As seen in Table 7, the toners of Example 1 to Example 27 are excellent with regard to low temperature fixability and hot offset resistance.

On the other hand, the low temperature fixability of the toners of Comparative Example 1 and Comparative Example 2 are degraded because [Fixing belt 4] and [Fixing belt 5] having a Martens hardness of 1.3 n/mm$^2$ and 2.0 N/mm$^2$ at 23° C., respectively, are used.

In Comparative Example 3 and Comparative Example 4, the fixing ranges of the toners become narrow because S(120)/S(23) of [Toner 8] and [Toner 9] are 1.75, and 1.72, respectively.

In Comparative Example, 5, the hot offset resistance of the toner is degraded because the surface pressure of the nip is 1.6 kgf/cm$^2$.

The low temperature fixability of the toners of Comparative Example 6 and Comparative Example 7 are degraded because [Fixing belt 4] and [Fixing belt 5] having a Martens hardness of 1.3 n/mm$^2$ and 2.0 N/mm$^2$ at 23° C., respectively, are used.

In Comparative Example 8, Comparative Example 9, and Comparative Example 10, the fixing ranges of the toners become narrow because S(120)/S(23) of [Toner 25], [Toner 26], and [Toner 27] are 1.63, 1.76, and 1.76, respectively.

The image forming apparatus according to the present invention has excellent low temperature fixability and hot offset resistance even for toner having a low ductility.

Having now fully described embodiments of the present invention, it will be apparent to one of ordinary skill in the art that many changes and modifications can be made thereto without departing from the spirit and scope of embodiments of the invention as set forth herein.

What is claimed is:

1. An image forming apparatus comprising:

an image bearing member;

a charger to charge the image bearing member;

an irradiator to expose the image bearing member to light to form a latent electrostatic image thereon;

a development device comprising an accommodation unit that accommodates toner to develop the latent electrostatic image therewith to obtain a visible image;

a transfer device to transfer the visible image to a recording medium; and a fixing device to fix the visible image transferred onto the recording medium, the fixing device comprising:

a fixing rotation member; and a pressure rotation member to form a nipping portion by contacting the fixing rotation member, wherein a surface pressure of the nipping portion is 1.5 $kgf/cm^2$ or less, wherein the fixing rotation member has a Martens hardness of 1.0 $N/mm^2$ or less at 23° C., wherein a ratio of a projected area of a single particle of the toner onto the recording medium at 120° C. to a projected area of a single particle of the toner onto the recording medium at 23° C. is 1.60 or less.

2. The image forming apparatus according to claim 1, wherein the fixing rotation member has a Martens hardness of 0.5 $N/mm^2$ or less at 23° C.

3. The image forming apparatus according to claim 1, wherein the nipping portion has a surface pressure of from 0.5 $kgf/cm^2$ to 1.3 $kgf/cm^2$.

4. The image forming apparatus according to claim 1, wherein the fixing device further comprises a heating source to heat the fixing rotation member, wherein the fixing device further comprises a nipping portion forming member arranged inside the fixing rotation member to form the nipping portion while opposing the pressure rotating member.

5. The image forming apparatus according to claim 1, wherein the toner comprises a crystalline resin.

6. The image forming apparatus according to claim 5, wherein the toner has a crystalline degree of 15% or higher.

7. The image forming apparatus according to claim 5, wherein the ratio of a projected area of a single particle of the toner onto the recording medium at 120° C. to a projected area of a single particle of the toner onto the recording medium at 23° C. is 1.20 or less.

8. The image forming apparatus according to claim 5, wherein the crystalline resin has at least one of a urethane bond or a urea bond.

9. The image forming apparatus according to claim 1, wherein the toner satisfies the following relation 1:

$$T2(°\,C.)-T1(°\,C.)\leq 20, \qquad \text{relation 1,}$$

where T1 (° C.) represents a temperature when a storage elastic modulus of the toner is $3.0\times10^4$ Pa and T2 (° C.) represents a temperature when a storage elastic modulus of the toner is $1.0\times10^4$ Pa, wherein the toner has a glass transition temperature of from 30° C. to 50° C. during a first time temperature rising as measured by a differential scanning calorimetry (DSC).

10. The image forming apparatus according to claim 9, wherein the toner comprises a non-linear non-crystalline polyester and a linear non-crystalline polyester.

11. The image forming apparatus according to claim 9, wherein a component of the toner insoluble in tetrahydrofuran (THF) has a glass transition temperature of from −40° C. to 30° C. during a second time temperature rising as measured by a differential scanning calorimetry (DSC), wherein the toner satisfies the following relations 2 and 3:

$$1\times10^5\leq G'(100)\leq 1\times10^7 \qquad \text{relation 2,}$$

$$G'(40)/G'(100)\leq 35 \qquad \text{relation 3,}$$

where G'(100) (Pa) represents a storage elastic modulus of the component of the toner insoluble in tetrahydrofuran (THF) at 100° C. and G'(40) (Pa) represents a storage elastic modulus of the component of the toner insoluble in tetrahydrofuran (THF) at 40° C.

12. The image forming apparatus according to claim 9, wherein the toner comprises a crystalline polyester, wherein a component of the toner soluble in tetrahydrofuran (THF) has a glass transition temperature of from 20° C. to 35° C. during a second time temperature rising as measured by a differential scanning calorimetry (DSC).

13. The image forming apparatus according to claim 9, wherein a component of the toner insoluble in tetrahydrofuran (THF) accounts for from 20% by weight to 35% by weight.

* * * * *